United States Patent [19]

Nakamura et al.

[11] Patent Number: 4,783,396

[45] Date of Patent: Nov. 8, 1988

[54] SILVER HALIDE PHOTOGRAPHIC MATERIALS

[75] Inventors: Koki Nakamura; Sahigeru Nakamura, both of Kanagawa, Japan

[73] Assignee: Fuji Photo Film Co., Ltd., Ashigara, Japan

[21] Appl. No.: 925,350

[22] Filed: Oct. 30, 1986

[30] Foreign Application Priority Data

Oct. 31, 1985 [JP] Japan ..... 60-244873
Apr. 17, 1986 [JP] Japan ..... 61-88625

[51] Int. Cl.[4] ..... G03C 5/54; G03C 7/26; G03C 1/06; G03C 1/34

[52] U.S. Cl. ..... 430/353; 430/203; 430/223; 430/446; 430/543; 430/559; 430/562; 430/564; 430/566; 430/598; 430/551; 430/613; 430/542; 430/606; 430/617; 430/623; 430/631; 430/955; 430/956; 430/957; 430/958; 430/959

[58] Field of Search ..... 430/203, 617, 955, 956, 430/958, 959, 223, 957, 559, 562, 564, 566, 607, 623, 598, 613, 543, 551, 353, 542, 446, 606, 631

[56] References Cited

U.S. PATENT DOCUMENTS

| | | | |
|---|---|---|---|
| 3,980,479 | 9/1976 | Fields et al. | 430/222 |
| 4,139,379 | 2/1979 | Chasman et al. | 430/223 |
| 4,199,354 | 4/1980 | Hinshaw | 430/226 |
| 4,199,355 | 4/1980 | Hinshaw et al. | 430/223 |
| 4,232,107 | 11/1980 | Janssens | 430/223 |
| 4,248,962 | 2/1981 | Lau | 430/958 |
| 4,343,893 | 8/1982 | Donald et al. | 430/401 |
| 4,369,243 | 1/1983 | Credner et al. | 430/223 |
| 4,450,223 | 5/1984 | Poucke et al. | 430/223 |

FOREIGN PATENT DOCUMENTS

| | | |
|---|---|---|
| 57-84453 | 5/1982 | Japan . |
| 1593669 | 7/1981 | United Kingdom . |

*Primary Examiner*—Richard L. Schilling
*Attorney, Agent, or Firm*—Sughrue, Mion, Zinn, Macpeak and Seas

[57] ABSTRACT

The present invention provides silver halide photographic materials containing a havel compound, which when reduced, releases a photographically useful group as triggered off by the cleavage of the nitrogen-oxygen single bond in the compound and which is represented by the following general formula (I):

(I)

wherein EAG represents a group which accepts an electron from a reducing substance; N and O each represents nitrogen atom and an oxygen atom, respectively; $R^1$ and $R^2$ each represents a substituent other than a hydrogen atom, and when $R^1$ or $R^2$ is bonded to —(Time)$_t$PUG, $R^1$ or $R^2$ is a mere bond or a substituent other than a hydrogen atom, and $R^1$ and $R^2$ may be bonded to each other to form a ring; Time represents a group for releasing PUG via the subsequent reaction as triggered off by the cleavage of the nitrogen-oxygen single bond in the compound of general formula (I); PUG represents a photographically useful group; t is an integer of 0 or 1; the full lines in the formula each means a bond; and the dotted lines therein mean that at least one of the dotted lines is a bond.

In particular, compounds of the following formula (II) and (III) are preferred among those of the formula (I):

(II)

wherein $R^3$ is bonded to the nitrogen atom or oxygen atom in the formula, and represents an atomic group necessary for the formation of a 3 to 8-membered mono- or fused-hetero ring;

(III)

wherein $R^4$ and $R^5$ each represents a mere bond, a hydrogen atom or a substituent group, and they may be bonded to each other to form a saturated or unsaturated carbon ring or hetero ring; and X represents a divalent binding group.

22 Claims, No Drawings

SILVER HALIDE PHOTOGRAPHIC MATERIALS

FIELD OF THE INVENTION

The present invention relates to silver halide photographic materials, in particular, to those containing a new compound(s), which, when reduced, can release a photographically useful group which release is triggered by the cleavage of the nitrogen-oxygen single bond in the compound.

BACKGROUND OF THE INVENTION

In photographic elements compounds which provide a photographically useful group, which is immobile, ballast stabilized or blocked at the active site thereof include positive forming compounds as illustrated in Belgian Pat. No. 810,195, U.S. Pat. Nos. 4,199,354, 3,980,479 and 4,139,379 and Japanese patent application (OPI) No. 130972/79. (The term "OPI" as used herein means an "unexamined published application".) These compounds are immobile or photographically inacitve but can release a mobile photographically useful group by an intra-molecular nucleophilic displacement reaction or intra-molecular electron transfer reaction.

Compounds having the aforesaid function have various merits and improving the characteristic and features of positive forming compounds has been desired to further increase the freedom of planning and the tolerance in the formation of photographic elements and the methods. In photographic elements before and after processing, the possibility of providing compounds with higher stability is desirable. In addition, the provision of more advantageous means for the control of the release of the photographically useful group or component is also desirable.

The present inventors studied reactions for cleaving a single bond in a compound after the compound has received an electron from a reducing substance. Various types of single bonds which may be relatively easily cleaved by reduction are known, including a carbon-sulfur bond and a carbon-halogen bond. However, such single bonds that can be easily cleaved by reduction but which are stable to acids, alkalis and heat are fairly limited. Further, such bonds that are stable to the aforesaid various conditions but which can be reduced by conventional organic reducing agents which are generally used in the field of photography to participate in the release of photographically useful groups are extremely limited. Some compounds are known which act in accordance with the above reaction, for example, as described in European Pat. No. $0045129A_2$ and West German (OLS) No. 3,008,588. However, it is difficult to conclude that these compounds sufficiently satisfy the desired characteristics of positive forming compounds as well as the necessary tolerance and freedom in the formation or planning of photographic elements, generally because of the chemical properties of the bond to be cleaved or some for reasons in the synthesis of the compounds.

SUMMARY OF THE INVENTION

The object of the present invention is to provide silver halide photographic materials containing a novel compound(s) which is/are stable to acids, alkalis and heat but, when the compound accepts an electron from a reducing substance as is generally used in the field of photography, it releases a photographically useful group which is triggered by the easy cleavage of the nitrogen-oxygen single bond in the compound.

The inventors selected the nitrogen-oxygen bond as the bond which is stable to acids, alkalis and heat and which is easily cleaved by reduction and conducted studies thereon. It is known that the stability of the nitrogen-oxygen single bond to acids, alkalis and heat largely varies depending upon the substituents thereon, but the present inventors confirmed that said bond may be sufficiently stabilized by selecting appropriate substituents to be substituted thereon so that the bond may be used in photographic materials. Further, the inventors directed their studies to facilitating the reductive cleavage of the nitrogen-oxygen single bond with a compound which is known as a general photographic reducing agent and found that the nitrogen-oxygen bond may easily be cleaved by the introduction of an electron-accepting group to the nitrogen atom.

The cleavage of the nitrogen-oxygen single bond in the thus planned and synthesized compounds is substantially irreversible, and therefore, the cleavage reaction proceeds at a surprisingly higher speed than the speed expected from the oxidation-reduction equilibrium system. Accordingly, any stable reducing agent which is sufficiently resistant to oxidation by oxygen in the air may be used for the reduction of the compounds, which is highly advantageous.

The detailed mechanism of the cleavage reaction of the nitrogen-oxygen bond per the present invention is unclear to date, but the inventors have assumed that the reaction proceeds a mechanism similar to the continuous reaction described in *Angewante Chemie International Edition,* Vol. 14 (1975), No. 11, p. 734.

More precisely, the compound of the present invention will accept one electron from a reducing substance to become an anion radical and the reducing substance assumes the one-electron-oxidized form. This reaction is considered to be in an equilibrium state, but since the formation of the anion-radical intermediate proceeds irreversibly to the direction for the cleavage of the nitrogen-oxygen single bond in the reaction, the reaction itself is considered to proceed easily in the direction of releasing the photographically useful group from the compound.

The present invention is based upon the aforesaid technical background. More precisely, in a compound having a nitrogen-oxygen single bond with an electron-accepting group bonded thereto, the nitrogen-oxygen single bond is cleaved when the electron-accepting group accepts an electron, whereupon the de-blocked nitrogen atom or oxygen atom acts as a trigger thereby to release a photographically useful group from the compound.

Accordingly, the present invention provides silver halide photographic materials containing a novel compound or compounds of the following formula (I), which has or have the aforesaid function.

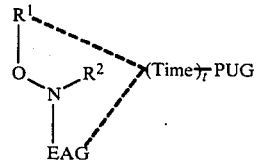

(I)

in which:

EAG represents a group which accepts an electron from a reducing substance;

N and O each represents a nitrogen atom or oxygen atom, respectively, and the single bond therebetween is cleaved when EAG has accepted an electron;

$R^1$ and $R^2$ each represents a mere bond or a substituent other than a hydrogen atom, and when $R^1$ or $R^2$ is bonded to —(Time)$_t$ PUG, the $R^1$ or $R^2$ may be a mere bond, or $R^1$ and $R^2$ may bond to each other to form a ring;

Time represents a group which releases PUG via subsequent reaction triggered by the cleavage of the nitrogen-oxygen single bond after EAG has accepted an electron;

PUG represents a photographically useful group;

t is an integer of 0 or 1; and the full lines in the formula each mean a bond is present, while the dotted lines mean that at least one dotted line represents a bond (hereafter the same unless otherwise indicated).

DETAILED DESCRIPTION OF THE INVENTION

The compounds of formula (I) are positive forming compounds, and in particular, those of the following formula (II) are preferred, especially for increasing the tolerance and the freedom on the characteristics of the positive forming compounds and the synthesis planning thereof.

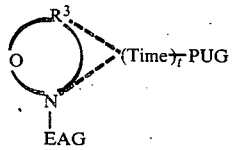

(II)

in which $R^3$ is bonded to the nitrogen atom and oxygen atom in the formula, and represents an atomic group necessary for the formation of a 3 to 8-membered mono- or fused-hetero-ring; other synbols are same as those in formula (I).

Substituents in the formulae (I) and (II) are described in detail hereunder.

EAG represents a group for accepting an electron from a reducing substance and is bonded to at least the nitrogen atom in the compound. In particular, EAG is preferably represented by the following formulae (A) of (B):

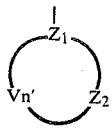

(A)

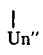

(B)

In formula (A), $Z_1$ represents

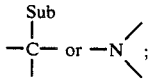

Vn' represents an atomic group for forming a 3 to 8-membered ring together with $Z_1$ and $Z_2$;

n' is an integer of 3 to 8 and Vn's thus mean the following:

| | |
|---|---|
| $V_3$; $-Z_3-$, | $V_4$; $-Z_3-Z_4-$, |
| $V_5$; $-Z_3-Z_4-Z_5-$, | $V_6$; $-Z_3-Z_4-Z_5-Z_6-$, |
| $V_7$; $-Z_3-Z_4-Z_5-Z_6-Z_7$, | $V_8$; $-Z_3-Z_4-Z_5-Z_6-Z_7-Z_8-$; |

$Z_2$ to $Z_8$ each represents

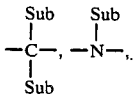

—O—, —S— or —$SO_2$—;

Sub represents a mere bond ($\pi$-bond) or a hydrogen atom or a substituent as illustrated below; the Sub's may be same or different, or they may be bonded to each other to form a 3 to 8-membered, saturated or unsaturated carbon-ring or hetero-ring.

In formula (A), the Subs are selected so that the total of the Hammett's substituent constant ($\sigma_p$) of the Sub's is +0.09 or more, more preferably +0.3 or more, most preferably +0.45 or more, with an upper limit being preferably +2.6.

Examples of the substituents as Sub are given below (in these substituents, the number of the carbon atom(s) is preferably 0 to 40).

Substituted or unsubstituted alkyl groups (such as a methyl group, ethyl group, sec-butyl group, t-octyl group, benzyl group, cyclohexyl group, chloromethyl group, dimethylaminomethyl group, n-hexadecyl group, trifluoromethyl group, 3,3,3-trichloropropyl group, methoxycarbonylmethyl group), substituted or unsubstituted alkenyl groups (such as a vinyl group, 2-chlorovinyl group, 1-methylvinyl group), substituted or unsubstituted alkynyl groups (such as an ethynyl group, 1-propinyl group), a cyano group, a nitro group, a halogen atom (such as fluorine, chlorine, bromine, iodine), substituted or unsubstituted heterocyclic groups (such as a 2-pyridyl group, 1-imidazolyl group, benzothia-2-yl group, morpholino group, benzoxazole-2-yl group), a sulfo group, a carboxyl group, substituted or unsubstituted aryloxycarbonyl or alkoxycarbonyl groups (such as a methoxycarbonyl group, ethoxycarbonyl group, tetradecyloxycarbonyl group, 2-methoxycarbonyl group, phenoxycarbonyl group, 4-cyanophenoxylcarbonyl group, 2-chlorophenoxycarbonyl group), substituted or unsubstituted carbamoyl groups (such as a carbamoyl group, methylcarbamoyl group, diethylcarbamoyl group, methylhexadecylcarbamoyl group, methyloctadecylcarbamoyl group, phenylcarbamoyl group, 2,4,6-trichlorophenylcarbamoyl group, N-ethyl-N-phenylcarbamoyl group, 3-hexadecylsulfamoylphenylcarbamoyl group), a hydroxyl group, substituted or unsubstituted azo groups (such as a phenylazo group, p-methoxyphenylazo group, 2-cyano-4-methanesulfonylphenylazo group), substituted or unsubstituted aryloxy or alkoxy groups (such as a methoxy group, ethoxy group, dodecyloxy group, benzyloxy group, phenoxy group, 4-methoxyphenoxy group, 3-acetylaminophenoxy group, 3-methoxycarbonylpropyloxy group, 2-trimethylammonioethoxy group), a sulfino group, a sulpheno group, a mercapto group, substituted or unsubstituted acyl groups (such as an acetyl group, trifluoroacetyl group, n-butyroyl group, t-butyroyl group, benzoyl group, 2-carboxybenzoyl group, 3-nitrobenzoyl group, formyl group), substituted or unsubstituted arylthio or alkylthio group (such as a methylthio group, ethylthio group, t-octylthio group, hexadecylthio group, phenylthio group, 2,4,5-trichlorophenylthio group, 2-methoxy-5-t-octylphenylthio group, 2-acetylaminophenylthio group), substituted or unsubstituted aryl groups (such as a phenyl group, naphthyl group, 3-sulfophenyl group, 4-methoxyphenyl group, 3-lauroylaminophenyl group), substituted or unsubstituted sulfonyl groups (such as a methylsulfonyl group, chloromethylsulfonyl group, n-octylsulfonyl group, n-hexadecylsulfonyl group, sec-octylsulfonyl group, p-toluenesulfonyl group, 4-chlorophenylsulfonyl group, 4-dodecylphenylsulfonyl group, 4-dodecyloxyphenylsulfonyl group, 4-nitrophenylsulfonyl group), substituted or unsubstituted sulfinyl groups (such as a methylsulfinyl group, dodecylsulfinyl group, phenylsulfinyl group, 4-nitrophenylsulfinyl group), substituted or unsubstituted amino groups (such as a methylamino group, diethylamino group, methyloctadecylamino group, phenylamino group, ethylphenylamino group, 3-tetradecylsulfamoylphenylamino group, acetylamino group, trifluoroacetylamino group, N-hexadecylacetylamino group, N-methylbenzoylamino group, methoxycarbonylamino group, phenoxycarbonylmethyl group, N-methoxyacetylamino group, amidinoamino group, phenylaminocarbonylamino group, 4-cyanophenylaminocarbonylamino group, N-ethylethoxycarbonylamino group, N-methyldodecylsulfonylamino group, N-(2-cyanoethyl)-p-toluenesulfonylamino group, hexadecylsulfonylamino group, trimethylammonio group), substituted or unsubstituted sulfamoyl groups (such as a dimethylsulfamoyl group, hexadecylsulfamoyl group, sulfamoyl group, methyloctadecylsulfamoyl group, methylhexadecylsulfamoyl group, 2-cyanoethylhexadecylsulfamoyl group, phenylsulfamoyl group, N-(3,4-dimethylphenyl)N-octylsulfamoyl group, dibutylsulfamoyl group, dioctadecylsulfamoyl group, bis(2-methoxycarbonylethyl)-sulfamoyl group), substituted or unsubstituted acyloxy groups (such as an acetoxy group, benzoyloxy group, decyloyloxy group, chloroacetoxy group), and substituted or unsubstituted sulfonyloxy groups (such as a methylsulfonyloxy group, p-toluenesulfonyloxy group, p-chlorophenylsulfonyloxy group).

In formula (B), n'' is an integer of 1 to 6 and then Un'' is meant to include:

| | |
|---|---|
| $U_1$; $-Y_1$, | $U_2$; $-Y_1-Y_2$, |
| $U_3$; $-Y_1-Y_2-Y_3$, | $U_4$; $-Y_1-Y_2-Y_3-Y_4$, |
| $U_5$; $-Y_1-Y_2-Y_3-Y_4-Y_5$, | $U_6$; $-Y_1-Y_2-Y_3-Y_4-Y_5-Y_6$ |

$Y_1$ through $Y_6$ each represents

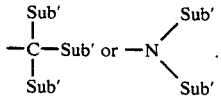

Sub' represents a mere bond ($\sigma$-bond or $\pi$-bond) or the same substituents as Sub as mentioned for formula (A).

In the formula (B), the (Sub')s are so selected that the total of the Hammett's substituent constant ($\sigma_p$) of the substituents is +0.09 or more, more preferably +0.3 or more, most preferably +0.45 or more, with an upper limit being preferably +2.6.

Specific examples of EAG include aryl groups substituted with at least one electron-attaching group (such as a 4-nitrophenyl group, 2-nitro-4-N-methyl-N-octadecylsulfamoylphenyl group, 2-N,N-dimethylsulfamoyl-4-nitrophenyl group, 2-cyano-4-octadecylsulfonylphenyl group, 2,4-dinitrophenyl group, 2,4,6-tricyanophenyl group, 2-nitro-4-N-methyl-N-octadecylcarbamoylphenyl group, 2-nitro-5-octylthiophenyl group, 2,4-dimethanesulfonylphenyl group, 3,5-dinitrophenyl group, 2-chloro-4-nitro-5-methylphenyl group, 2-nitro-3,5-dimethyl-4-tetradecylsulfonylphenyl group, 2,4-dnitronaphthyl group, 2-ethylcarbamoyl-4-nitrophenyl group, 2,4-bis-dodecylsulfonyl-5-trifluoromethylphenyl group, 2,3,4,5,6-pentafluorophenyl group, 2-acetyl-4-nitrophenyl group, 2,4-diacetylphenyl group, 2-nitro-4-trifluoromethylphenyl group), substituted or unsubstituted heterocyclic groups (such as a 2-pyridyl group, 2-pyrazyl group, 5-nitro-2-pyridyl group, 5-N-hexadecylcarbamoyl-2-pyridyl group, 4-pyridyl group, 3,5-dicyano-2-pyridyl group, 5-dodecylsulfonyl-2-pyridyl group, 5-cyano-2-pyrazyl group, 4-nitrothiophene-2-yl group, 5-nitro-1,2-dimethylimidazole-4-yl group, 3,5-diacetyl-2-pyridyl group, 1-dodecyl-5-carbamoylpyridinium-2-yl group), substituted or unsubstituted quinone residues (such as a 1,4-benzoquinone-2-yl group, 3,5,6-trimethyl-1,4-benzoquinone-2-yl group, 3-methyl-1,4-naphthoquinone-2-yl group, 3,6-dimethyl-5-hexadecylthio-1,4-benzoquinone-2-yl group, 5-pentadecyl-1,2-benzoquinone-4-yl group) and vinylogues of the aforesaid groups as well as nitroalkyl groups (such as a 2-nitro-2-propyl group), nitroalkenyl groups (such as a 2-nitroethenyl group) and monovalent residues of $\alpha$-diketo compounds (such as a 2-oxopropanoyl group).

$R^3$ represeents, as mentioned in the above, an atomic group necessary for the formation of a 3 to 8-membered hetero-ring and is bonded to the nitrogen atom and the oxygen atom in formula (II). Examples of such hetero-rings are given below.

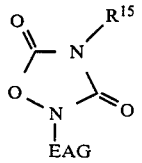

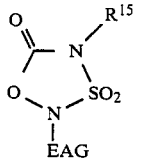

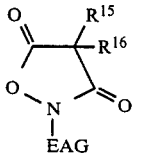

-continued

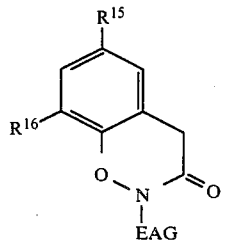

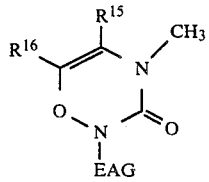

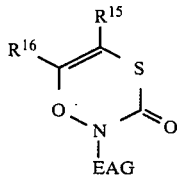

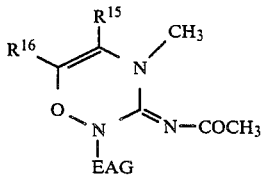

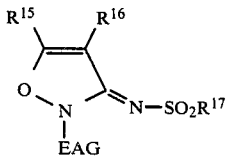

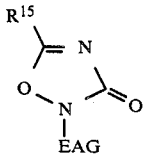

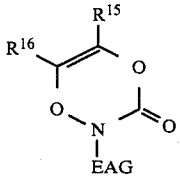

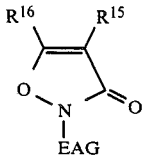

-continued

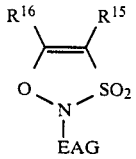

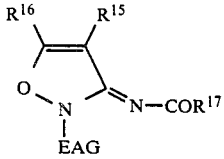

In the above formulae, $R^{15}$, $R^{16}$ and $R^{17}$ each represents a hydrogen atom, an aliphatic group, an aromatic group, a heterocyclic group or —(Time)$_t$PUG.

Among the positive forming compounds of formula (II), more preferred compounds are represented by the following formula (III), as these have better photographic characteristics, i.e., the storage stability in a photographic material is good, the release speed of PUG is fast, and the S/N ratio is good. In other words, PUG is not released only by the action of alkalis, but PUG is first released by the action of the reducing agent:

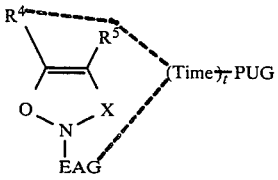

(III)

in which EAG, Time, t and PUG have the same meanings as earlier given; X represents a divalent binding group and is especially preferably

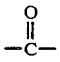

or —$SO_2$; $R^4$ and $R^5$ each represents a hydrogen atom or a substituent; or these may be bonded to each other to form a saturated or unsaturated carbon-ring or hetero-ring.

Preferred examples of $R^4$ are a hydrogen atom, substituted or unsubstituted alkyl groups (such as a methyl group, ethyl group, t-butyl group, octadecyl group, phenethyl group, carboxymethyl group), substituted or unsubstituted aryl group (such as a phenyl group, 3-nitrophenyl group, 4-methoxyphenyl group, 4-acetylaminophenyl group, 4-methanesulfonylphenyl group, 2,4-dimethylphenyl group, 4-tetradecyloxyphenyl group,

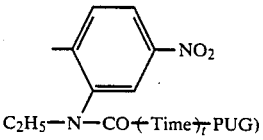

and substituted or unsubstituted heterocyclic groups (such as a 2-pyridyl group, 2-furyl group, 3-pyridyl group).

Preferred examples of $R^5$ are a hydrogen atom, substituted or unsubstituted alkyl groups (such as a methyl group, hydroxymethyl group, $—CH_2—(TIME)_tPUG$), substituted or unsubstituted aryl groups (such as a phenyl group, 4-chlorophenyl group, 2-methylphenyl group,

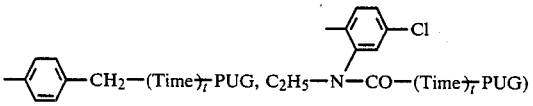

and substituted or unsubstituted heterocyclic groups (such as a 4-pyridyl group).

$R^4$ and $R^5$ may together form a fused ring, and examples thereof are as follows:

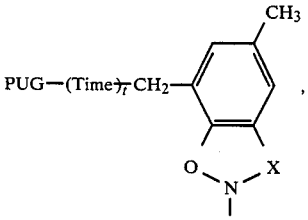

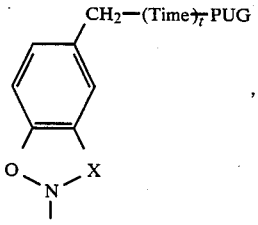

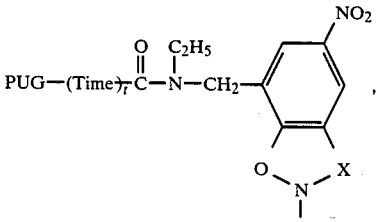

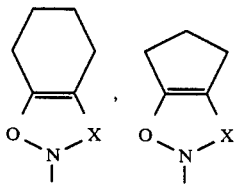

-continued

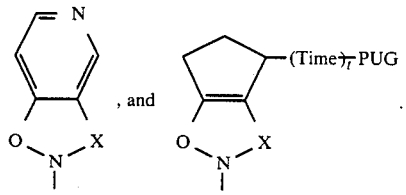

The above formulae show complete skeletons of fused rings. For R'' and $R^5$, Time, t and PUG are as identified herein.

The group $—(Time)_tPUG$ will now be described in detail.

Time represents a group releasing PUG via the subsequent reaction as triggered by the cleavage of the nitrogen-oxygen single bond in the compound; and t is 0 or 1.

Preferred groups for Time are those represented by the following formulae (T-1) through (T-10), where (*) represents the position bonded to the side of the dotted line in the aforesaid formulae, and (*) (*) represents the position to which PUG in the aforesaid formulae is bonded.

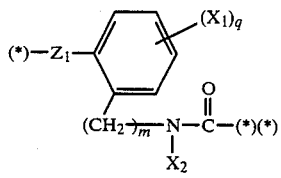

(T-1)

In this formula, $Z_1$ represents (*)—O—,

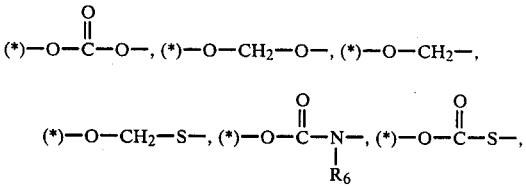

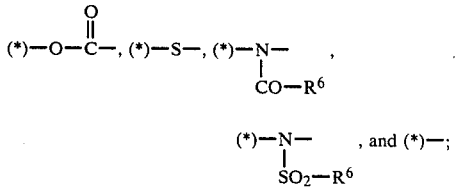

$R^6$ represents a hydrogen atom, an aliphatic group, an aromatic group or a heterocyclic group;

$X_1$ represents a hydrogen atom, an aliphatic group, an aromatic group, a heterocyclic group, $—O—R^7$, $—SR^7$, $—OC—R^7$,

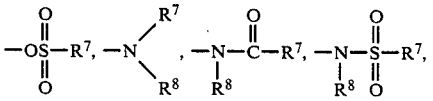

-continued

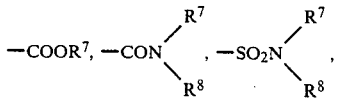

—CO—$R^7$, —$SO_2$—$R^7$, a cyano group, a halogen atom (such as fluorine, chlorine, bromine, iodine), or a nitro group;

$R^7$ and $R^8$ may be the same or different and each has the same meaning as $R^6$;

$X_2$ has the same meaning as $R^6$;

q is an integer of 1 to 4, when q is 2 or more, the $X_1$'s may be the same or different substituents, and when q is 2 or more, the $X_1$'s may be bonded to each other to form a ring; and n is 0, 1 or 2.

The groups represented by formula (T-1) are described in U.S. Pat. No. 4,248,962.

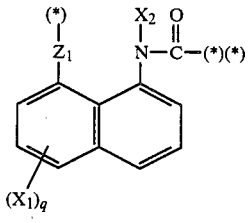

(T-2)

In this formula;

$Z_1$, $X_1$, $X_2$ and q have the same meanings as those given for formula (T-1).

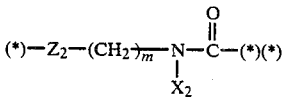

(T-3)

In this formula, $Z_2$ represents (*)—O—,

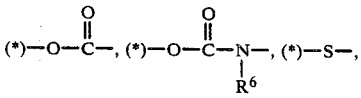

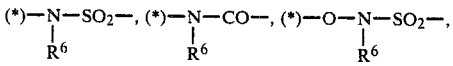

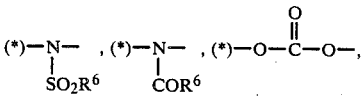

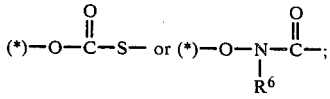

m is an integer of 1 to 4, preferably 1, 2 or 3; and $R^6$ and $X_2$ have the same meanings as given for formula (T-1).

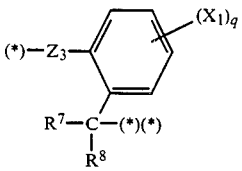

(T-4)

In this formula, $Z_3$ represents (*)—O—,

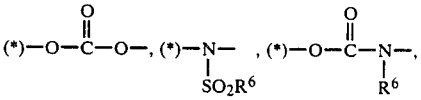

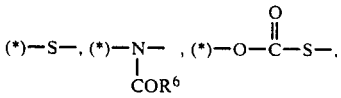

(*)—O—$CH_2$—O— or (*)—O—$CH_2$—S—;

$R^6$, $R^7$, $R^8$, $X_1$ and q have the same meanings as defined for formula (T-1).

The groups represented by formula (T-4) are, for example, timing groups as described in U.S. Pat. No. 4,409,323.

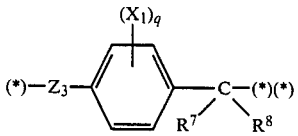

(T-5)

In this formula, $Z_3$, $R^7$, $R^8$, $X_1$ and q have the same meanings as defined for formula (T-4).

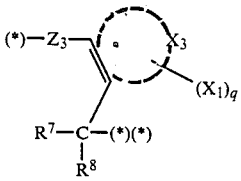

(T-6)

In this formula, $X_3$ represents an atomic group comprising at least one atom selected from carbon, nitrogen, oxygen and sulfur atoms which is necessary to form a 5 to 7-membered hetero-ring in the formula. The hetero-ring may optionally be fused with a benzene ring or a 5 to 7-membered hetero-ring. Preferred hetero-rings are pyrole, pyrazole, imidazole, triazole, furan, oxazole, thiophene, thiazole, pyridine, pyridazine, pyrimidine, pyrazine, azepine, oxepine, indole, benzofuran and quinoline.

$Z_3$, $X_1$, q, $R^7$ and $R^8$ have the same meanings as defined for formula (T-4).

The groups represented by formula (T-6) are, for example, timing groups as described in British Pat. No. 2,096,783.

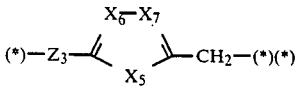

(T-7)

In this formula, $X_5$ represents an atomic group comprising at least one atoms selected from carbon, nitrogen, oxygen and sulfur atoms, which is necessary to form a 5 to 7-membered hetero-ring in the formula.

$X_6$ and $X_7$ each represents

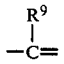

—N=, in which $R^9$ represents a hydrogen atom, an aliphatic group or an aromatic group.

The hetero-ring in the formula may optionally be condensed with a benzene ring or a 5 or 7-membered hetero-ring.

Preferred hetero-rings are pyrole, imidazole, triazole, furan, oxazole, oxadiazole, thiophene, thiazole, thiadiazole, pyridine, pyridazine, pyrimidine, pyrazine, azepine, oxepine and isoquinoline.

$Z_3$, $X_1$ and q have the same meanings as defined in the formula (T-4).

(T-8)

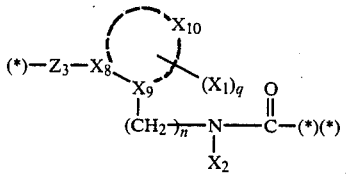

In this formula, $X_{10}$ represents an atomic group comprising at least one atom selected from carbon, nitrogen, oxygen and sulfur atoms, which is necessary to form a 5 to 7-membered hetero-ring in the formula.

$X_8$ and $X_9$ each represents —C= or N—.

The heterocyclic ring in the formula may optionally be fused with a benzene ring or a 5 to 7-membered hetero-ring.

$Z_3$, $X_1$, $X_2$, n and q have the same meanings as defined in the formula (T-1).

(T-9)

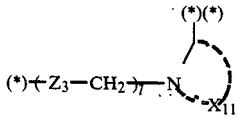

In this formula, $X_{11}$ has the same meaning as defined for $X_{10}$ in formula (T-8); $Z_3$ has the same meaning as defined for formula (T-4); and l is 0 or 1.

Preferred hetero-rings are those of the following formulae:

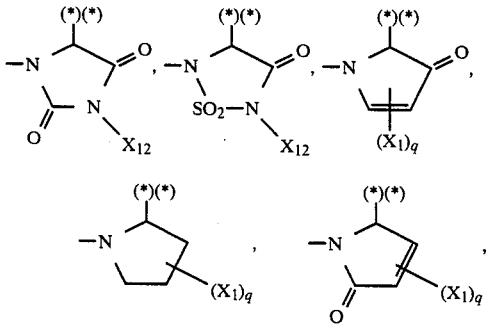

-continued

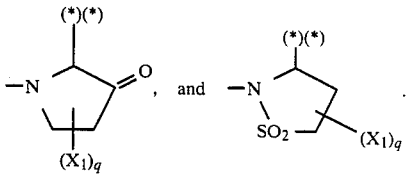

In these formulae, $X_1$ and q have the same meanings as defined for formula (T-1); and $X_{12}$ represents a hydrogen atom, an aliphatic group, an aromatic group, an acyl group, a sulfonyl group, an alkoxycarbonyl group, a sulfamoyl group, a heterocyclic group or a carbamoyl group.

(T-10)

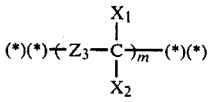

In this formula, $X_1$ and $X_2$ have the same meanings as defined for formula (T-1); $Z_3$ has the same meaning as defined for formula (T-4); and m has the same meaning as defined in formula (T-3) and is preferably 1 or 2.

In the above formulae (T-1) through (T-10), when $X_1$, $X_2$, $R^6$, $R^7$, $R^8$ and $R^9$ contain an aliphatic group moiety, the group preferably has 1 to 20 carbon atoms and may be unsaturated or saturated, unsubstituted or substituted, linear or cyclic, or straight-linear or branched. When the aforesaid $X_1$, $X_2$, $R^6$, $R^7$, $R^8$ and $R^9$ contain an aromatic group moiety, the group has 6 to 20, preferably 6–10, carbon atoms and is more preferably a substituted or unsubstituted phenyl group. When the $X_1$, $X_2$, $R^6$, $R^7$, $R^8$ and $R^9$ contain a heterocyclic group moiety, the group is preferably a 5-membered or 6-membered heterocyclic group having at least one hetero-atom selected from nitrogen, oxygen and sulfur atoms. Preferred heterocyclic groups are a pyridyl group, furyl group, thienyl group, triazolyl group, imidazolyl group, pyrazolyl group, thiadiazolyl group, oxadiazolyl group and pyrrolidinyl group.

Preferred timing groups are those represented by the following formulae:

(1)

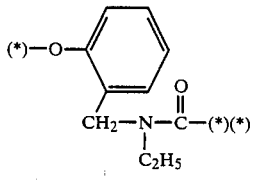

(2)

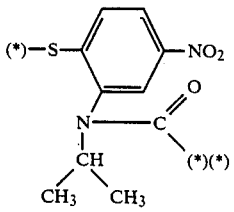

-continued
(3)
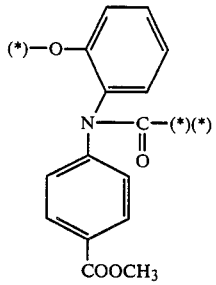
(4)
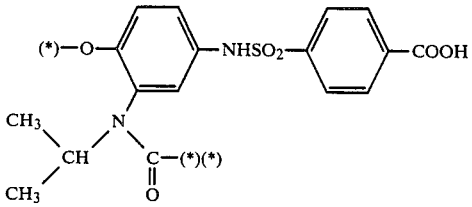
(5)
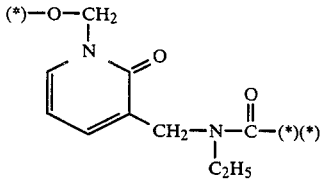
(6)
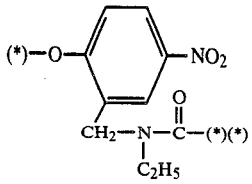
(7)
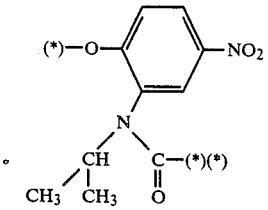
(8)
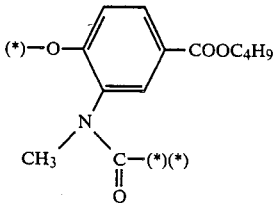
(9)
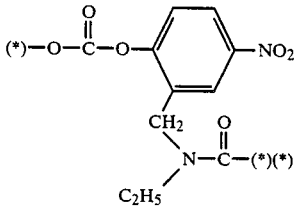
-continued
(10)
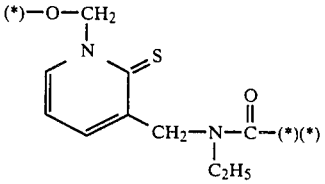
(11)
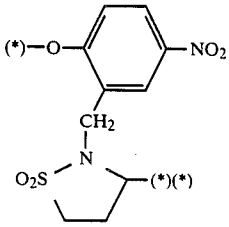
(12)
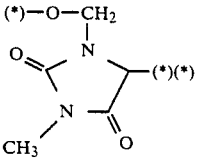
(13)
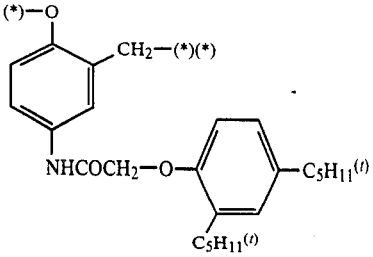
(14)
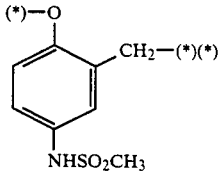
(15)
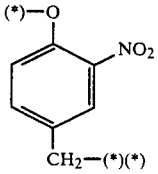
(16)
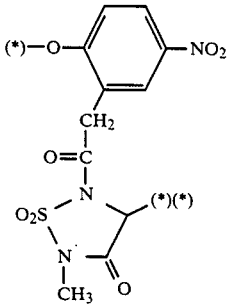

-continued
(17)
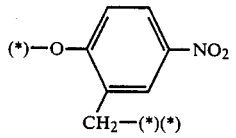
(18)
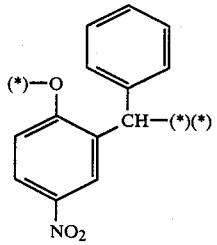
(19)
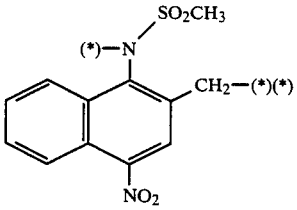
(20)
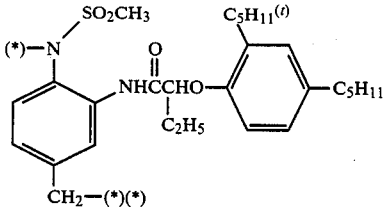
(21)
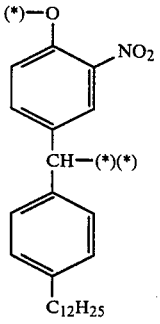
(22)
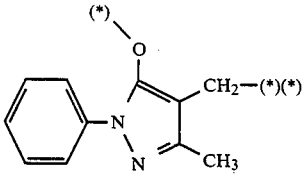
(23)
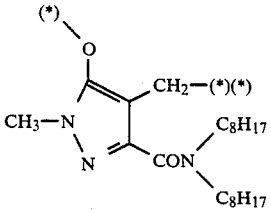
-continued
(24)
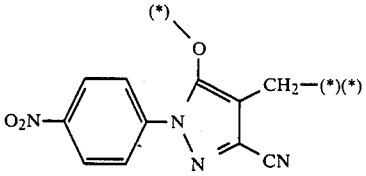
(25)
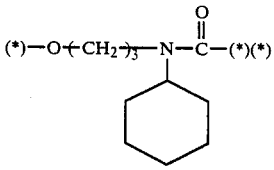
(26)
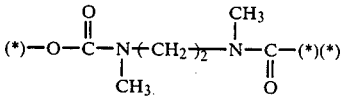
(27)
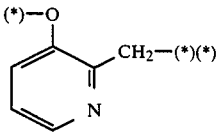
(28)
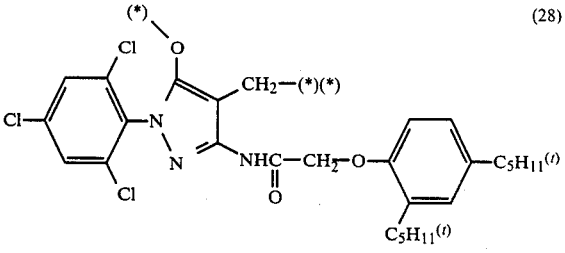
(29)
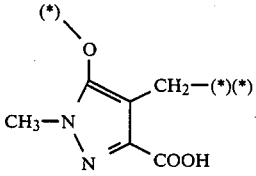
(30)
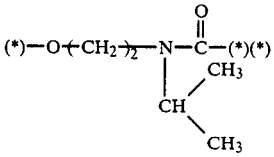
(31)
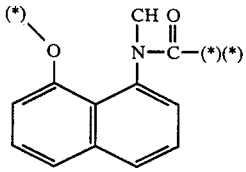
(32)
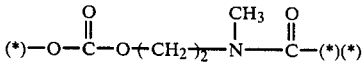
(33)
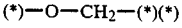
(34)
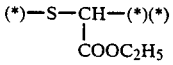

-continued

(35) 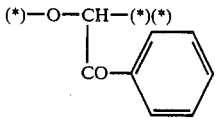

(36) 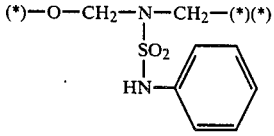

(37) 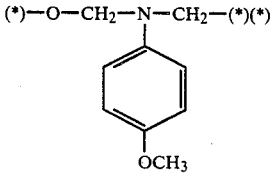

(38) 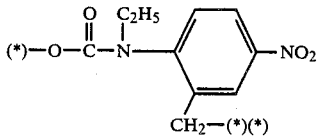

(39) 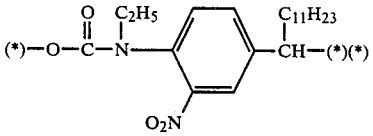

(40) 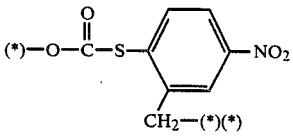

(41) 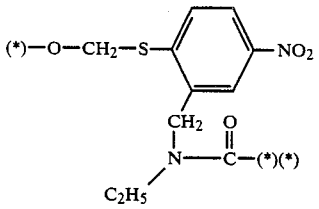

(42) 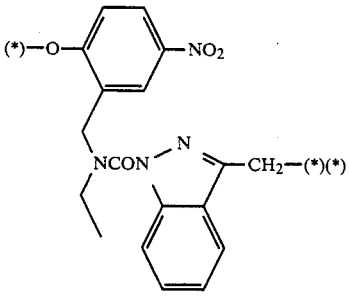

PUG means a photographically useful group in the form of Time-PUG or PUG by itself.

Photographically useful groups include, for example, development inhibitors, development accelerators, nucleating agents, couplers, diffusible or non-diffusible dyes, desilvering accelerators, desilvering inhibitors, silver halide solvents, competing compounds, developing agents, developing auxiliaries, fixing accelerators, fixing inhibitors, image stabilizers, toning agents, processing dependence improving agents, dot improving agents, color image stabilizers, photographic dyes, surfactants, hardeners, desensitizers, contrast intensifiers, chelating agents and fluorescent whitening agents as well as precursors thereof.

These photographically useful groups often overlap with one another with respect to the useful characteristics thereof, and typical examples of these groups are specifically given hereafter.

Examples of development inhibitors include compounds having a mercapto group bonded to a hetero-ring, for example, substituted or unsubstituted mercaptoazoles (such as 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)-phenyl]-5-mercaptotetrazole, 1-(4-nitrophenyl)-5-mercaptotetrazole, 5-(2-ethylhexanoylamino)-2-mercaptobenzimidazole), substituted or unsubstituted mercaptoazaindenes (such as 6-methyl-4-mercapto-1,3,3a,7-tetrazaindene, 6-methyl-2-benzyl-4-mercapto-1,3,3a,7-tetrazaindene, 6-phenyl-4-mercapto-1,3,3a,7-tetrazaindene, 4,6-dimethyl-2-mercapto-1,3,3a,7-tetrazaindene), and substituted or unsubstituted mercaptopyrimidines (such as 2-mercaptopyrimidine, 2-mercapto-4-methyl-6-hydroxypyrimidine, 2-mercapto-4-propylpyrimidine); as well as imino silver forming heterocyclic compounds, for example, substituted or unsubstituted benzotriazoles (such as benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, 4,5,6,7-tetrachlorobenzotriazole), substituted or unsubstituted indazoles (such as indazole, 5-nitroindazole, 3-nitroindazole, 3-chloro-5-nitroindazole, 3-cyanoindazole, 3-n-butylcarbamoylindazole, 5-nitro-3-methanesulfonylindazole), substituted or unsubstituted benzimidazoles (such as 5-nitrobenzimidazole, 4-nitrobenzimidazole, 5,6-dichlorobenzimidazole, 5-cyano-6-chlorobenzimidazole, 5-trifluoromethyl-6-chlorobenzimidazole). The development inhibitors, after released from the oxidation-reduction nucleus of formula (I) by the reaction subsequent to the oxidation-reduction reaction in the development process, yield development inhibitory compounds, which may change to compounds with no substantial development inhibitory activity or to compounds with an extremely reduced development inhibitory activity.

Examples thereof are 1-(3-phenoxycarbonylphenyl)-5-mercaptotetrazole, 1-(4-phenoxycarbonylphenyl)-5-mercaptotetrazole, 1-(3-maleimidophenyl)-5-mercaptotetrazole, 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylthoxycarbonyl)-2-mercaptobenzothiazole, 1-[4-(2-chloroethoxycarbonyl)phenyl]-2-mercaptoimidazole, 2-{3-[thiophen-2-ylcarbonyl]-propyl}thio-5-mercapto-1,3,4-thiadiazole, 5-cinnamoylaminobenzotriazole, 1-(3-vinylcarbonylphenyl)-5-mercaptotetrazole, 5-succinimidomethylbenzotriazole, 2-[4-succinimidophenyl]-5-mercapto-1,3,4-oxadiazole, 3-[4-(benzo-1,2-isothiazole-3-oxo-1,1-dioxy-2-yl)phenyl]-5-mercapto-4-methyl-1,2,4-triazole and 6-phenoxycarbonyl-2-mercaptobenzoxazole.

When PUG is a diffusible or non-diffusible dye, examples of the days include azo dyes, azomethine dyes, azopyrazolone dyes, indaniline type eyes, indophenol type dyes, anthraquinone type dyes, triarylmethane type dyes, alizarin, nitro type dyes, quinoline type dyes, indigo type dyes and phthalocyanine type dyes. In addition, the leuco forms of these dyes, dyes with a temporarily shifted absorption wavelength as well as dye precursors such as tetrazolium salts may be used. Further, these dyes may form chelated dyes with metals. These dyes are described, e.g., in U.S. Pat. Nos. 3,880,658; 3,931,144; 3,932,380; 3,932,381 and 3,942,987.

Preferred dyes and dye precursors are azo dyes, azomethine dyes, indaniline type dyes and dye precursors thereof. Examples of preferred dyes and dye precursors are given below.

D-1

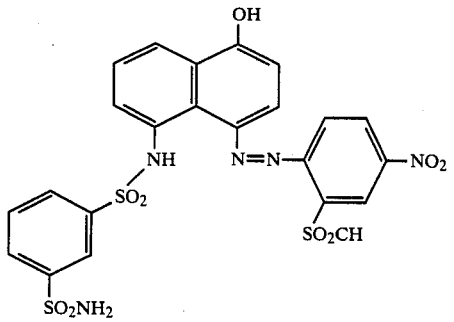

D-2

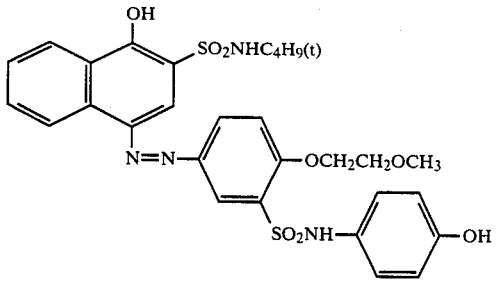

D-3

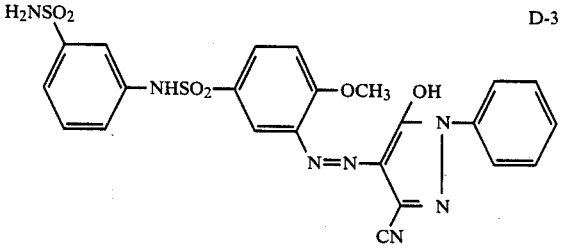

D-4

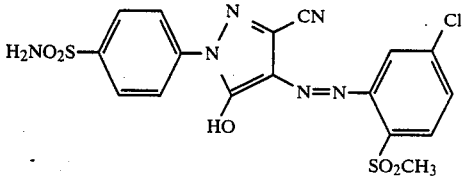

D-5

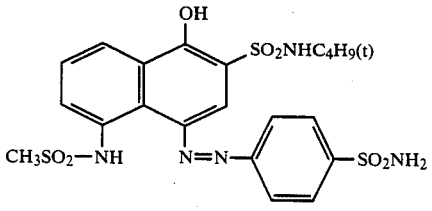

D-6

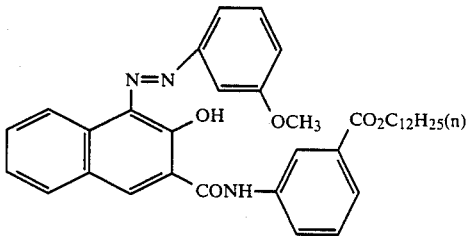

D-7

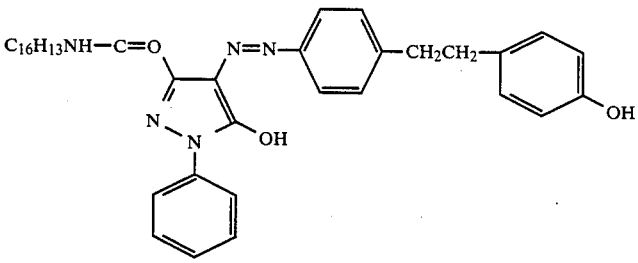

-continued
D-8
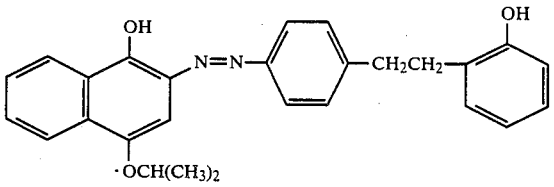
D-9
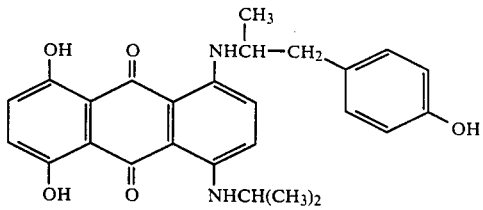
D-10
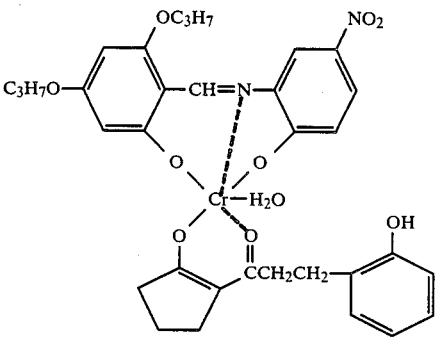
D-11
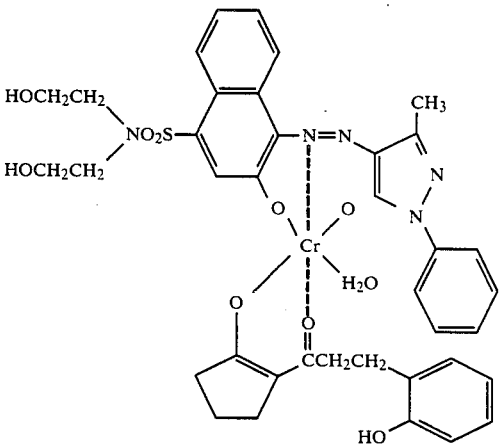
D-12
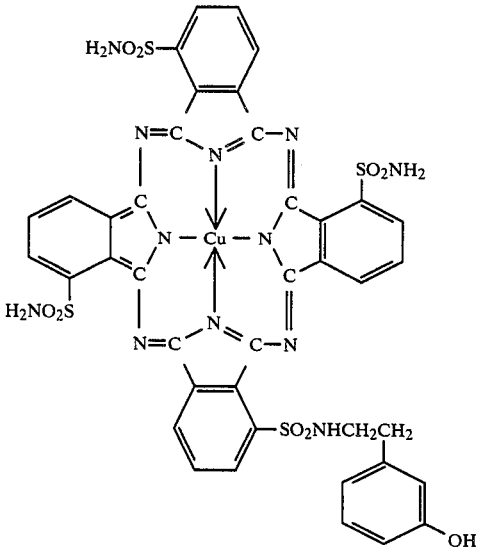
D-13
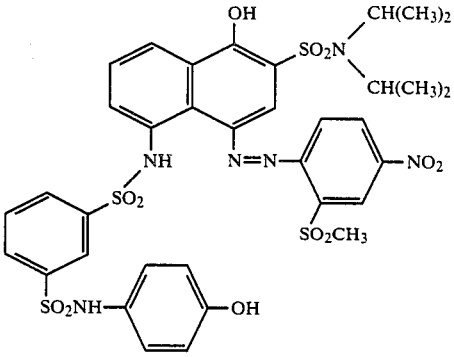
D-14
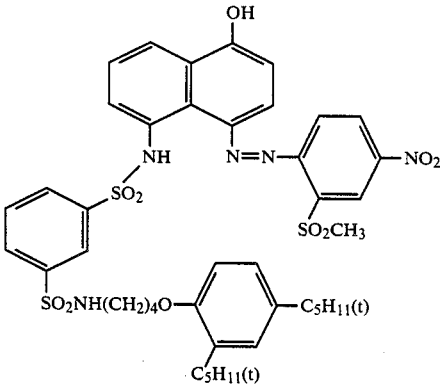
D-15
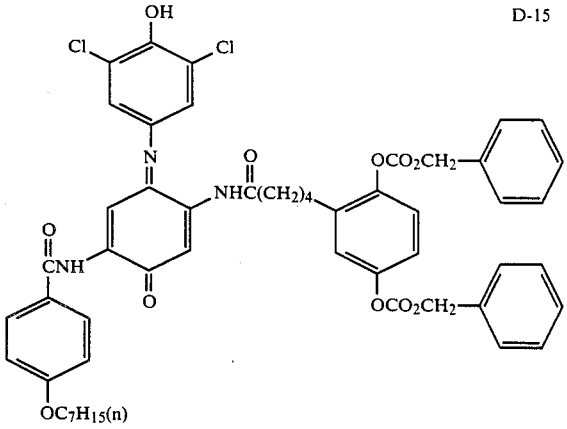

-continued
D-16
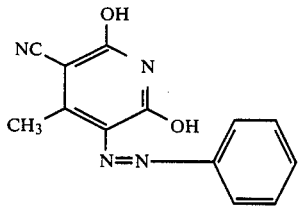
D-17
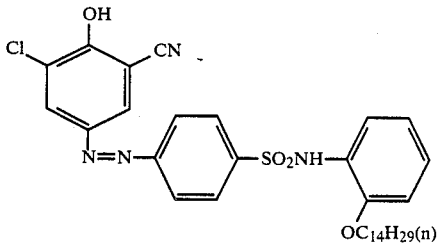
D-18
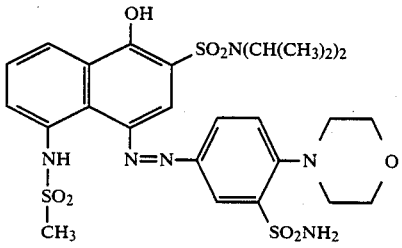
D-19
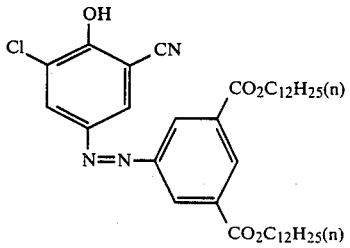
D-20
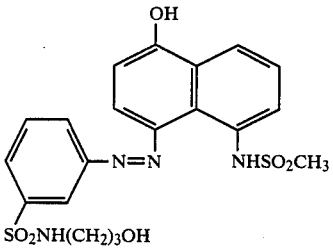
D-21
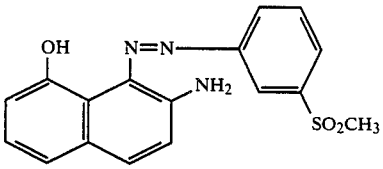
D-22
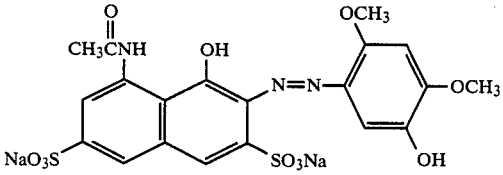
D-23
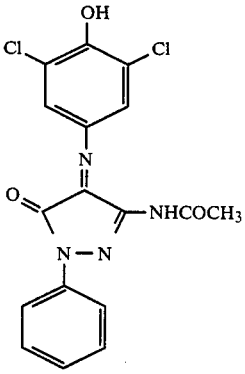
D-24
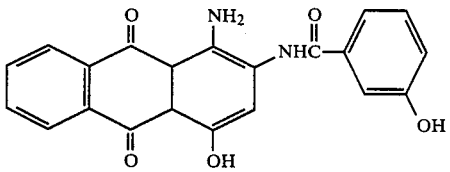
D-25
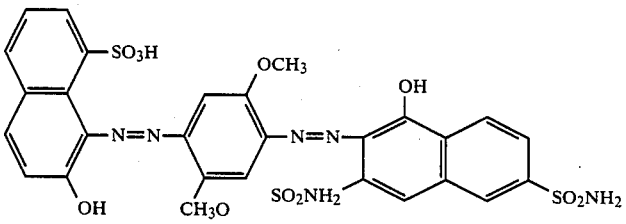

-continued
D-26
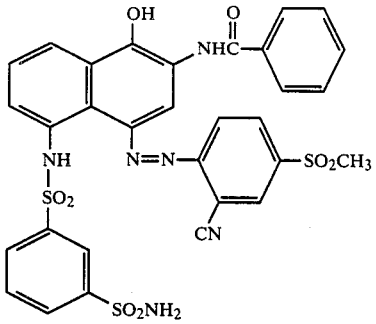
D-26
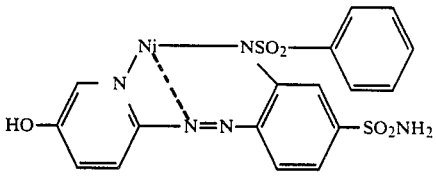
D-27
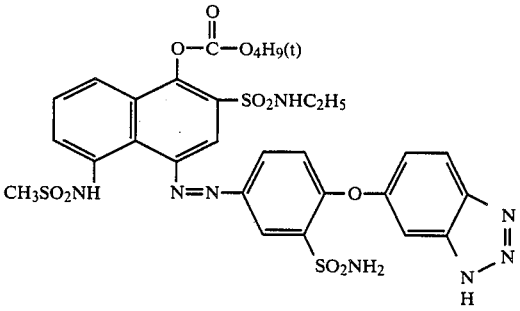
D-28
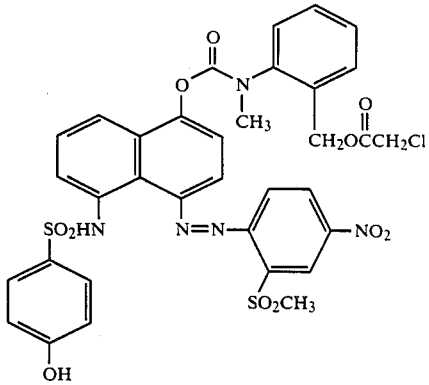
D-29
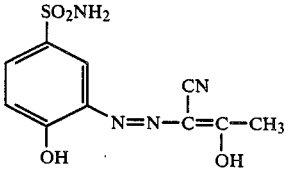
D-30
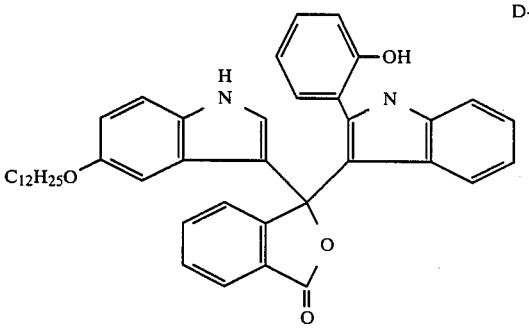
D-31
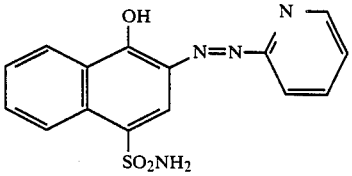
D-33
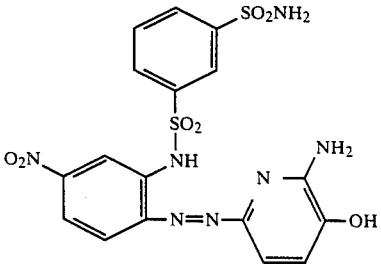
D-34
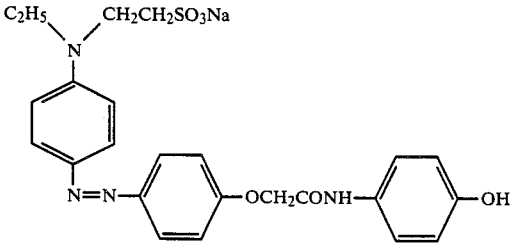

-continued
D-35
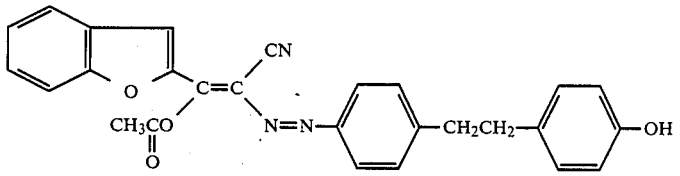
D-36
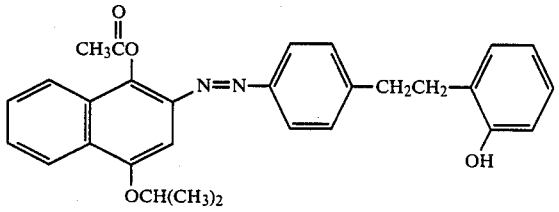
D-37
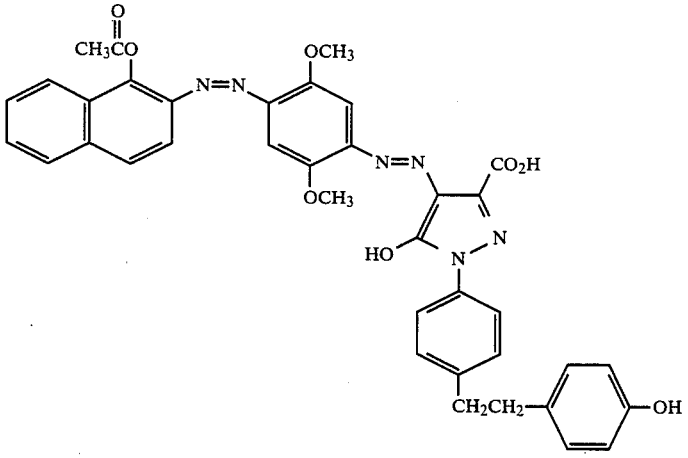
D-38
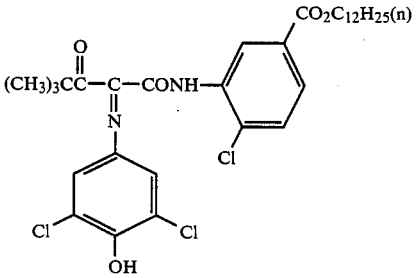
D-39
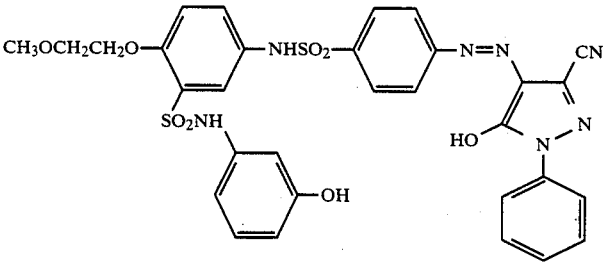

-continued
D-40
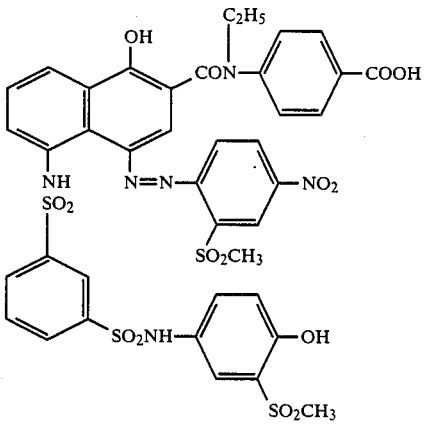
D-41
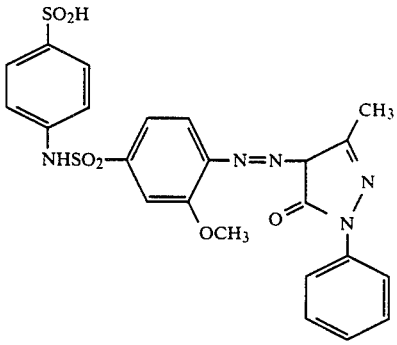
D-42
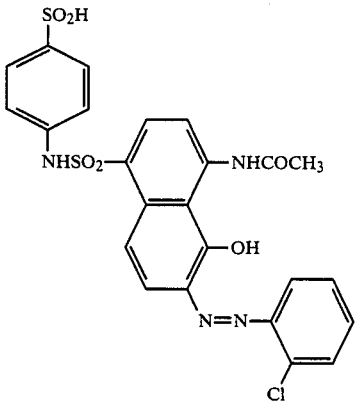
D-43
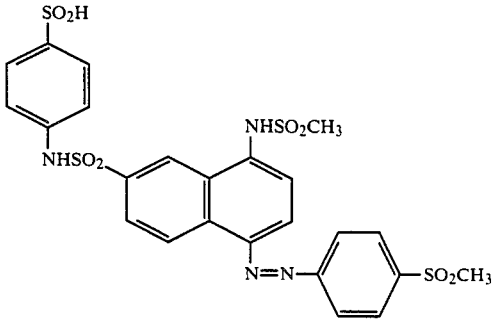
D-44
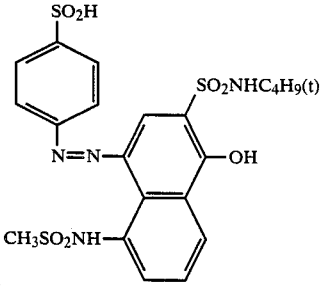
D-45
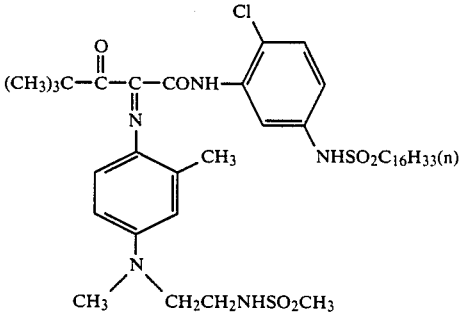
D-46
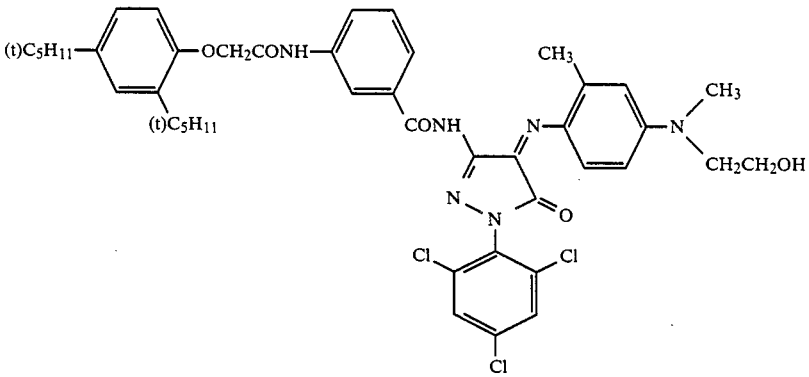

-continued

D-47

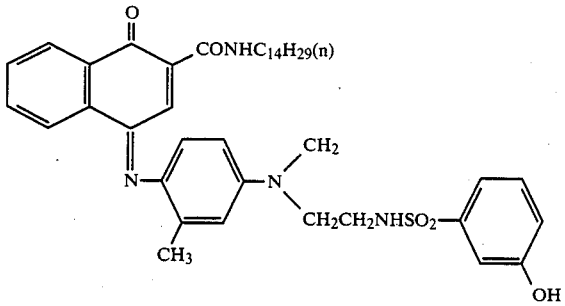

Examples of silver halide solvents for PUG are mesoionic compounds as described in Japanese patent application (OPI) No. 163042/85 and U.S. Pat. Nos. 4,003,910 and 4,387,424; and amino-substituent-containing mercaptoazoles and azolethiones as described in Japanese patent application (OPI) No. 202531/82.

Examples of nucleating agents for PUG are the parts of the split-off groups released from couplers as described in Japanese patent application (OPI) No. 170840/84.

For the other PUG groups U.S. Pat. No. 4,248,962 may be referred to.

Examples of the compounds of the present invention are given below, which, however, are not limitative.

1

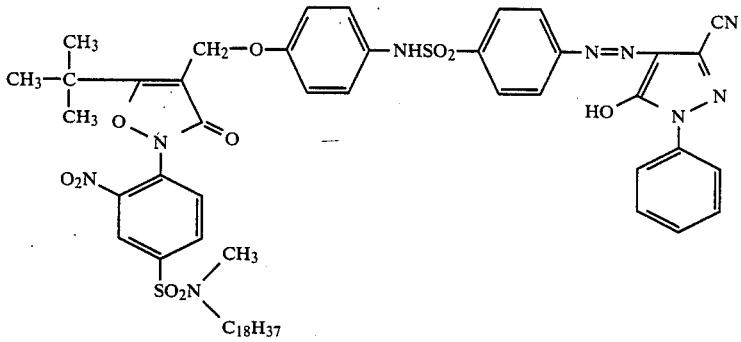

2

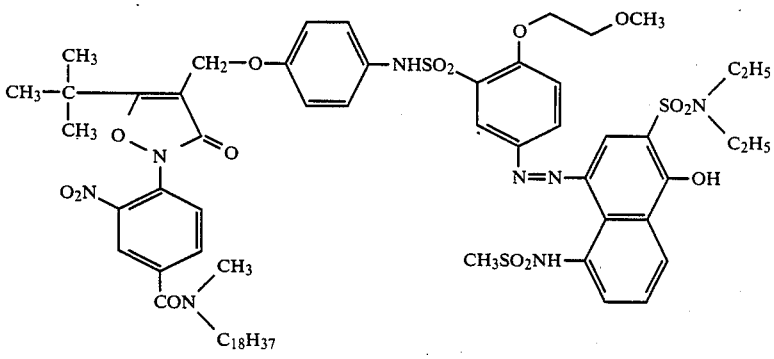

3

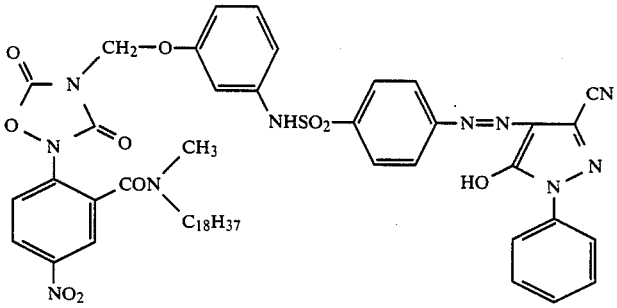

-continued
4
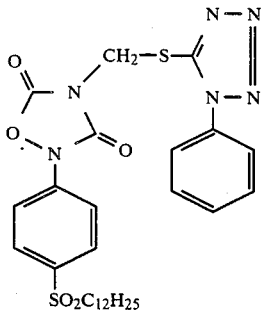
5
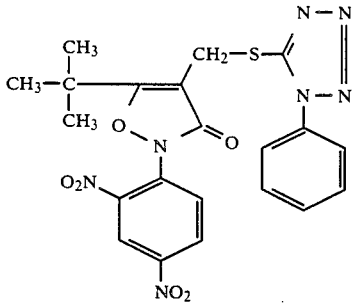
6
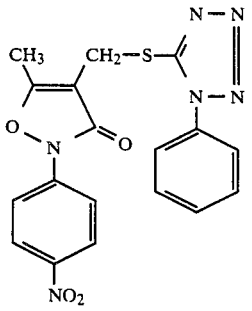
7
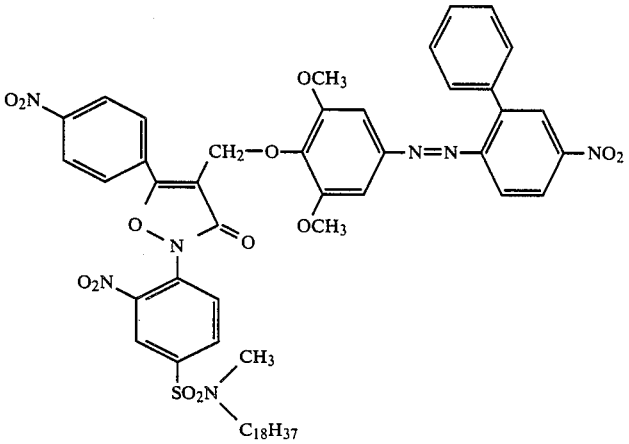
8
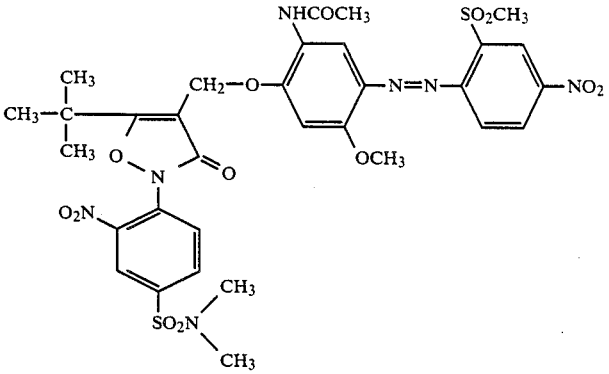

-continued
9
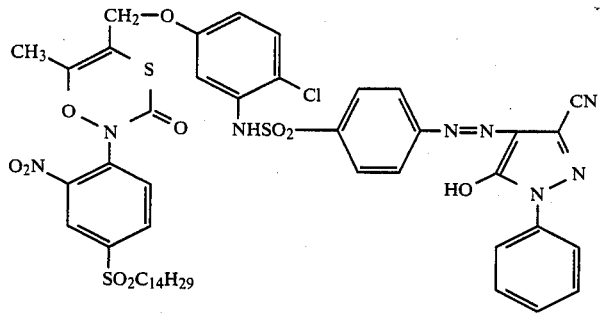
10
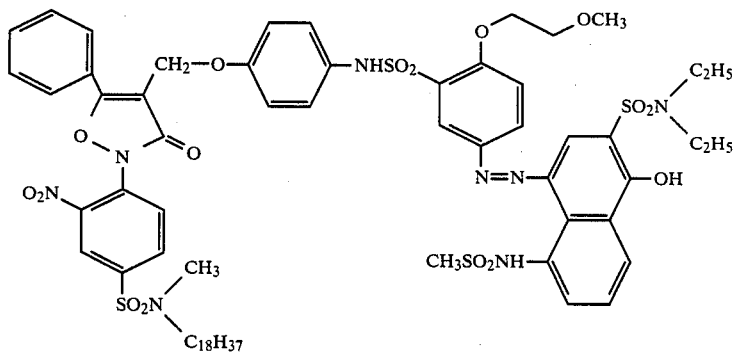
11
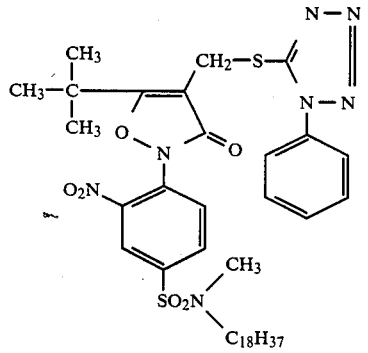
12
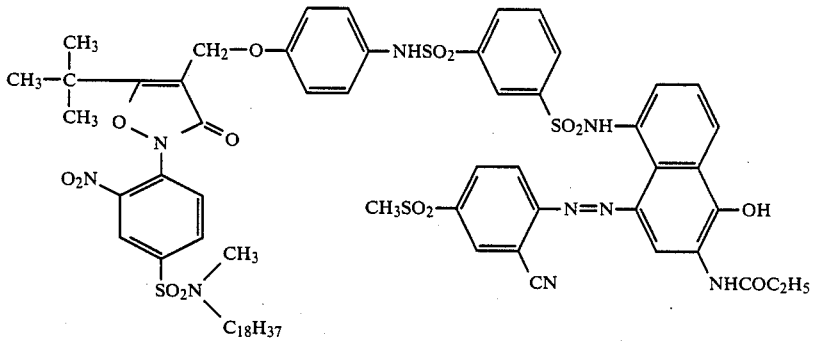

-continued
13
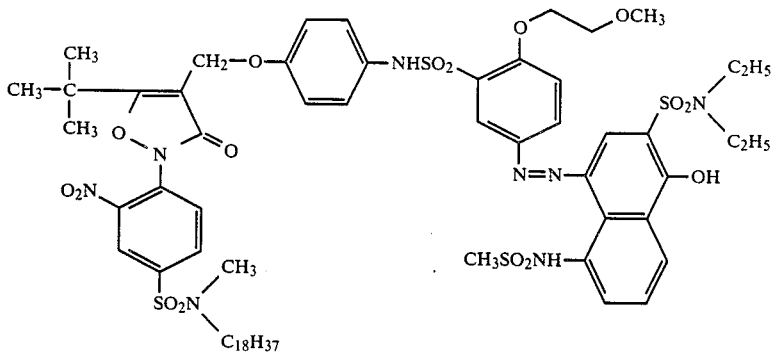
14
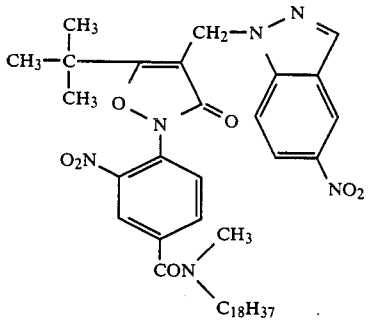
15
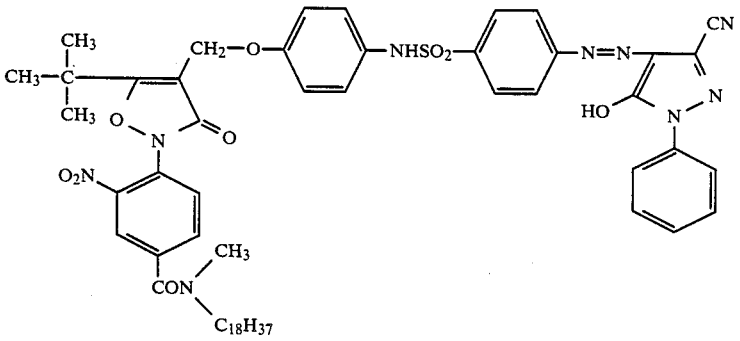
16
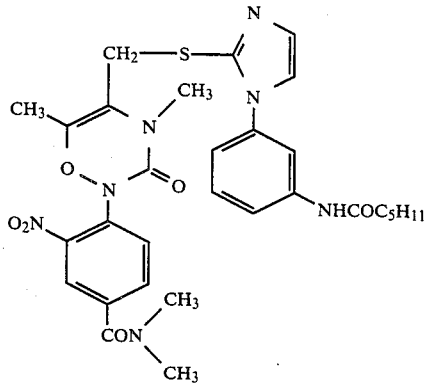
17
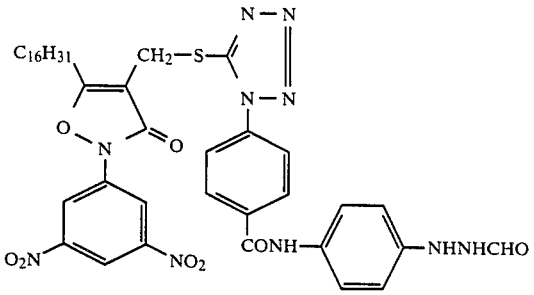

-continued
18
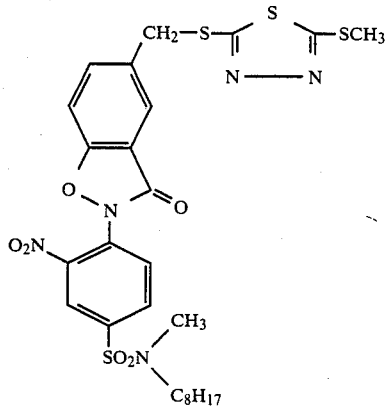
19
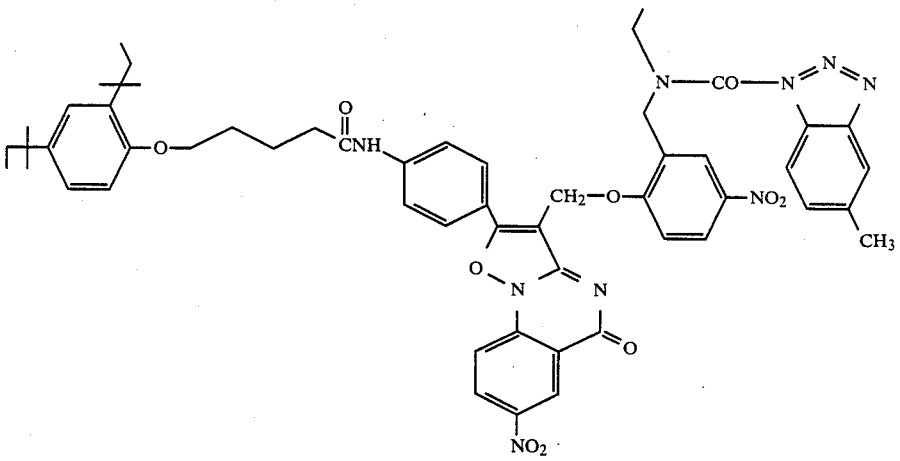
20
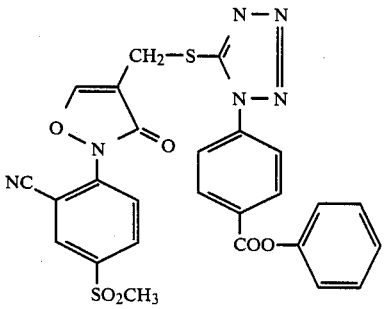
21
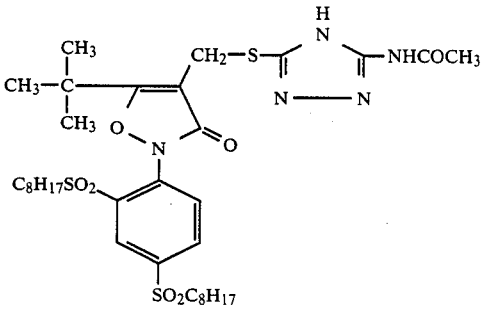
22
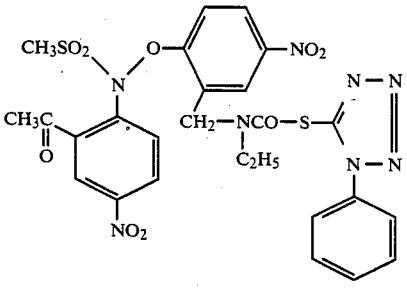

-continued
23
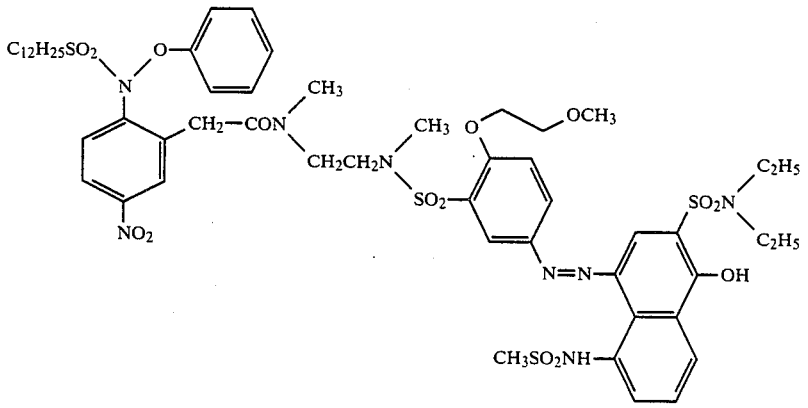
24
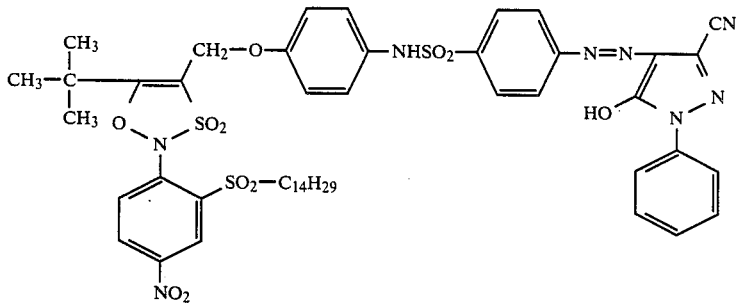
25
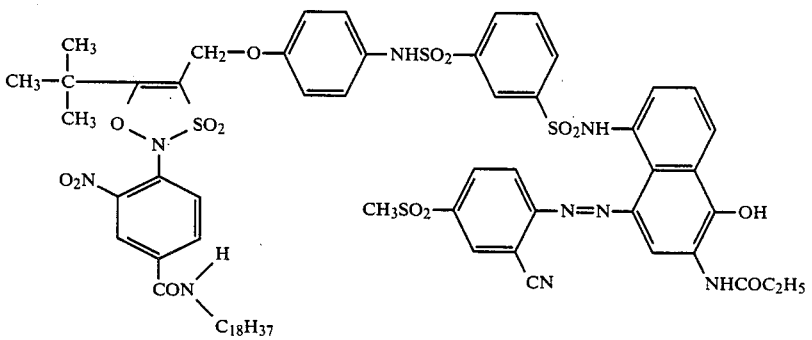
26
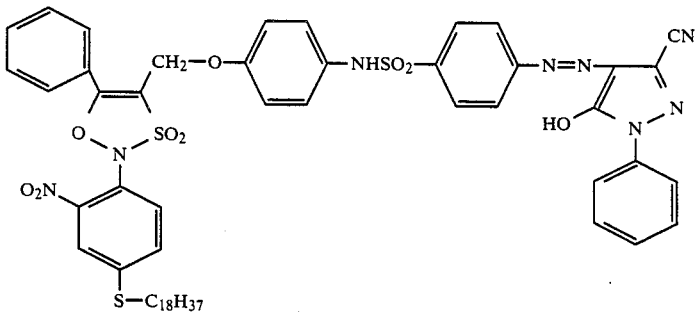

-continued
27
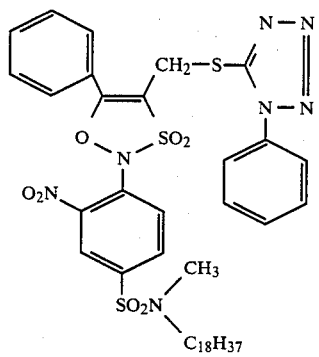
28
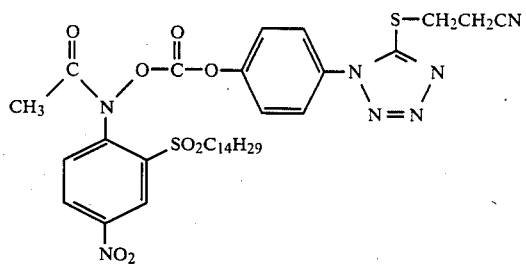
29
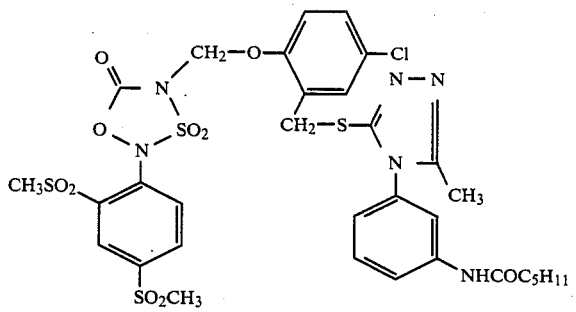
30
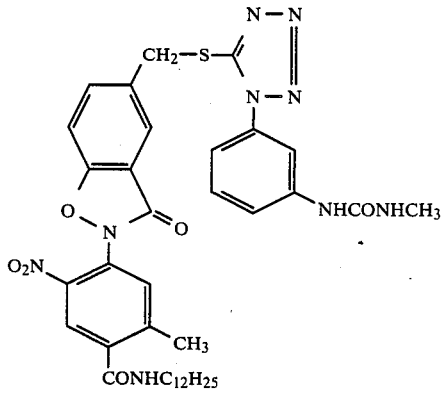
31
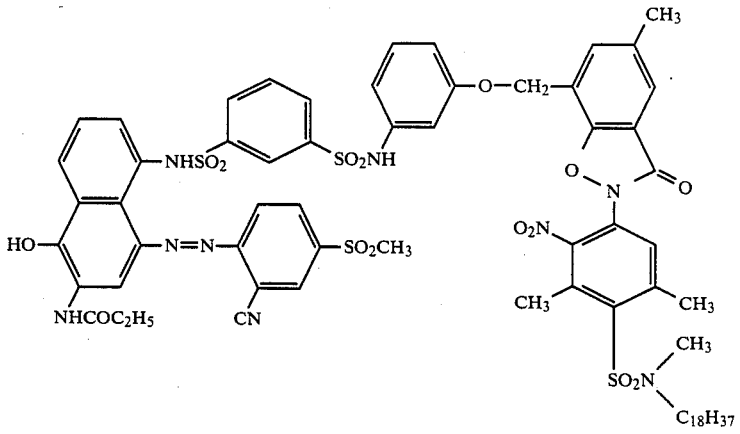

-continued
32
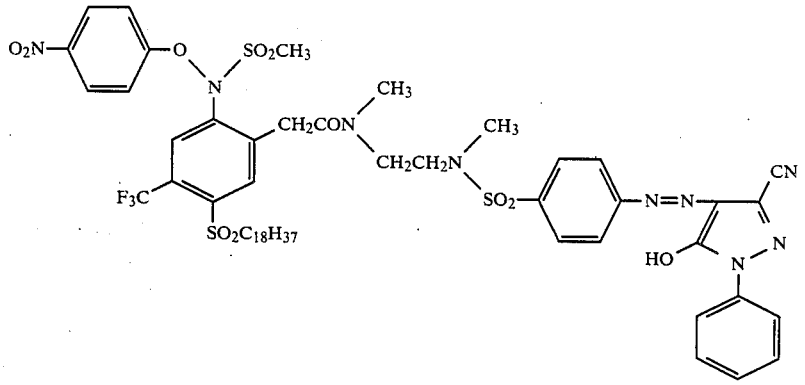
33
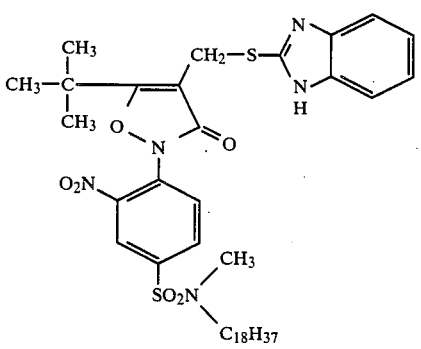
34
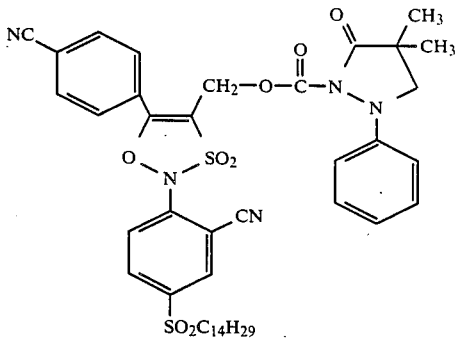
35
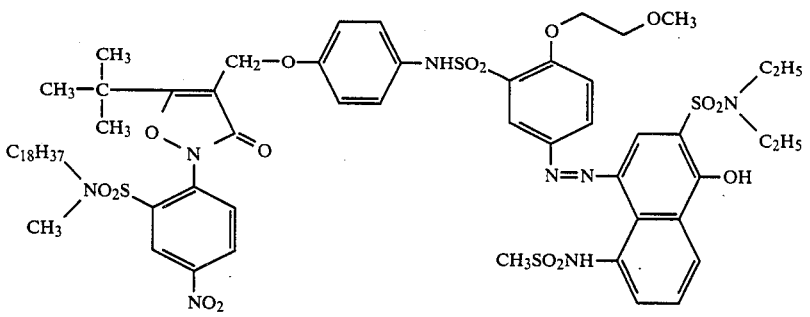
36
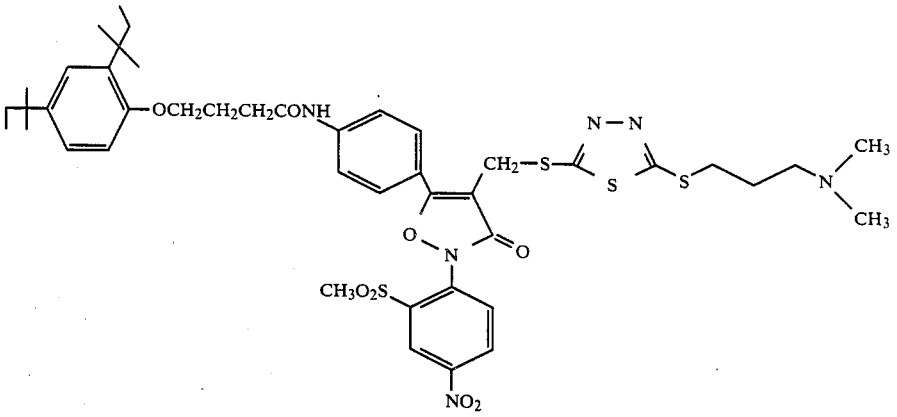

-continued
37
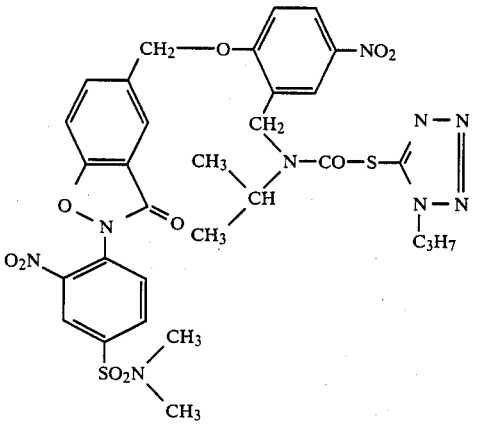
38
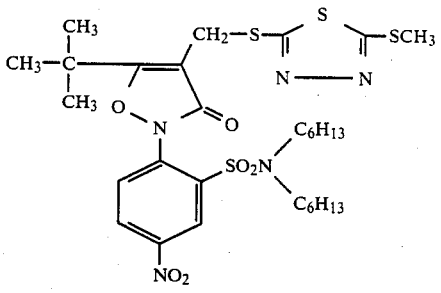
39
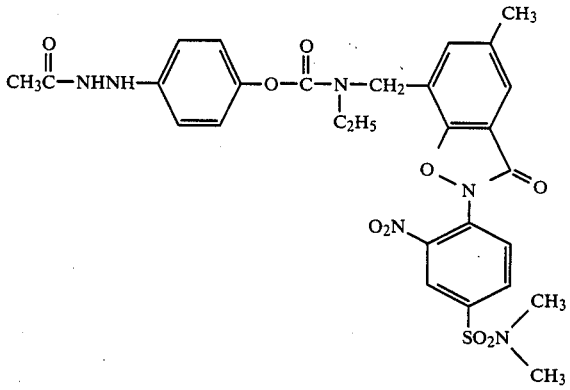
40
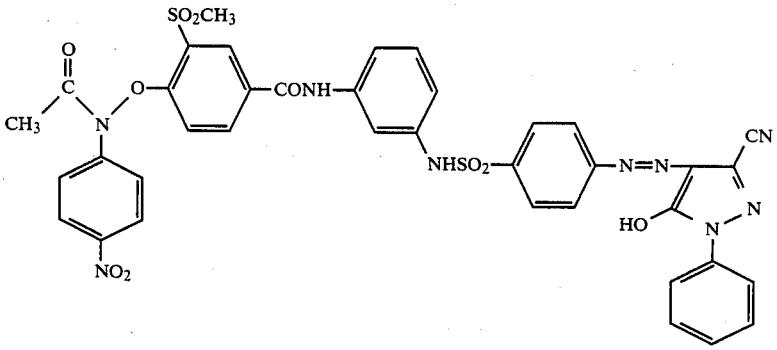
41
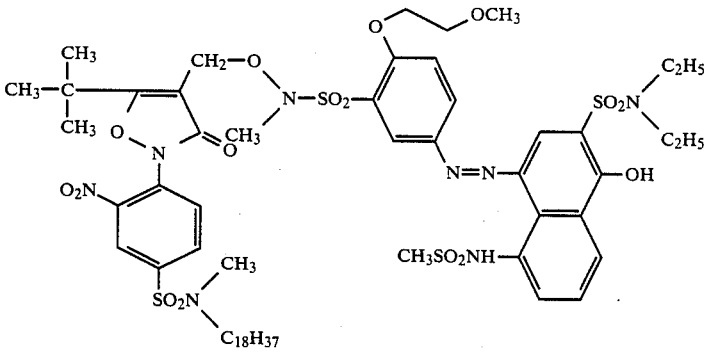

-continued
42
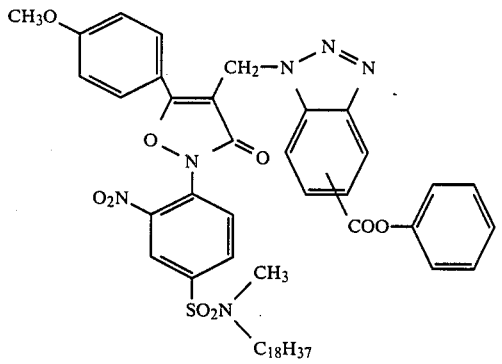
43
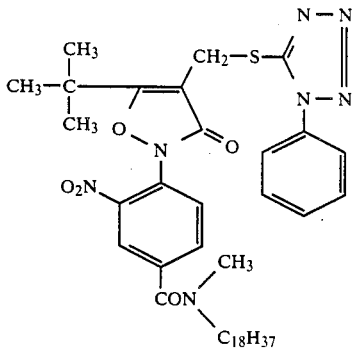
44
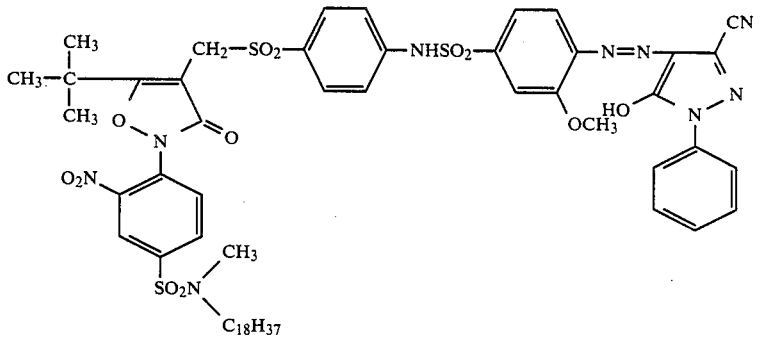
45
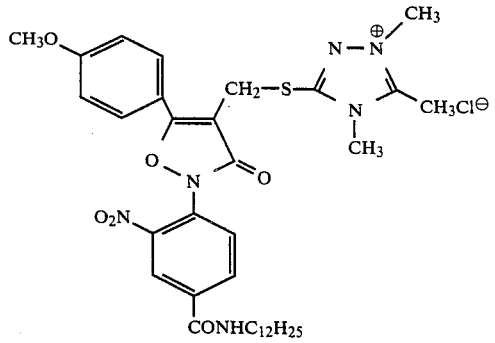
46
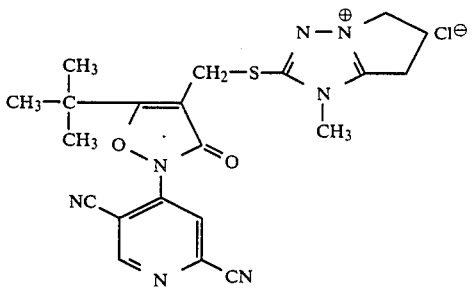
47
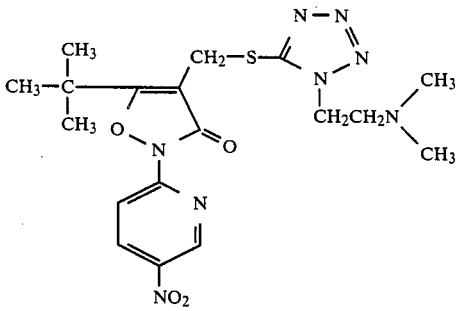
48
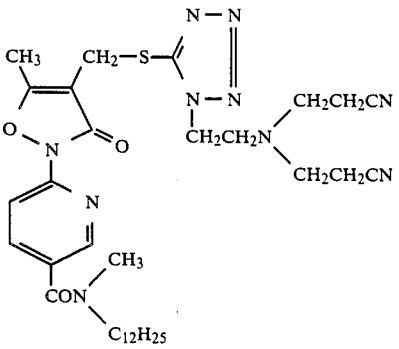

-continued
49
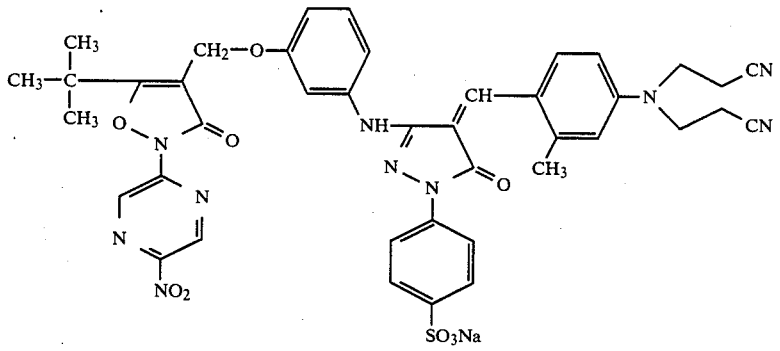
50
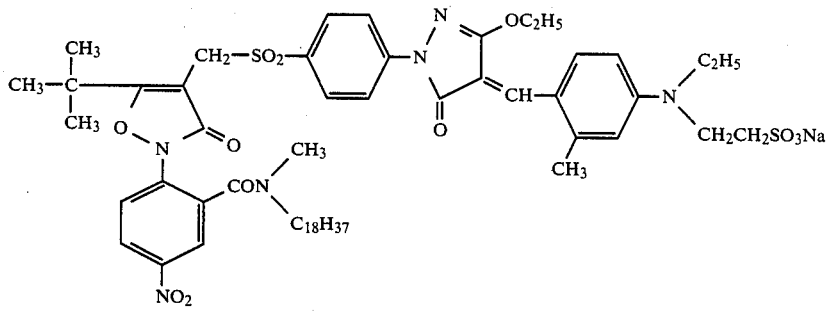
51
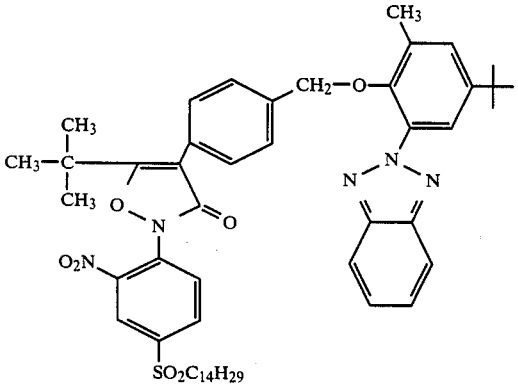
52
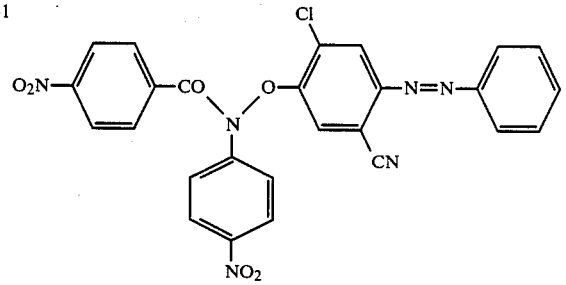
53
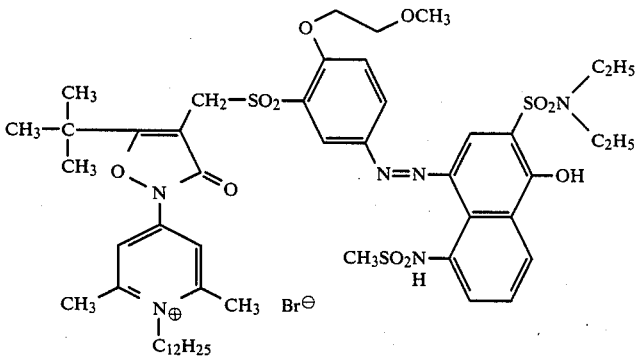

-continued
54
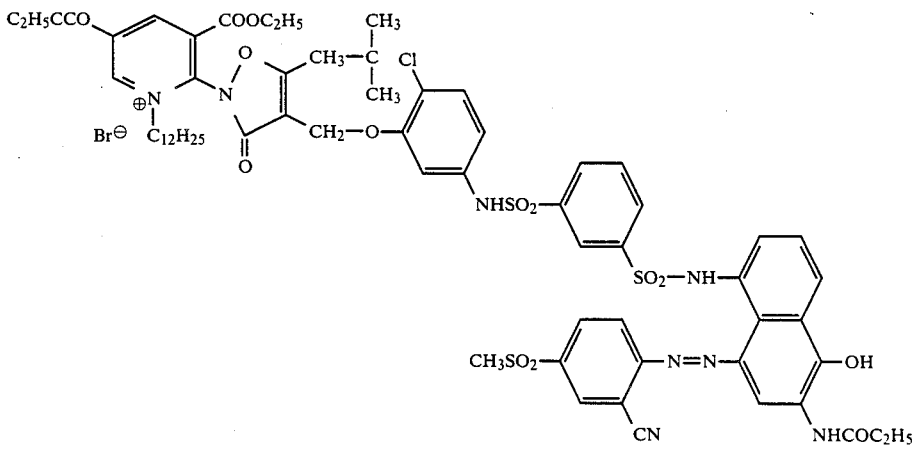
55
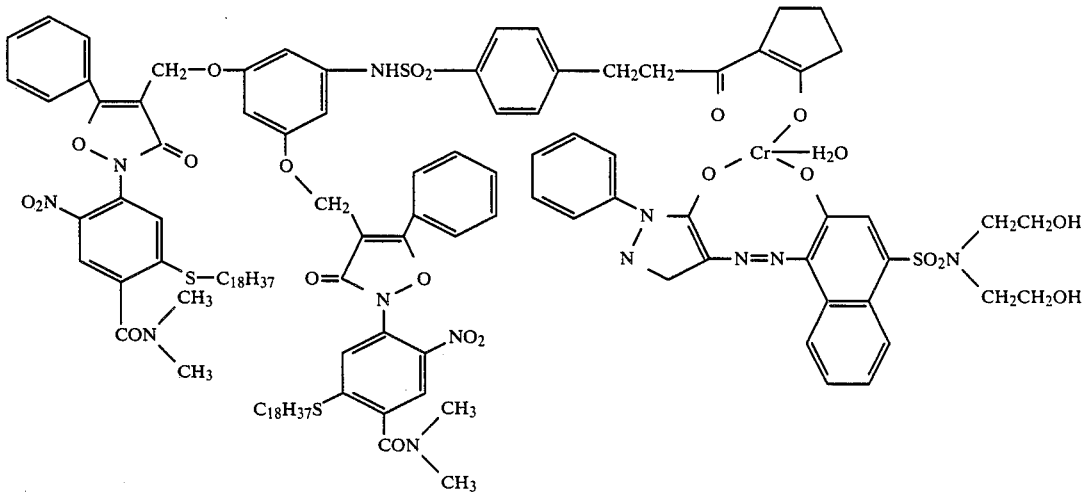
56
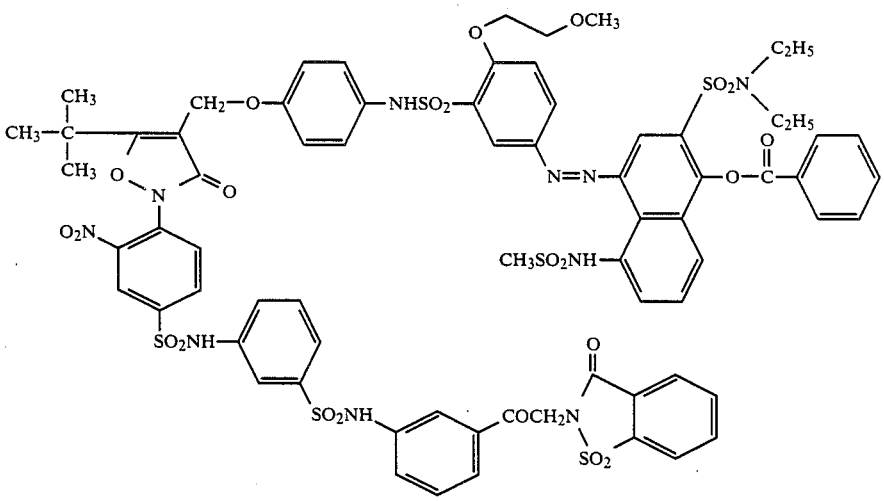

-continued
57
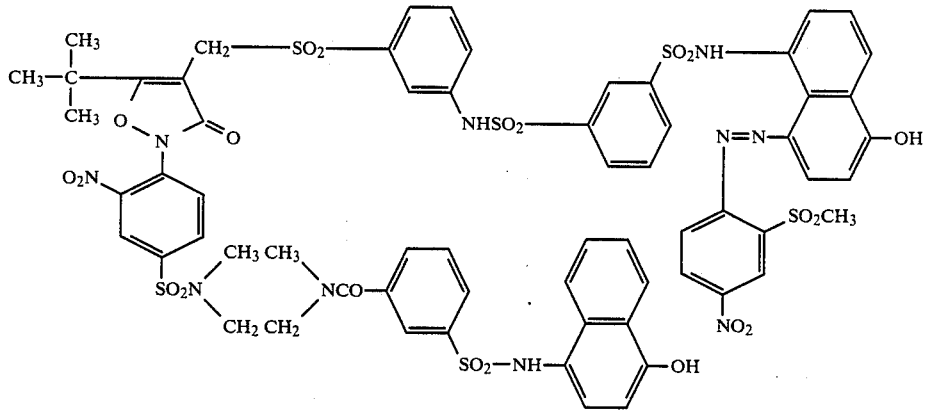
58
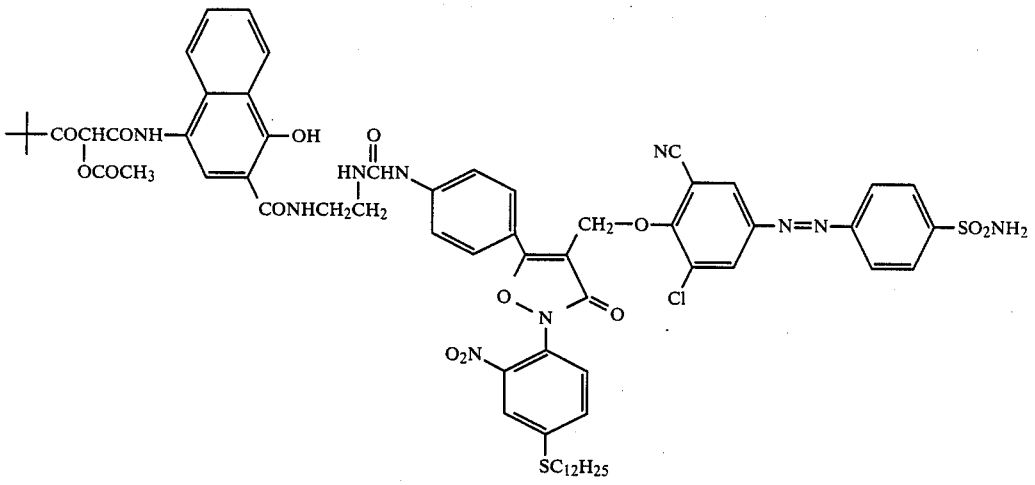
59
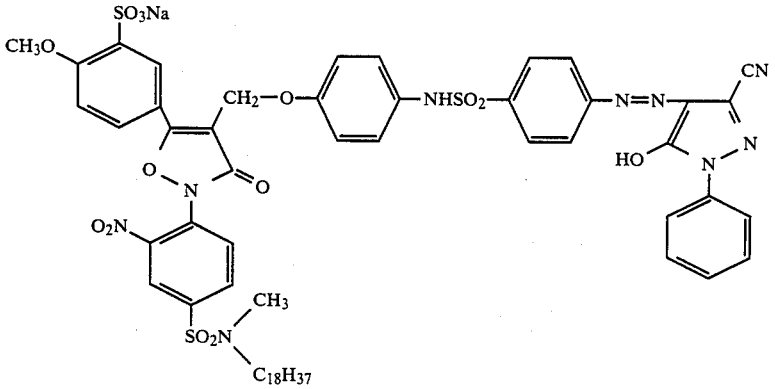
60
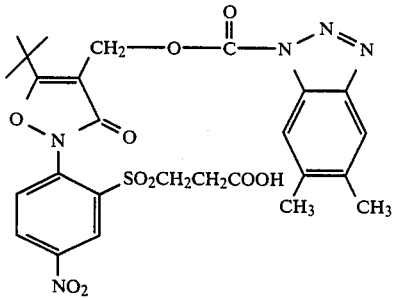

-continued
61
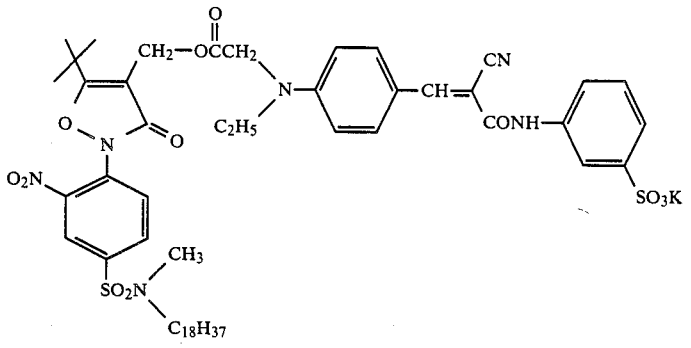
62
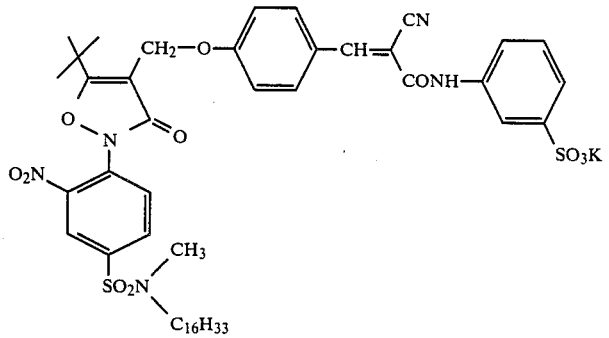
63
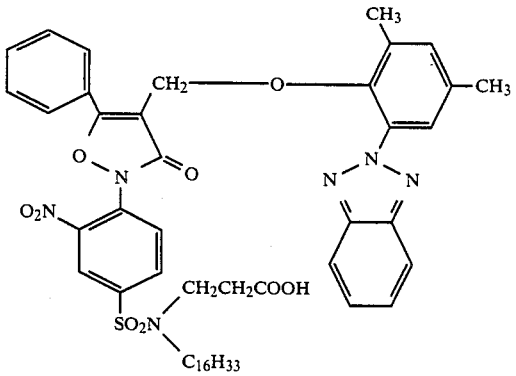
64
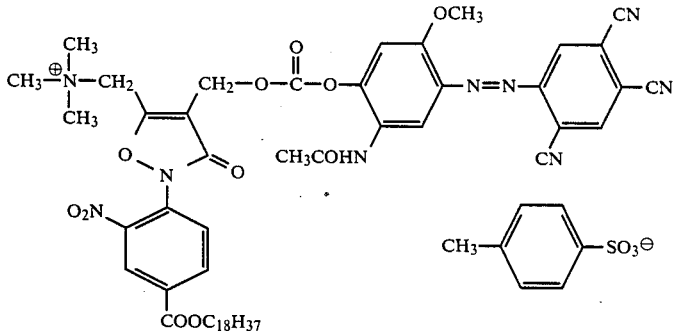

-continued

65

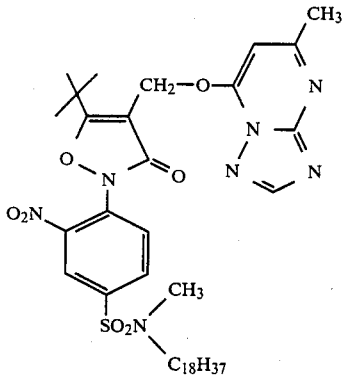

66

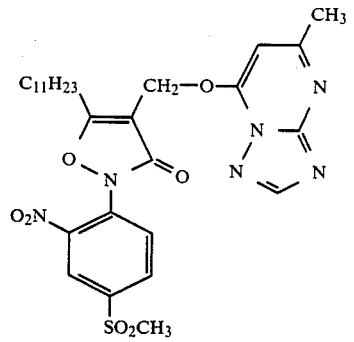

67

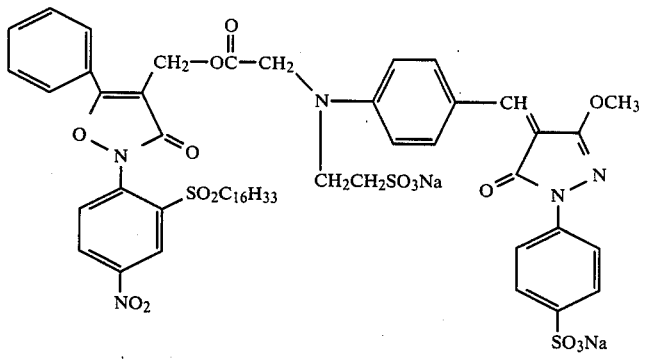

68

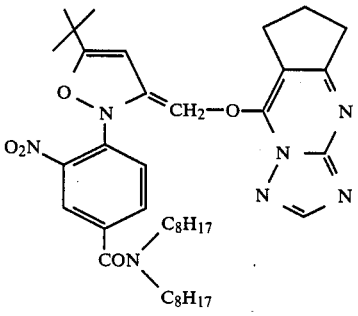

69

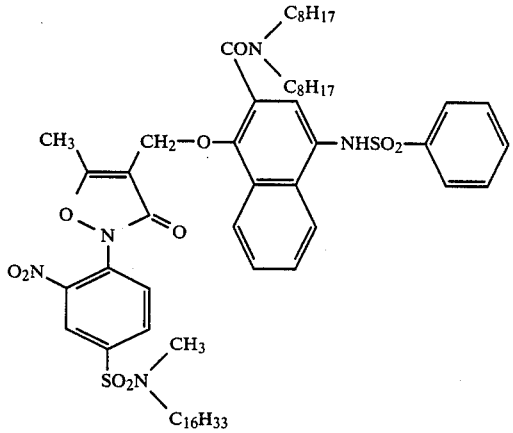

70

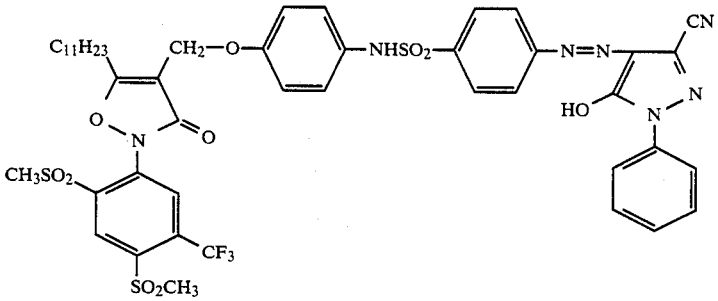

In the synthesis of the compounds of the present invention, the most important point resides in the method for binding the nitrogen-oxygen group and the electron accepting group. The binding method is roughly classified into two methods (1) and (2). The first method (1) comprises the introduction of a nitro group into the electron acceptor part, the reduction of the part with a zinc-ammonium chloride system into a hydroxylamine and the binding of the amine and the $(Time)_l$PUG. The second method (2) comprises the introduction of an easily substitutable group such as a halogen atom into the electron acceptor part followed by the nucleophilic substitution of the part by a hydroxylamine or an equivalent chereof. Regarding method (1), the synthesis may be carried out in accordance with the method described in *Organic Functional Group Preparations* written by S. R. Sandler & W. Karo. Regarding method (2), the synthesis may be carried out by the reaction under neutral or basic conditions in ethanol, dimethylformamide or dimethyl sulfoxide. In order to explain the content of the present invention more specifically, some synthesis examples are given below.

Synthesis Example 1

Synthesis of 5-t-butyl-3-hydroxyisoxazole:

Synthesis Example 1-1

Synthesis of 3-t-butyl-5-pyrazolidone:

1.0 kg of ethyl pivaloylacetate was dissolved in 2.5 liters of ethanol and 320 g of hydrazine hydrate was added dropwise thereto while cooling with water. After the addition, the whole was reacted for one night at room temperature and then 5.0 liters of water was added thereto and the system stirred. The crystals precipitated out were filtered out under reduced pressure, washed fully with water, then with a small amount of methanol and then dried with air. Yield: 812 g, 98.5%.

Synthesis Example 1-2

Synthesis of 4,4-dibromo-3-t-butyl-5-pyrazolidone:

658 g of 3-t-butyl-5-pyrazolidone was dissolved in 2.0 liters of acetic acid. 1.5 kg of bromine was added dropwise to the resulting solution while stirring and cooling with water. After the addition, the whole was reacted for one night at room temperatures and then 5.0 liters of water was added thereto. The crystals precipitated out were filtered out under reduced pressure, washed fully with water and then with a small amount of methanol and thereafter dried with air. Yield: 1.36 kg, 97.2%.

Synthesis Example 1-3

Synthesis of 4,4-dimethyl-2-pentiolic acid:

552 g of sodium hydroxide was dissolved in 3.0 liters of water and the ice was added thereto to cool the resulting solution to 5° C. or lower. Next, dibromo-3-t-butyl-5-pyrazolidone was slowly added thereto while stirring and the system kept at 5° C. or lower. If the temperature of the reaction system rose, ice was added thereto, and acetonitrile was added thereto so as to prevent this from foaming. After the reaction was completed, the reaction system was rendered acidic with 6N-hydrochloric acid and then ethyl acetate was twice added for extraction.

The resulting extract was dried over anhydrous sodium sulfate and then the ethyl acetate was distilled out under reduced pressure. The residual oil was 4,4-dimethyl-2-pentiolic acid. This oil was used in the next reactin without purification.

Synthesis Example 1-4

Synthesis of 4,4-dimethyl-2-pentiolic acid chloride:

466 g of 4,4-dimethyl-2-pentiolic acid was admixed with 3.5 liters of methylene chloride and stirred. To this was added 483 g of thionyl chloride and the system reacted for 1 hour. After the reaction, the whole was heated under reflux, whereupon hydrogen chloride gas was vigorously generated. After heating under reflux for 2 hours, the solvent was distilled off and the residual content was distilled under reduced pressure. The product was a colorless liquid having a b.p. of about 70° C./20 mmHg. Yield: 290 g, 54.3%.

Synthesis Example 1-5

Synthesis of 5-t-butyl-3-hydroxyisoxazole 308 g of hydroxylamine hydrochloride was dissolved in 2.5 liters of water and 176 g of sodium bicarbonate was added thereto. Ice was added to the resulting solution so it was kept at 5° C. or lower, and 290 g of 4,4-dimethyl-2-pentiolic acid chloride was added dropwise thereto while vigorously stirring.

The product was obtained in the form of colorless crystals. The crystals were filtered out under reduced pressure and washed with water. Next, the crystals thus obtained were dissolved in 2.5 liters of a 2N aqueous sodium hydroxide solution and kept at room temperature for one night. The reaction mixture was then neutralized, whereby colorless crystals of 5-t-butyl-3-hydroxyisoxazole were obtained. Yield: 190 g, 67.4%; m.p. 99°–101° C.

Synthesis Example 2

Synthesis of Compound No. 15:

Synthesis Example 2-1

Synthesis of N-methyl-N-octadecyl-3-nitro-4-chlorobenzamide:

105.7 g of 3-nitro-4-chlorobenzoic acid and 800 ml of acetronitrile were blended, and 68.6 g of thionyl chloride was added thereto and the system heated for 4 hours under reflux. After cooling, the solvent was distilled off and the residual content was dissolved in chloroform. 63.5 g of triethylamine was added to the resulting solution and the whole was cooled to 5° C. Next, a solution of 148.6 g of N-methyloctadecylamine dissolved in chloroform was added dropwise to the solution. After the reaction, water was added to the reaction mixture for liquid fractionation, and then the organic phase was dried over anhydrous sodium sulfate. The inorganic component was filtered off and the solvent was distilled off, whereafter the product was recrystallized from acetonitrile/methanol (1:3 volume). Yield: 186 g, 76.8%; m.p. 55°–56° C.

Synthesis Example 2-2

Synthesis of 5-t-butyl-2-(4-N-methyl-N-octadecylcarbamoyl-2-nitrophenyl)-3-isoxazolone:

300 ml of dimethylformamide was added to 34.1 g of N-methyl-N-octadecyl-3-nitro-4-chlorobenzamide, 12.4 g of 5-t-butyl-3-hydroxyisoxazole and 12.4 g of potassium carbonate and reacted for 5 hours at 100° C. The solvent was distilled off under reduced pressure and ethyl acetate and water were added to the residual content and the same stirred. The isolated organic phase was then taken out and subjected to silica gel column chromatography to obtain the desired product. This was recrystallized from n-hexane/ethyl acetate. Yield: 18.0 g, 43.1%; m.p. 64° C.

Synthesis Example 2-4

Synthesis of 4-chloromethyl-5-t-butyl-2-(4-N-methyl-N-octadecylcarbamoyl-2-nitrophenyl)-3-isoxazolone:

36 g of 5-t-butyl-2-(4-N-methyl-N-octadecylcarbamoyl-2-nitrophenyl)-3-isoxazolone, 5.7 g of paraformaldehyde and 10.3 g of zinc chloride were admixed with 250 ml of acetic acid and reacted for 20 hours at 100° C. while hydrogen chloride gas was blown thereinto. After the reaction, the reaction mixture was cooled and poured into ice water. The solid as precipitated out was removed by filtratin, dissolved in chloroform and purified by conventional column chromatography. Yield: 10.0 g, 25.6%; m.p. 77° C.

Synthesis Example 2-5

Synthesis of 4-(4-t-butoxycarbonylaminophenoxy)-methyl-5-butyl-2-(4-N-methyl-N-octadecylcarbamoyl-2-nitrophenyl)-3-isoxazolone:

10.0 g of 4-chloromethyl-5-t-butyl-2-(4-N-methyl-N-octadecylcarbamoyl-2-nitrophenyl)-3-isoxazolone, 4.0 g of 4-t-butoxycarbonylaminophenol and 3.0 g of potassium carbonate were admixed with 100 ml of acetone and heated for 7 hours under reflux.

After the reaction, the acetone was distilled off and ethyl acetate/water was added to the residual content for extraction. The organic phase was purified by silica gel column chromatography. Yield: 9.0 g, 70.5%.

Synthesis Example 2-6

Synthesis of 4-(4-aminophenoxy)methyl-5-t-butyl-2-(4-N-methyl-N-octadecylcarbamoyl-2-nitrophenyl)-3-isoxazolone:

9.0 g of 4-(4-t-butoxycarbonylaminophenoxy)-methyl-5-t-butyl-2-(4-N-methyl-N-octadecylcarbamoyl-2-nitrophenyl)-3-isoxazolone was dissolved in 80 ml of chloroform and cooled to 5° C. or lower. Next, 10 ml of trifluoroacetic acid was gradually added dropwise thereto. The whole was reacted for 10 hours, while gradually warming up to room temperature. After the reactin, the reaction mixture was poured into sodium bicarbonate and neutralized and then extracted with ethyl acetate. The extract was purified by silica gel column chromatography. Yield: 6.9 g, 90.85%.

Synthesis Example 2-7

Synthesis of Compound No. 15:

5.4 g of 4-(4-aminophenoxy)methyl-5-t-butyl-2-(4-N-methyl-N-octadecylcarbamoyl-2-mitrophenyl)-3-isooxazolone was dissolved in 40 ml of chloroform and cooled to 0° C. To this was added 0.8 g of pyridine and then 3.1 g of the following compound (A) was added thereto and reacted for 2 hours.

After the reaction, the chloroform was distilled off and the residual content was dissolved in a small amount of DMF. Next, methanol was added thereto in an amount such that no oily substance precipitated out and the system was stirred, whereby crystals precipitated out. The crystals were renewed by filtration and again purified in the same manner. Yield: 3.9 g, 46.5%. m.p. 157°–159° C. Compound (A):

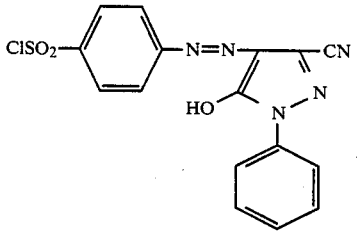

Synthesis Example 3

Synthesis of Compound No. 43:

4 g of 5-t-butyl-2-(4-N-methyl-N-octadecylcarbamoyl-2-nitrophenyl)-3-isoxazolone as obtained in the above Synthesis Example 2-4 and 1.2 g of 1-phenyl-5-mercaptotetrazole were dissolved in acetone. Next, 1.4 g of potassium carbonate was added thereto and the system stirred for 3 hours at room temperature. The inorganic component was filtered out and the residual content was recrystallized from methanol to obtain colorless crystals. Yield: 1.1 g, 22.4%, m.p. 66°–68° C.

Synthesis Example 4

Synthesis of Compound No. 10:

Synthesis Example 4-1

Synthesis of 5-phenyl-3-hydroxyisoxazole:

This was synthesized in accordance with the method described in *Chemical and Pharmaceutical Bulletin,* Vol. 14, No. 11, pp. 1277–1286 (1966).

Synthesis Example 4-2

Synthesis of 5-phenyl-2-(4-N-methyl-N-octadecylsulfamoyl-2-nitrophenyl)-3-isoxazolone:

50.3 g of 2-nitro-4-N-methyl-N-octadecylsulfamoyl-1-chlorobenzene and 19.3 g of 5-phenyl-3-hydroxyisoxazole as obtained in the above Synthesis Example 4-1 were dissolved in 16.8 g of dimethylformamide and 16.8 g of potassium carbonate was added thereto and the system reacted for 5 hours at 80° C. Next, the inorganic component was filtered out, the solvent was distilled off under reduced pressure and the residual content was recrystallized from methanol. Yield: 52.2 g, 83.2%.

Synthesis Example 4-3

Synthesis of Compound No. 10:

7.5 g of 5-phenyl-4-(4-aminophenoxymethyl)-2-(4-N-methyl-N-octadecylsulfamoyl-2-nitrophenyl)-3-isoxazolone as obtained in accordance with the steps of the above Synthesis Examples 2-4 through 2-6 was dissolved in chloroform and 1.2 g of pyridine was added thereto. Next, 6.5 g of the following Compound (B) was added thereto and the system reacted for 3 hours at room temperature. After the reaction, the chloroform was distilled off and the product was recrystallized from dimethylacetamide with a small amount of methanol. Yield: 7.8 g, 57.3%. Compound (B):

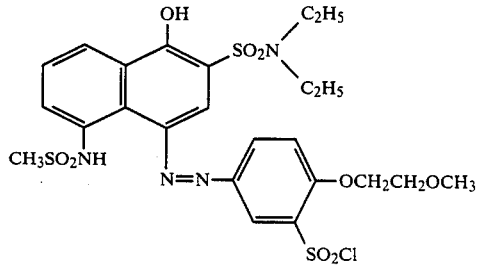

The compounds of the present invention can release a photographically useful group reversely to the imagewise development of silver halide, or reversely corresponding to the development of silver halide, rapidly, with good timing and with high efficiency, and therefore, can be applied over a broad field of use in the photographic arts. Some examples of the uses to which the compounds of the present invention can be applied are given hereafter.

(1) In the case the compounds of the present invention involve a diffusible dye as a photographically useful group, they can be used in the formation of color images in a diffusion transfer process or a sublimation transfer process. In this case, when negative emulsions are used, positive images are obtained whereas when autopositive emulsions are used, negative images are obtained.

(2) In the case the compounds of the present invention involve a compound which is a colorless compound or a dye with a changed absorption wavelength when it is bonded to the compound but which is colored or is differently colored after release therefrom as a photographically useful group, color is changed before and after release of the compound. Accordingly, images may be formed by utilization of such color change.

(3) In the case the compounds of the present invention involve a fog inhibitor as a photographically useful group, a larger amount of the fog inhibitor will typically be released in non-developed areas than in developed areas, and, therefore, effective fog inhibition is possible without lowering of sentitization (which is generally unfavorable in photography). In this case, the same effects can be attained by the use of autopositive emulsions or negative emulsions.

The compounds of the present invention may be applied to various uses over a wide range as mentioned above. Further, the present compounds provide more excellent characteristics than any other known compounds having similar functions.

More precisely:

(1) The compounds of the present invention release a photographically useful group at a sufficient speed even at a temperature of −20° C. or lower and hardly decompose even at higher temperatures. Therefore, they can be used over an extremely broad temperature range. Regarding pH, the reduction reaction of compounds per the present invention is of a controlling step for reaction since the cleavage of the nitrogen-oxygen bond in the compound seemingly results in the direct release of the photographically useful group from the compound, and, therefore, the compounds may be used almost in any desired pH range where the reduction reaction is possible. The preferred temperature range for the use of the present compounds is from −20° C. to +180° C. and the preferred pH range therefor is from 6.0 to 14.0, based on a consideration of the practical use of such compounds in photography.

(2) The compounds of the present invention are oxidative in nature and, therefore, are completely stable under the oxidative environment of the air during storage of photographic materials. The nitrogen-oxygen single bond in the compounds is stable to acids and alkalis and, therefore, stability in storage of photographic materials is excellent.

(3) Further merits of the present compounds are that the reduced and decomposed products of the present compounds, or the products formed by the reduction of the present compounds in processing thereof, are chemically inactive and do not have any undesired side-effects during photographic processing. Further, the present compounds have no adverse influence on the stability of formed images in the storage of photographs.

The compounds of the present invention can be incorporated into a silver halide emulsion layer or layers or into a hydrophilic colloid layer provided on the upper or lower side of the emulsion layer(s) or into both layers, whereby the aimed object of the present invention is attained. In the actual use of the compounds, e.g., of formula (I) of the present invention, for the objects described, the selection of a desired PUG group in accordance with the objects is required, and the amount of the compound added to the photographic material varies depending on the kind of the photographic material and the property of the desired PUG. In general, the amount added is preferably within the range of $1\times10^{-7}$ mole to $1\times10^{3}$ moles per one mole of silver halide.

The compound(s) of the present invention may be used over a broad range. The preferred amount to be used varies, depending upon the kind of PUG. For instance, in the case PUG is a diffusible dye, the amount is generally 0.05 mmole/$m^2$ to 50 mmole/$m^2$, preferably 0.1 mmole/$m^2$ to 5 mmole/$m^2$, though this depends upon the absorbancy index of the dye. In the case PUG is a development inhibitor, the amount is preferably $1\times10^{-7}$ mole to $1\times10^{-1}$ mole, especially preferably $1\times10^{-3}$ mole to $1\times10^{-2}$ mole, per mole of silver halide. In the case PUG is a development accelerator or a nucleating agent, the same is used as in the case of the aforesaid development inhibitor. In the case PUG is silver halide solvent, the amount is preferably within the range of $1\times10^{-5}$ mole to $1\times10^{3}$ mole, especially preferably $1\times10^{-4}$ to $1\times10$ mole, per mole of silver halide.

The compounds of the present invention release a photographically useful grup or a precursor thereof, after accepting an electron from a reducing substance. Accordingly, when the reducing substance is imagewise converted into the oxidized form thereof, the compounds reversely imagewise release the photographically useful group or the precursor thereof.

The reducing substances used for the reduction of the compounds can be inorganic compounds or organic compounds, and their oxidation potential is preferably lower than the standard oxidation-reduction potential of silver ion/silver, which is 0.80 V.

Examples of usable inorganic compounds include metals having an oxidation potential of 0.80 V or less, such as Mn, Ti, Si, Zn, Cr, Fe, Co, Mo, Sn, Pb, W, $H_2$, Sb, Cu and Hg; ions and complexes thereof having an oxidation potential of 0.80 V or less, such as $Cr^{2+}$, $V^{2+}$, $Cu^{+}$, $Fe^{2+}$, $MnO_4^{2-}$, $I^{-}$, $Co(CN)_6^{4-}$, $Fe(CN)_6^{4-}$, $(Fe\text{-}EDTA)^{2-}$; metal hydrides having an oxidation potential of 0.80 V or less, such as NaH, LiH, KH, NaBH, $LiBH_4$, $LiAl(O—tC_4H_9)_3H$, $LiAl(OCH_3)_3H$; sulfur or phosphorus compounds having an oxidation potential of 0.80 V or less, such as $Na_2SO_3$, NaHS, $NaHSO_3$, $H_3P$, $H_2S$, $Na_2S$, $Na_2S_2$ The reducing organic compounds which are usable include, for example, organic nitrogen compounds such as alkylamines and arylamines, organic sulfur compounds such as alkylmercaptans and arylmercaptans and organic phosphorus compounds such as alkylphosphines and arylphosphines, and in particular, compounds of the following formula (C), which follow the Kendal-Pelz theory, are preferred.

$$Q_1(\alpha=\beta)_nQ_2 \qquad (C)$$

In formula (C), $Q_1$ and $Q_2$ each represents —O—Sub,

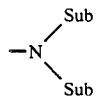

or —S—Sub;

n is an integer from 0 to 8, and when n=0, formula (C) is $Q_1$–$Q_2$;

$\alpha$ and $\beta$ each represents $$-\overset{\text{Sub}}{C}= \text{ or } -N=,$$

and when n is more than 2, $\alpha_1$, $\alpha_2$, $\beta_1$, $\beta_2$ . . . in the formula $(\alpha_1=\beta_1)(\alpha_2=\beta_2)$ . . . may be the same or different from each other;

Sub represents a hydrogen atom or the same substituent as mentioned for Sub for earlier formula (A); and $Q_1$ and $Q_2$, $Q_1$ and $\alpha$ or $\beta$, and $Q_2$ and $\alpha$ or $\beta$ may also form a hetero-ring.

Especially preferred compounds among those of formula (C) are given below.

(C-1)

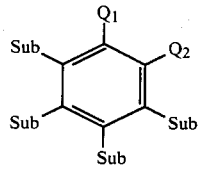

(C-2)

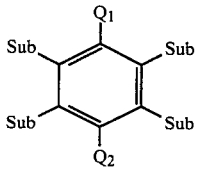

(C-3)

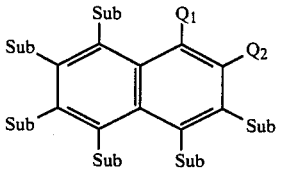

(C-4)

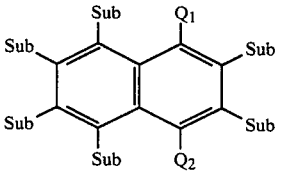

(C-5)

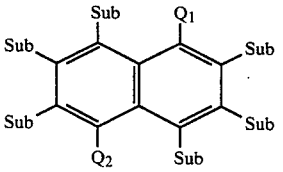

(C-6)

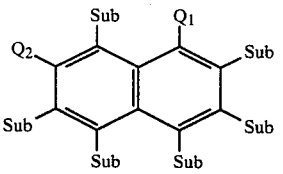

(C-7)

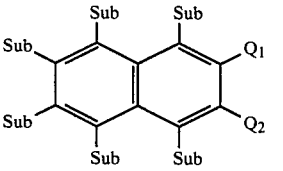

-continued (C-8)

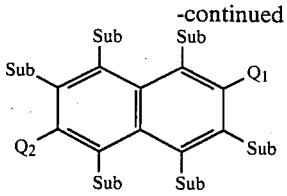

(C-9)

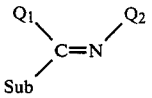

(C-10)

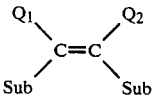

(C-11)

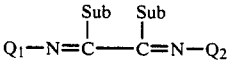

(C-12)

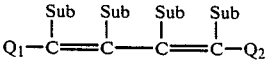

(C-13)

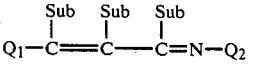

In the above formulae (C-1) through (C-13), Sub represents a hydrogen atom or the same substituent as mentioned for Sub of formula (A).

Among the compounds of formula (C-1) through (C-13), those of formulae (C-1), (C-2), (C-3), (C-4), (C-7), (C-9), (C-10) and (C-12) are especially preferred.

Preferred examples of $Q_1$ and $Q_2$ are as follows:

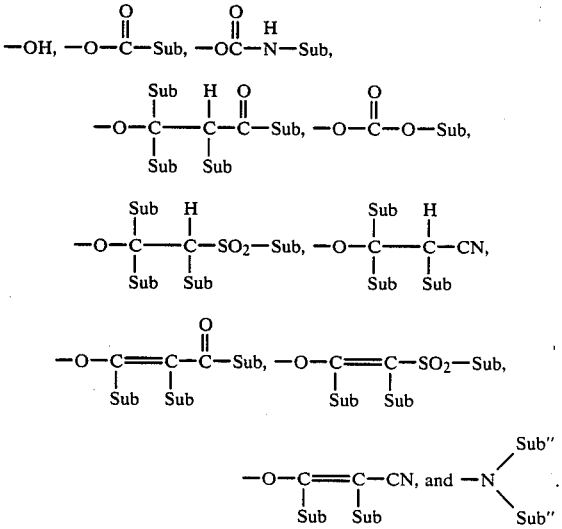

In the above formulae, Sub has the same meaning as mentioned above; Sub" is the same as Sub and is preferably a hydrogen atom, an alkyl group, an aryl group, an acyl group or a sulfonyl group.

Especially preferred reducing agents are given below.

3-Pyrazolidones and precursors thereof, such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone.

Hydroquinones and precursors thereof, such as hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenyl, 2-methyl-4-benzoyloxyphenol, 2-t-butyl-4-(4-chlorobenzoyloxy)-phenol.

Various reducing agents and combinations thereof as illustrated in U.S. Pat. No. 3,039,869 may also be used in the present invention.

Color developers are usable as a reducing substance in the present invention, including p-phenylene-type color developers as described in U.S. Pat. No. 3,531,286. Among them, N,N-diethyl-3-methyl-p-phenylenediamine is typical. Other useful reducing agents include aminophenols as described in U.S. Pat. No. 3,761,270. Among the aminophenol reducing agents, especially useful compounds are 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride. Further, *Research Disclosure,* Vol. 151, RD No. 15108 (November 1976) and U.S. Pat. No. 4,021,240 describe 2,6-dichloro-4-substituted sulfonamidophenols and 2,6-dibromo-4-substituted sulfonamidophenols; and Japanese patent application (OPI) No. 116740/84 describes p-(N,N-dialkylaminophenyl)sulfamines; and these are usable in the present invention. In addition to the aforesaid phenol-type reducing agents, naphthol-type reducing agents such as 4-aminonaphthol derivatives and 4-substituted sulfonamidonaphthol derivatives as described in *Research Disclosure,* Vol. 178, RD No. 17842 (February 1979) and Japanese patent application (OPI) No. 88136/81 are especially useful. Further, general color developers are usable in the present invention, which are described in various publications. For instance, U.S. Pat. No. 2,895,825 describes aminohydroxypyrazole derivatives; U.S. Pat. No. 2,892,714 describes aminopyrazoline derivatives; and *Research Disclosure,* Vol. 194, RD No. 19412 (June, 1980), pp. 227–230 and ibid., Vol. 194, RD No. 19415 (June, 1980), pp. 236–240 describe hydrazone derivatives. These color developers may be used singly or in the form of a combination of two or more thereof.

For the practice of the present invention, the functioning of the present invention in silver halide photographic materials will be explained.

The present compound is added to a silver halide photographic material and is reduced, following the electron transfer pathway as shown by the arrows in the following Scheme (1), to thereby release the photographically useful group therefrom.

Scheme (1)

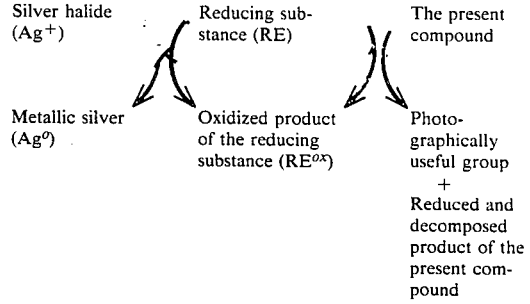

In the above Scheme (1), the reducing substance (RE) is the aforesaid inorganic or organic reducing substance, and this may be externally added to a processing solution to be reacted with the compound of the invention or may previously be incorporated into the photographic material to be reacted with the compound of the invention, or otherwise, this may previously be incorporated into the photographic material while the same or a different reducing substance (RE) is added to the processing solution and is additionally reacted with the present compound.

In case a conventional negative type silver halide emulsion as is generally used is used in the photographic material, the reducing substance (RE) is consumed in the reduction of the silver halide in accordance with the degree of the exposure of the silver halide and, thereof, the amount of the reducing substance (RE) consumed in the reaction with the present compound is such that it reversely corresponds to the degree of the exposure, that is, the amount of the reducing substance (RE) as remained without being consumed in the reduction of the silver halide among the whole reducing substance (RE) as supplied. Accordingly, a larger amount of the photographically useful group is released in the area less exposed in the material.

As opposed to the case of a negative type emulsion, when an autopositive emulsion is used in the photographic material, the reduction of the silver halide occurs in the unexposed areas and, therefore, the reducing substance is consumed in the unexposed areas. Accordingly, the reaction of the present compound and the reducing substances proceeds primarily in more exposed areas in the material and the photographically useful group is therefore released more largely in the more exposed areas.

As earlier mentioned, the compounds of the present invention release a small amount of the photographically useful group in developed areas (where the silver halide and the reducing substance react) but a large amount thereof in non-developed areas. Thus, an electron transfer agent (ETA) which is a reducing substance and acts in accordance with the following reaction Scheme (2) and may be used together with the present compound(s) in order to regulate the ratio of the amount of released photographically useful group in developed areas to that in undeveloped areas (in general, for the purpose of improving the ratio).

Scheme (2)

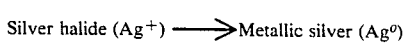

-continued

Scheme (2)

Electron transfer agent (ETA) ⇄ Oxidized electron transfer agent

Oxidized product of reducing substance ⇄ Reducing substance (RE)

Photographically useful group; and reduced and decomposed product of the present compound ⇄ The present compound In Scheme (2), the electron transfer agent (ETA) may be selected from the earlier mentioned reducing agents, preferably from organic reducing substances of formulae (C-1), (C-2), (C-3), (C-4), (C-7), (C-9), (C-10) and (C-12). The electron transfer agents (ETA) desirably have an oxidation-reduction potential positioned between the oxidation-reduction potential of the reducing substances (RE) and that of the silver halide(s) so that the agents may show their activity to the fullest.

Regarding the reaction scheme for the electron transfer agent (ETA) and the reducing agent (RE), the same given for the reducing substance (RE) in Scheme (1) applies thereto.

In Scheme (2), transfer of the electron from the reducing substance to the silver halide proceeds through the electron transfer agent, while other steps for release of the photographically useful group are essentially same as those in Scheme (1). If the reducing substance is immobile in Scheme (2), the electron transfer from the reducing substance to the silver halide is often slow. If the electron transfer from the reducing substance to the silver halide is slow, the reaction between the reducing substance and the present compound(s) preferentially occurs, as can be understood from Scheme (1) and, therefore, the difference in the amounts of the photographically useful group released in developed areas and the undeveloped areas is small.

The electron transfer agent may be used for the purpose of the smooth electron transfer from an immobile reducing substance to the silver halide to thereby enlarge the difference in the amounts of photographically useful group as released in developed areas and undeveloped areas. In order to meet this object, when the electron transfer agent is used together with an immobile reducing substance (RE), the ETA must have a higher transferability than the reducing substance (RE). As shown in Scheme (2), an immobile reducing substance can efficiently be used because of the co-use of an electron transfer agent.

The reducing agents which may be used together with the ETA may be any one of the aforesaid reducing agents which is substantially immobile in the layers of the photographic material and, in particular, hydroquinones, aminophenols, aminonaphthols, 3-pyrazolidinones, saccharin and precursors thereof, picoliniums and electron donors are described in Japanese patent application (OPI) No. 110827/78 are especially preferred.

Examples of preferred reducing agents are given below.

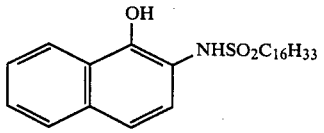

S-1

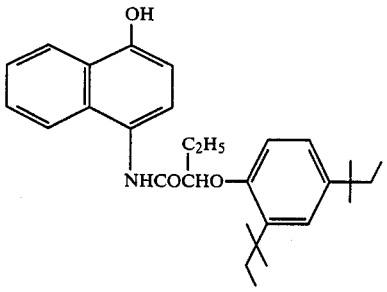

S-2

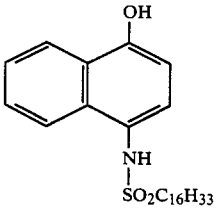

S-3

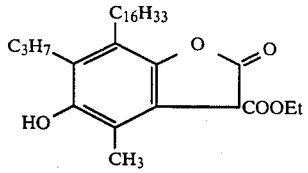

S-4

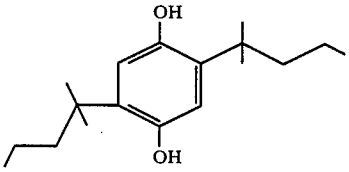

S-5

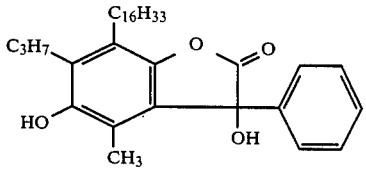

S-6

-continued
S-7
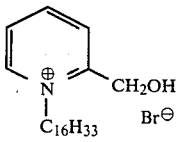
S-8
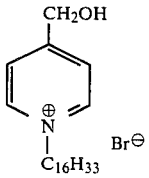
S-9
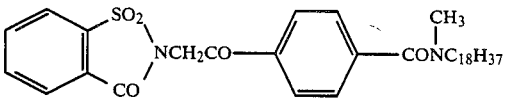
S-10
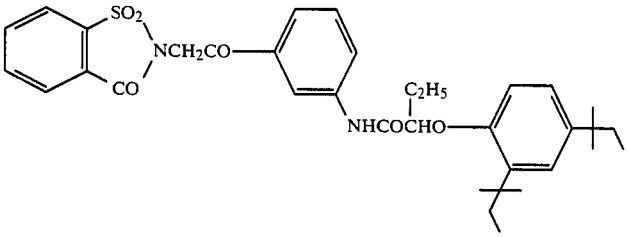
S-11
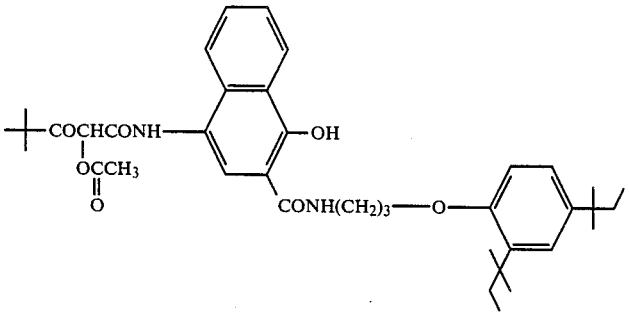
S-12
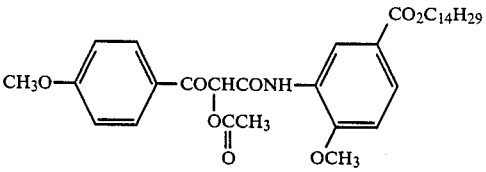
S-13
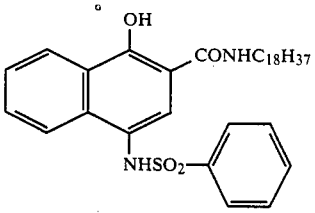
S-14
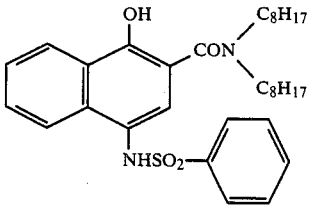
S-15
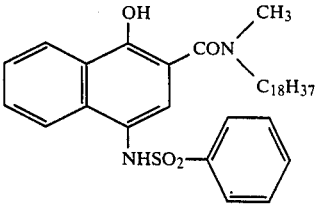
S-16
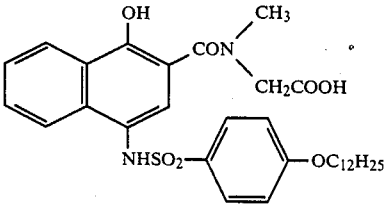
S-17
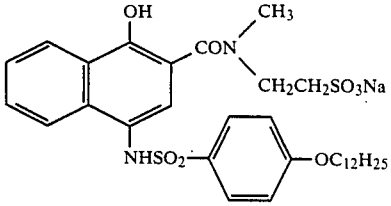

-continued
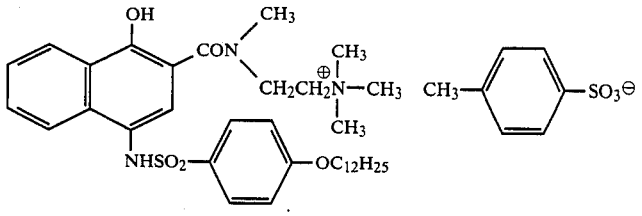
S-18
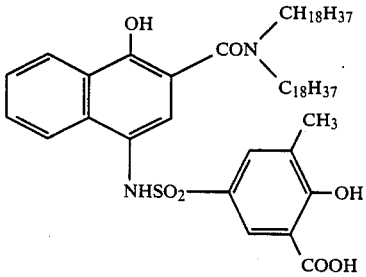
S-19
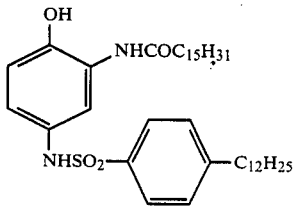
S-20
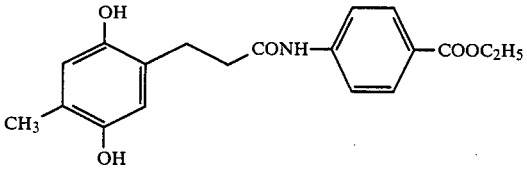
S-21
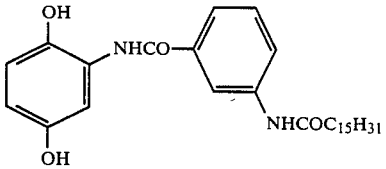
S-22
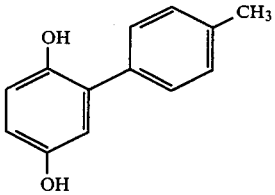
S-23
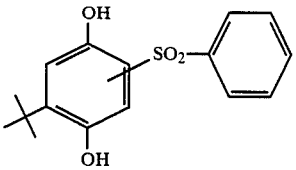
S-24
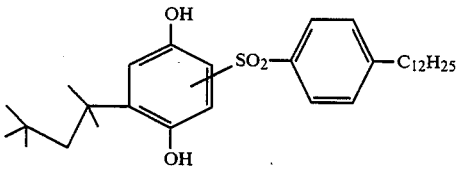
S-25
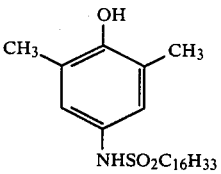
S-26
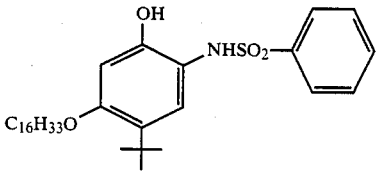
S-27
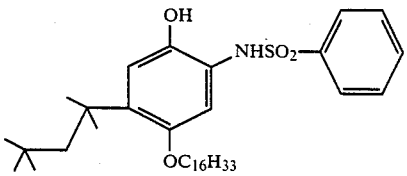
S-28
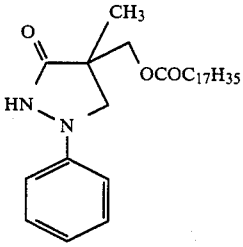
S-29
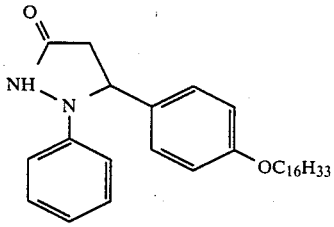
S-30

-continued
S-31
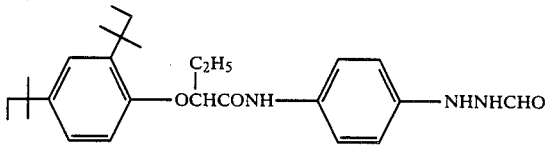
S-32
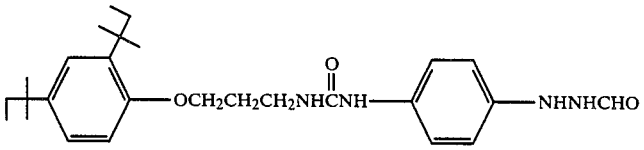
S-33
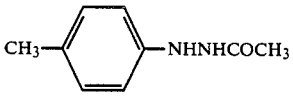
S-34
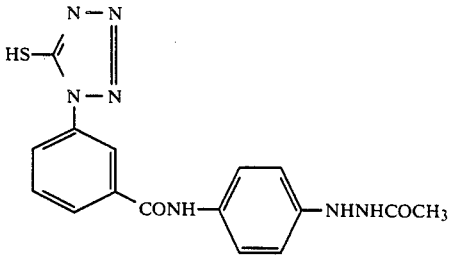
S-35
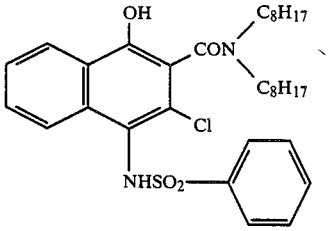
S-36
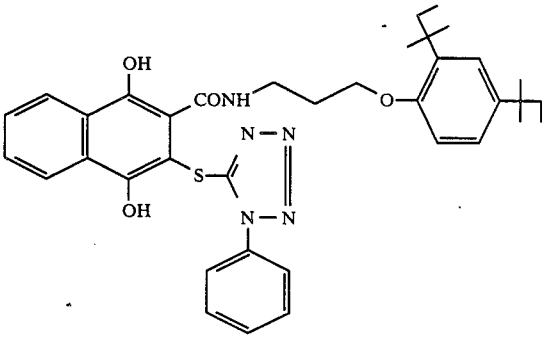
S-37
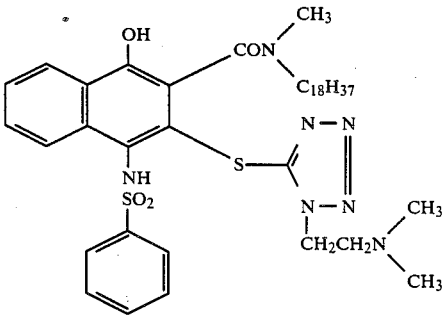
S-38
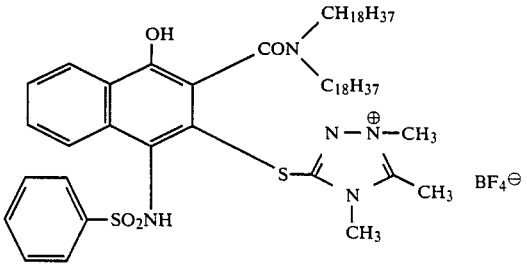
S-39
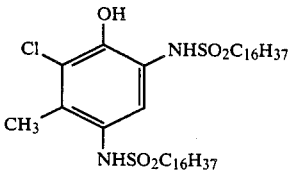
S-40
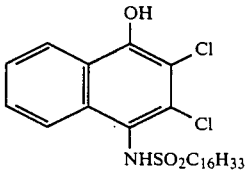

-continued

S-41

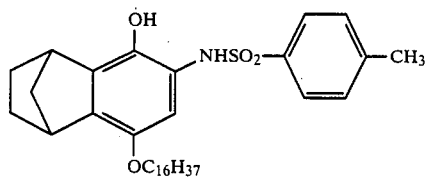

S-42

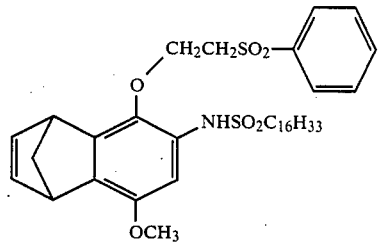

S-43

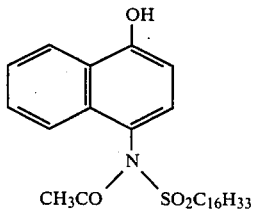

S-44

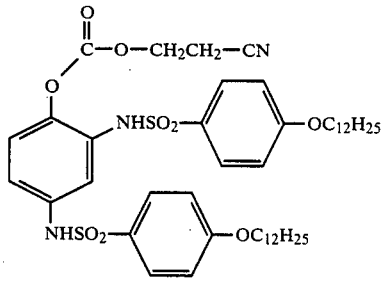

S-45

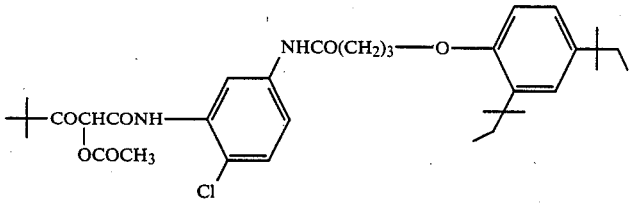

ETA's usable in combination with the reducing substance may be any ETA which may be cross-oxidized with said substance. Preferred examples thereof are diffusible 3-pyrazolidines, aminophenols, phenylenediamines and reductones.

Specific examples include the following compounds: 3-pyrazolidinones such as 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone, 1,5-diphenyl-3-pyrazolidinone; aminophenols such as p-aminophenol, p-methylaminophenol, p-dimethylaminophenol, p-dimethylaminophenol, p-dibutylaminophenol, p-piperidinoaminophenol, 4-dimethylamino-2,6-dimethoxyphenol; phenylenediamines such as N-methyl-p-phenylenediamine, N,N-dimethyl-p-phenylenediamine, N,N-diethyl-p-phenylenediamine, N,N,N',N'-tetramethyl-p-phenylenediamine, 4-diethylamino-2,6-dimethoxyaniline; and reductones such as piperidinohexose-reductone and pyrrolidinohexose-reductone.

In addition, such precursors that can be hydrolyzed under alkaline conditions to form the aforesaid compounds may be used in the present invention. Such precursors are described, for example, in Japanese patent application (OPI) No. 52055/80, Japanese patent publication No. 39727/79 and Japanese patent application (OPI) No. 135949/82.

The compounds of formula (I) of the present invention may be used in conventional siliver halide photographic material which are to be developed with a developer near normal temperature (for example, X-ray films, lith films and other black-and-white photographic materials, color negative films, color papers, color reversal or other color photographic materials, color diffusion transfer photographic materials) or may also be used in other photographic materials for heat development.

In case the present compound are applied to conventional silver halide photographic materials, two systems are preferred for the reaction of the aforesaid reducing substance or the combination of the aforesaid reducing substance and ETA with the photographic material. In one system, the reducing substance or the combination of the substance and ETA is applied to the photographic material in the form of a developer in development thereof; and in the other system, the reducing substance is previously incorporated in the photographic material and the ETA is applied to the material in the form of a developer. In the former system, the preferred amount to be used is 0.001 mole/liter to 1 mole/liter, which is the concentration of the substance(s) in the total developer solution. In the latter system of previous incorporation in the element, 0.5 to 5 moles of the reducing substance is preferably incorporated into the material per mole of the present compound(s), and the concentration of ETA in the solution is preferably 0.001 mole/liter to 1 mole/liter.

On the other hand, in case the present compounds are applied to a heat developable photographic material, the reducing substance or the combination of the reducing substance and ETA is preferably previously incorporated into the heat developable photographic material. In this case, the preferred amounts are 0.5 to 5 moles of the reducing substance and 0.1 to 10 moles of ETA, per mole of the present compound(s).

The silver halide which can be used in the present invention may include any of silver chloride, silver bromide, silver iodide, silver chlorobromide, silver chloroiodide, silver iodobromide, and silver chloroiodobromide.

A halogen composition in the silver halide grains may be uniform, or the silver halide grains may have a multiple structure in which the composition is different between a surface portion and an inner portion (see Japanese patent application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of 0.5 μm or less, a diameter of at least 0.6 μm and an average aspect ratio of 5 or more (see U.S. Pat. Nos. 4,414,310 and 4,435,499, and West German patent application (OLS) No. 3,241,646A1, etc.), and a monodispersed emulsion having a nearly uniform distribution of grain size (see Japanese patent application (OPI) Nos. 178235/82, 100846/83 and 14829/83, PCT application (OPI) No. 83/02338A1, and European Pat. Nos. 64,412A3 and 83,377A1, etc.) may be used in the present invention.

Two or more kinds of silver halides in which a crystal habit, a halogen composition, a grain size and/or a distribution of grain size, etc. are different from each other may be used in mixture. Further, two or more kinds of monodispersed emulsions having different grain size from each other may be employed in mixture to control gradation.

An average grain size of the silver halide used in the present invention is preferably from 0.001 μm to 10 μm, and more preferably from 0.001 μm to 5 μm.

These silver halide emulsions can be prepared by any of an acid process, a neutral process, and an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, a concentration of addition, the amount of addition and/or speed of addition of silver salts and halogen salts added may be raised (see Japanese patent application (OPI) Nos. 142329/80 and 158124/80, and U.S. Pat. No. 3,650,757, etc.).

Furthermore, silver halide grains of epitaxial junction type (see Japanese patent application (OPI) No. 16124/81, and U.S. Pat. No. 4,094,684, etc.) may be employed.

In the step for formation of silver halide grains used in the present invention, ammonia, an organic thioether derivative as described in Japanese patent publication No. 11386/72, or a compound containing sulfur as described in Japanese patent application (OPI) No. 144319/78, etc., can be used as a solvent for silver halide.

In a process of the formation or physical ripening of silver halide grains, a cadmium salt, a zinc salt, a lead salt, or a thallium salt, etc., may coexist. These salts are used for the purposes of improving a change in photographic performance against the pressure, etc. Further, for the purpose of eliminating high-intensity reciprocity failure or low-intensity reciprocity failure, a water-soluble iridium salt such as iridium (III or IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field of emulsions for conventional type photographic light-sensitive materials can be applied alone or in combination therewith. Such a chemical sensitization may be carried out in the presence of a nitrogen-containing heterocyclic compound (see Japanese patent application (OPI) Nos. 126526/83 and 215644/83, etc.).

The silver halide emulsion used in the present invention can be that of a surface latent image type in which a latent image is formed mainly on the surface of grains, or that of an internal latent image type in which a latent image is formed mainly in the interior of grains. Further, a direct reversal emulsion in which an internal latent image type emulsion and a nucleating agent are used in combination may be used. Examples of the internal latent image type emulsions suitable for this purpose are described in U.S. Pat. Nos. 2,592,250 and 3,761,276, Japanese patent publication No. 3534/83, and Japanese patent application (OPI) No. 136641/82, etc. Preferred examples of the nucleating agents suitably used in the present invention are described in U.S. Pat. Nos. 3,227,552, 4,245,037, 4,255,511, 4,266,031 and 4,276,364, and West German patent application (OLS) No. 2,635,316, etc.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazole nucleus, a selenazole nucleus, an aimidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect or materials which do not substantially absorb visible light but which exhibit a supersensitizing effect. For example, aminostilbene compounds substituted with a nitrogen-containing heterocyclic group (for example, those described in U.S. Pat. Nos. 2,993,390 and 3,635,721, etc.), aromatic organic acid-formaldehyde condensates (for example, those described in U.S. Pat. No. 3,743,510, etc.), cadmium salts, azaindene compounds, etc., can be present. The combinations are described in U.S. Pat. Nos. 3,615,613, 3,615,641, 3,617,295 and 3,635,721 are particularly useful.

Gelatin is preferably used as the binder or protective colloid in the emulsion layers or intermediate layers of the present photographic materials, but other conventional hydrophilic colloids may be used alone or together with gelatin.

The gelatin may be either a lime treated gelatin or acid treated in the present invention. Details on the preparation of gelatins are given in *The Macromolecular Chemistry of Gelatin,* written by Arther Vaise, published by Academic Press, 1964.

The photographic emulsions used in the present invention may contain surfactants singly or in the form of a mixture thereof.

These are essentially used as a coating auxiliary and sometimes for some other purposes such as emulsification and dispersion, improvement of photographic characteristic for sensitization, static charge prevention and blocking prevention. These surfactants are classified into natural surfactants such as saponin; nonionic surfactants such as alkyleneoxide type, glycerin type or glycidol type surfactants; cationic surfactants such as higher alkylamines, quaternary ammonium salts, pyridine and the like heterocyclic compounds or phosphonium or sulfonium salts; an anionic surfactants containing an acidic group such as a carboxylic acid, sulfonic acid, phosphoric acid, sulfate or phosphate group; and ampholytic surfactants such as amino acids, aminosulfonic acids or aminoalcohol sulfates or phosphates.

The photographic emulsions used in the present invention may contain various compounds for the purpose of the prevention of fog in manufacture, storage or photographic processing of the photographic materials or for the purpose of stabilization of photographic characteristic of the materials. For these purposes, various compounds which are known as anti-fogging agents or stabilizers may be used, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; thioketo compounds such as oxazolinthione; azaindenes such as triazaindenes, tetrazaindenes (especially 4-hydroxy-substituted (1,3,3a,7-tetrazaindenes), pentazaindenes; as well as benzenethiosulfonic acid, benzenesulfinic acid and benzenesulfonic acid amide.

The photographic emulsion layers of the present photographic materials may contain, for the purpose of increasing sensitivity, intensification of contrast or acceleration of development, for example, thioether compounds, thiomorpholines, quaternary ammonium salt compounds, urethane derivatives, urea derivatives, imidazole derivatives or 3-pyrazolidones.

The present photographic materials may further contain, in the photographic emulsion layers or in any other hydrophilic colloid layers, a water insoluble or sparingly soluble synthetic polymer dispersion for the purpose of the improvement of the dimensional stability of the material. Polymers usable for this purpose are homopolymers or copolymers of alkyl(meth)acrylates, alkoxyalkyl(meth)acrylates, glycidyl(meth)acrylates, (meth)acrylamides, vinyl esters (such as vinyl acetate), acrylonitriles, olefins and/or styrenes; as well as copolymers made of a combination of the said monomers and other monomer components such as acrylic acid, methacrylic acid, $\alpha,\beta$-unsaturated dicarboxylic acids, hydroxyalkyl(meth)acrylates, sulfoalkyl(meth)acrylates and styrenesulfonic acids.

Hydrophilic colloids are preferred as the binders used in the emulsion layers or auxiliary layers (such as protective layers, intermediate layers, etc.) of the present photographic materials, and in particular, gelatin is most preferred. Other hydrophilic colloids than gelatin may, of course, be used. For example, gelatin derivatives, graft polymers of gelatin and ther high molecular weight compound, albumin, casein or like proteins; cellulose derivatives such as hydroxyethyl cellulose, carboxymethyl cellulose or cellulose sulfate esters, sodium alginate, starch derivatives or like saccharide derivatives; polyvinyl alcohol, partially acetalized polyvinyl alcohol, poly-N-vinylpyrrolidone, polyacrylic acid, polymethacrylic acid, polyacrylamide, polyvinylimidazole, polyvinyl pyrazole or like homo- or co-polymers; as well as other various kinds of synthetic hydrophilic high molecular weight substances may be used. In addition, lime treated gelatin, acid treated gelatin or enzyme treated gelatin may also be used.

The present photographic materials may contain in the photographic emulsion layers, or in any other hydrophilic colloid layers, an inorganic or organic hardener. For example, chromium salts (such as chromium alum, chromium acetate), aldehydes (such as formaldehyde, glyoxale, glutaraldehyde), N-methylol compounds (such as dimethylolurea, methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol), active halogen-containing compounds (such as 2,4-dichloro-6-hydroxy-s-triazine), mucohalogenic acids (such as mucochloric acid, mucophenoxychloric acid) and like hardeners may be used singly or in the form of a combination thereof.

The silver halide photographic materials of the present invention may contain other various conventional additives as are well known in the art, for example, whitening agents, dyes, desensitizers, coating assistants, antistatic agents, plasticizers, sliding agents, matting agents, development accelerators, mordanting agents, ultraviolet light absorbents, discoloration inhibitors and color fog-preventing agents.

Examples of such additives which may be used in the present invention are disclosed, for example, in *Research Disclosure,* Vol. 176, RD No. 17643 (Dec., 1978), pp. 22–31.

The compounds of formula (I) of the present invention may be used in various types of silver halide photographic materials, some examples of which are described hereunder.

(1) The present compounds are effective to improve the quality of silver halide photographic materials for photomechanical processing which have a silver chlorobromide or silver chloroiodobromide emulsion layer containing at least 60% silver chloride and 0 to 5% silver chlorobromide (the emulsion preferably being a monodispersed emulsion) and which contain a polyalkyleneoxide(s). For instance, in the case PUG in compound (I) is a development inhibitor, improving toe sharpness is possible without deteriorating dot quality. In the case PUG is a development accelerator, the compounds of formula (I) are effective for intensification of sensitivity and improving dot quality. In such cases, the amount of the present compound used is $1\times10^{-7}$ mole to $1\times10^{-1}$ mole, especially preferably $1\times10^{-6}$ mole to $1\times10^{-2}$ mole, per mole of silver halide.

The polyalkylene oxides used herein may be added to the silver halide photographic material(s) or to the developer(s), or to both the silver halide photographic material(s) and the developer(s).

Useful polyalkylene oxides include polyalkylene oxides having 2 to 4 carbon atoms, such as ethylene oxide, propylene-1,2-oxide or butylene-1,2-oxide; condensation products of polyalkylene oxides, which preferably comprise at least ten ethylene oxide units, and compounds having at least one active hydrogen atom, such as water, aliphatic alcohols, aromatic alcohols, fatty acids, organic amines or hexitol derivatives; as well as block copolymers comprising two or more polyalkylene oxides. Examples of usable polyalkylene oxide compounds are polyalkylene glycols, polyalkylene glycol alkylethers, polyalkylene glycol arylethers, polyalkylene glycol(alkylaryl)esters, polyalkylene glycol esters, polyalkylene glycol fatty acid amides, polyalkylene glycol amines, polyalkylene glycol block copolymers, polyalkylene glycol graft copolymers etc.

The molecular weight of the polyalkylene oxides preferably used is most suitable 500 to 10,000.

These polyalkylene oxide compounds may be used alone as a combination of two or more thereof.

In the case the polyalkylene oxide compounds are added to the silver halide photographic material, the amount of the compound is preferably $5\times10^{-4}$ g to 5 g, more preferably $1\times10^{-3}$ g to 1 g per mole of the silver halide. In the case the polyalkylene oxide compounds are to be added to the developer(s), the amount of the compound is generally 0.1 g to 10 g per one liter of the developer.

(2) The compounds of formula (I) of the present invention are effective to improve (or elongation) the dot gradation of photographic materials having monodispersed silver halide emulsion layers capable of forming negative images of ultra-high contrast by development with developers stabilized by the action of hydrazine derivatives, e.g., as described in U.S. Pat. Nos. 4,224,401, 4,168,977, 4,241,164, 4,311,781, 4,272,606, 4,221,857, 4,243,739, 4,272,614, and 4,269,929, without deterioration of the dot quality of the materials.

In the above development, stabilized developers are those containing at least 0.15 mole/liter of such sulfite ion as a preservative and a pH of 10.0 to 12.3. Such developers, containing a large amount of such preservative, are more stable than conventional lith developers which contain only an extremely low amount of the sulfite ion, and, having a relatively low pH value, are hardly subjected to oxidation by the air and are more stable, for example, than developers (pH of 12.8) in the high contrast image formation systems as described in U.S. Pat. No. 2,419,975.

In the present case, PUG in the compounds of formula (I) of the present invention is preferably a compound having development acceleration activity in high contract image formation systems containing a hydrazine derivative.

Examples of preferred compound are hydroxytetrazaindene derivatives as described in Japanese patent application (OPI) No. 83714/78, thioamide compounds as described in Japanese patent application (OPI) No. 137133/78, heterocyclic quaternary salt compounds as described in Japanese patent application (OPI) No. 77616/78 and amine compounds as described in Japanese patent application (OPI) No. 140340/85, and, in particular, hydroxytetrazaindene derivatives are especially preferred. In the present case, the compounds of formula (I) of the present invention are preferably used in an amount of $1\times10^{-5}$ mole to $8\times10^{-2}$ mole, especially preferably $1\times10^{-4}$ mole to $5\times10^{-2}$ mole, per mole of silver halide.

In the case the hydrazine derivatives are to be incorporated into a photographic material per the present invention, they are preferably incorporated into the silver halide emulsion layers, or may also be incorporated into any other non-light-sensitive hydrophilic colloid layers (such as protective layers, intermediate layers, filter layers, anti-halation layers). For instance, in the case the compounds are soluble in water, they may be added in the form of an aqueous solution; and in the case these are sparingly soluble in water, they may be added to a hydrophilic colloid solution in the form of a solution as dissolved in water compatible organic solvents such as an alcohol(s), ester(s) or ketone(s). In the case these compounds are to be added to a silver halide emulsion layer(s), the addition may be carried out in any desired stage from the beginning of chemical ripening to before the coating of the emulsions, and, in particular, addition is preferably carried out during the period from after chemical ripening to before emulsion coating. It is especially preferred to add the compound to the coating solution which is being prepared just for coating.

With respect to the amount of hydrazine derivative(s) to be added, the optimum amount is desirably selected depending upon the grain diameter of the silver halide emulsion(s), the halogen composition thereof and the method and degree of chemical sensitization of the emulsion(s) as well as the relation between the layers to which the compound(s) is/are to be added and the silver halide emulsion layer(s) and the kinds of anti-fogging compounds. Further, the testing method for selection will be known by one skilled in the art. In general, the amount is preferably $10^{-6}$ mole to $1\times10^{-1}$ mole, especially preferably $10^{-5}$ mole to $4\times10^{-2}$ mole, per mole of the silver halide.

(3) The compounds of formula (I) of the present invention may be applied to multi-layer multi-color photographic materials having at least two light-sensitive layers on a support, each with a different spectral sensitivity, mainly for the purpose of fog inhibition, gradation regulation, improving color reproducibilirty and sensitization. Multi-layer natural color photographic materials have, in general, at least one red-sensitive emulsion layer, at least one green-sensitive emulsion layer and at least one blue-sensitive emulsion layer on a support. The order of provision of these layers may freely be determined in accordance with the necessity thereof. The preferred order for the arrangement of the layers comprises a red-sensitive layer, a green-sensitive layer and a blue-sensitive layer from the support, or a blue-sensitive layer, a red-sensitive layer and a green-sensitive layer from the side of the support. Each of these emulsion layers may comprise two or more emulsion layers which have a different sensitivity, or a non-light-sensitivive layer may be provided between or among two or more emulsion layers having the same sensitivity. In general, the red-sensitive emulsion layer contains a cyan-forming coupler, the green-sensitive emulsion layer contains a magenta-forming coupler and the blue-sensitive emulsion layer contains a yellow-forming coupler, but, as desired other different combinations may be used per the present invention.

Various color couplers may be used in the present photographic materials. "Color couplers" herein mean compounds capable of forming dyes by a coupling reaction with an oxidized aromatic primary amine developing agent. Typical examples of usable color couplers are naphthol or phenol type compounds, pyrazolone or pyrazoloazole type compounds and open or heterocyclic ketomethylene compounds. Examples of cyan, magenta and yellow couplers which may be used in the present invention are described in the patent publications referred to in *Research Disclosure,* Vol. 176, RD No. 17643 (Dec., 1978), Item VII-D and ibid., Vol. 187, RD No. 18717 (Nov., 1979).

The color couplers to be incorporated in the photographic materials of this invention are preferably non-diffusible and have a ballast group or are polymerized. Two equivalent couplers where the coupling split-off group is substituted are preferred to four equivalent couplers where the coupling active site has a hydrogen atom, because the amount of the silver coated is reduced. Further, couplers capable of forming a dye with a diffusible, non-coloring coupler, a DIR coupler capable of releasing a development inhibitor on coupling or a coupler capable of releasing a development accelerator on coupling may also be used.

Typical yellow couplers used in the present invention are oil protected acylacetamide couplers. Examples are described, e.g., in U.S. Pat. Nos. 2,407,210, 2,875,057 and 3,265,506. Two equivalnt yellow couplers are preferably used in the present invention, and examples are oxygen atom-releasing type yellow couplers as described in U.S. Pat. Nos. 3,408,194, 3,447,928, 3,933,501, and 4,022,620; and nitrogen atom-releasing type yellow couplers as described in Japanese patent publication No. 10739/83, U.S. Pat. Nos. 4,401,752 and 4,326,024, *Research Disclosure,* Vol. 180, RD No. 18053 (Apr., 1979), British Pat. No. 1,425,020 and German Pat. (OLS) Nos. 2,219,917, 2,261,361, 2,329,587, and 2,433,812. The α-pivaloylacetanilide type couplers are excellent in the fastness of the colored dyes, in particular in the light fastness thereof, and the α-benzoylacetanilide type couplers generally form dyes of high color density.

The magenta couplers which may be used in the present invention are oil protected type indazolone or cyanoacetyl couplers, especially 5-pyrazolone type or pyrazoloazole type couplers, such as pyrazolotriazoles. Among the 5-pyrazolone type couplers, those in which the 3-position is substituted by an arylamino group or an acylamino group are preferred in view of the hue or the color density of the colored dyes; typical examples thereof are described in U.S. Pat. Nos. 2,311,082, 2,343,703, 2,600,788, 2,908,573, 3,062,653, 3,152,896, and 3,936,015. As the releasing group in the two equivalent 5-pyrazolone type couplers, preferred are the nitrogen atom-releasing groups as described in U.S. Pat. No. 4,310,619 and the arylthio groups as described in U.S. Pat. No. 4,351,897. The 5-pyrazolone type couplers with a ballast group as described in European Pat. No. 73,636 also can form dyes with a high color density and are useful herein.

Examples of pyrazoloazole type couplers useful herein are pyrazolobenzimidazoles as described in U.S. Pat. No. 3,061,432, preferably pyrazole(5,1-c)(1,2,4)triazoles as described in U.S. Pat. No. 3,725,067, pyrazolotetrazoles as described in *Research Disclosure,* Vol. 242, RD No. 24220 (June, 1984) and Japanese patent application (OPI) No. 33552/85 and pyrazolopyrazoles as described in ibid., Vol. 242, RD No. 24230 (June, 1984) and Japanese patent application (OPI) No. 43659/85. Imidazo(1,2-b)-pyrazoles as described in U.S. Pat. No. 4,500,630 are preferable because of the lower yellow side absorption of the colored dyes and the light fastness thereof, and in particular, pyrazolo(1,5-b)(1,2,4)triazoles as described in U.S. Pat. No. 4,540,654 are especially preferred.

Cyan couplers which may be used in the present invention are oil protected type naphthol and phenol couplers; typical examples thereof are naphthol type couplers as described in U.S. Pat. No. 2,474,293, especially oxygen atom-releasing type two equivalent naphthol couplers as described in U.S. Pat. Nos. 4,052,212, 4,146,396, 4,228,233 and 4,296,200. Examples of phenol type couplers are given in, e.g., U.S. Pat. Nos. 2,369,929, 2,801,171, 2,772,162, and 2,895,826. Cyan couplers which are resistant to moisture and temperature are preferably used in the present invention, and typical examples thereof are phenol type cyan couplers having an ethyl or higher alkyl group in the m-position of the phenol nucleus, as described in U.S. Pat. No. 3,772,002; 2,5-diacylamino substituted phenol type couplers, as described in U.S. Pat. Nos. 2,772,162, 3,758,308, 4,126,396, 4,334,011, and 4,327,173, German Pat. (OLS) No. 3,329,729 and European Pat. No. 121,365; and phenol type couplers having a 2-phenylureido group and a 5-acylamino group, as described in U.S. Pat. Nos. 3,446,622, 4,333,999, 4,451,559, and 4,427,767. In addition, naphthol type cyan couplers having a sulfonamido or amido group in the 5-position of the naphthol nucleus thereof, as described in Japanese patent application (OPI) No. 237448/85 and European Pat. No. 161,626, can preferably be used in the present invention, to form color images of high fastness.

In order to correct unnecessary absorption of dyes formed from the magenta and cyan couplers in the short wavelength region, colored couplers are preferably used in color negative photographic materials for photographing. Typical examples of colored couplers are yellow colored magenta couplers as described in U.S. Pat. No. 4,163,670 and Japanese patent publication No. 39413/82; and magenta colored cyan couplers as described in U.S. Pat. Nos. 4,004,929 and 4,138,258 and British Pat. No. 1,146,368.

Couplers forming dyes with an appropriate diffusibility may be used for an improvement of graininess. Regarding smearing couplers, examples of magenta couplers are described in U.S. Pat. No. 4,366,237 and British Pat. No. 2,125,570; and yellow, magenta or cyan couplers are described in European Pat. No. 96,570 and German Pat. (OLS) No. 3,234,533.

The dye forming couplers and the aforesaid special couplers may form dimers or higher polymers. Typical examples of polymerized dye forming couplers in general are described in U.S. Pat. Nos. 3,451,820 and 4,080,211. Examples of polymerized magenta couplers are described in British Pat. No. 2,102,173, U.S. Pat. No. 4,367,282 and U.S. patent application Ser. Nos. 849,589 (filed Apr. 8, 1986) and 866,833 (filed May 27, 1986).

Regarding the incorporation of various kinds of couplers into the photographic materials per the present invention, two or more different kinds of couplers may be added to one light-sensitive layer, or the same coupler may of course be added to two or more different layers with no problem.

The compounds of the present invention may be used together with couplers, and may be added to the same emulsion layer together with the couplers, or may be added to an intermediate layer(s) or another photographic auxiliary layer(s) in the form of an independent emulsified dispersion.

The amount of the present compounds to be used is 0.1 to 50 mole%, preferably 0.3 to 15 mole%, based on the coupler in each light-sensitive layer, or the yellow coupler in the blue-sensitive layer, the magenta coupler in the green-sensitive layer or the cyan coupler in the red-senstive layer, in the color photographic material. The amount is preferably $1\times10^{-5}$ mole to $8\times10^{-2}$ mole, especially $1\times10^{-4}$ mole to $5\times10^{-2}$ mole, per mole of the silver halide in the layer to which the present compound is to be added.

(4) The compounds of formula (I) of the present invention are effective to improve photographic characteristics, for example, for the regulation of graininess and gradation of black-and-white photographic materials, especially X-ray photographic materials, having a silver chlorobromide or silver chloroiodobromide emulsion layer(s) containing 0 to 50 mole% silver chloride and up to 15 mole% silver iodide on one side or both sides of the support. In the present case, the amount of the present compound used is $1\times10^{-6}$ mole to $1\times10^{-1}$ mole, especially $1\times10^{-5}$ mole to $5\times10^{-2}$ mole, per mole of the silver halide.

In addition, the compounds of formula (I) of the present invention may be applied to other photographic materials for various uses, for example, electrophotographic materials, black-and-white photographic materials of high resolving power, black-and-white photographic materials for use in a diffusion transfer process, color X-ray photographic materials and color photographic materials for use in a diffusion transfer process.

In the case the silver halide photographic materials of the present invention are processed by a conventional wet method, any and every general means may be used. Known processing solutions may thus be used. The processing temperature is generally selected in the range of 18° C. to 50° C., but this may be lower than 18° C. or higher than 50° C. In accordance with the desired use of the photographic materials, any black-and-white photographic processing for development for the formation of silver images or color photographic processing for development for the formation of color images may be applied to the materials.

Details on various useful photographic processing procedures are described in T. H. James, 4th Ed., *The Theory of the Photographic Process,* pp. 291–436, and *Research Disclosure,* Vol. 176, RD No. 17643 (Dec., 1978), pp. 28–30.

For fixing after black-and-white development, conventional fixers of general compositions may be used. The fixers may contain a thiosulfate or thiocyanate as a fixing agent or an organic sulfur containing compound which is known to be effective as a fixing agent. The fixer may contain a water-soluble aluminum salt as a hardener.

After color development, the photographic emulsion layers are generally bleached. The bleaching may be carried out simultaneously with fixing or separately therefrom.

As the bleaching agent there may be used polyvalent metal compounds such as iron(III), cobalt(III), chromium(VI) or copper(II) compounds, peracids, quinones or nitroso compounds. For instance, ferricyanides, bichromates and iron(III) or cobalt(III) organic complexes, for example, with an organic acid such as an aminopolycarboxylic acid (e.g., ethylenediaminetetraacetic acid, nitrilotriacetic acid, 1,3-diamino-2-propanoltetraacetic acid), citric acid, tartaric acid or malic acid; persulfates and permanganates; and nitrosophenols, etc., may be used. In particular, potassium ferricyanide, sodium ethylenediaminetetraacetate iron(III) and ammonium ethylenediaminetetraacetate iron(III) are especially useful. Ethylenediaminetetraacetate iron(III) complexes are useful either in an independent bleaching solution or in a combined bleach-fix bath.

The bleaching or bleach-fixing solution may contain various additives such as a bleach accelerator as described in U.S. Pat. Nos. 3,042,520 and 3,241,966 and thiol compound as described in Japanese patent application (OPI) No. 65732/78.

In particular, compounds of formula (I) of the present invention where a diffusible dye has been introduced as a PUG group are preferably used for heat developable silver halide photographic materials where mobile dyes are formed by heat development and these are transferred to and fixed in a dye fixing layer, as described, e.g., in Japanese patent application (OPI) Nos. 149046/83, 154445/84, 165054/84, 180548/84, 218443/84, and 133449/85 and U.S. Pat. Nos. 4,503,137, 4,474,876, 4,483,914, 4,455,363, and 4,500,626.

In the case the present compounds are used in heat developable photographic materials, the compounds do not always require the above-described electron transfer agent (ETA). That is, the use of only the reducing substance (RE) enables to sufficiently take place the reaction. In particular, the use of 4-substituted sulfonamidonaphthols are preferred.

In the case the present compounds are used in heat developable photographic materials, organic metal salts may be used as an oxidizing agent, together with the light-sensitive silver halide(s). In this case, the light-sensitive silver halide(s) and the organic metal salt(s) are necessarily kept in direct contact with each other or in close contact with each other.

Among the organic metal salts, organic silver salts are especially preferred.

Organic compounds useful for the formation of the aforesaid organic silver salt oxidizing agents are described, e.g., in Japanese patent application (OPI) No. 107243/86 and U.S. Pat. No. 4,500,626 (52nd column and 53rd column). In addition, silver salts of alkynyl group containing carboxylic acids such as silver phenylpropiolate, as described in Japanese patent application (OPI) No. 113235/85, are also useful.

The amount of the organic silver salt(s) which may be used is 0.01 to 10 moles, preferably 0.01 to 1 mole, per mole of the light-sensitive silver halide. The total amount of the light-sensitive silver halide and the organic silver salt as coated is suitably 50 mg/m$^2$ to 10 mg/m$^2$, calculated in terms of the coated silver amount.

The image forming substances of heat developable photographic materials may be compounds of formula (I) of the present invention which have a dye as PUG, or otherwise, if the compounds of formula (I) where PUG is a photographically useful group other than dyes which are used in heat developable photographic materials. The image forming substances thereof may be silver, or the materials may contain a compound capable of forming or releasing a mobile dye in the reduction of light-sensitive silver halide to silver under high temperature conditions, in accordance with or reversely in accordance with said reaction, i.e., a dye-providing substance.

Examples of the dye-providing substances which may be used in the present invention are, first the aforesaid couplers. In addition, two equivalent couplers which have a non-diffusible group as a split-off group and which form a diffusible dye by reaction with oxidized developer are also preferably used. Examples of these couplers are described in detail in T. H. James, *The Theory of the Photographic Process,* pp. 291–334 and pp. 354–361; and Japanese patent application (OPI) Nos. 123533/83, 149046/83, 149047/83, 111148/84, 124399/84, 174835/84, 231539/84, 231540/84, 2950/85, 2951/85, 14242/85, 23474/85, and 66249/85.

Another example of the dye providing substance is a dye-silver compound in which an organic silver salt is connected to a dye. Specific examples of the dye-silver compounds are described in *Research Disclosure,* Vol. 169, RD No. 16966 (May, 1978), pp. 54 to 58, etc.

Still another example of the dye providing substance is an azo dye used in a heat developable silver dye bleaching process. Specific examples of the azo dyes and the method for bleaching are described in U.S. Pat. No. 4,235,957, *Research Disclosure,* Vol. 144, RD No. 14433 (April, 1976), pp. 30 to 32, etc.

A further example of the dye providing substance is a leuco dye as described in U.S. Pat. Nos. 3,985,565 and 4,022,617, etc.

A still further example of the dye providing substance is a compound having a function of imagewise releasing a diffusible dye.

This type of compound can be represented by formula (LI)

$$(\text{Dye-X})_n\text{Y} \qquad \text{(LI)}$$

wherein Dye represents a dye moiety, a dye moiety temporarily shifted to the short wavelength range or a dye precursor moiety; X represents a chemical bond or a connecting group; Y represents a group having a property such that diffusibilty of the compound represented by $(\text{Dye—X})_n\text{Y}$ can be differentiated in correspondence or counter-correspondence to light-sensitive silver salts having a latent image distributed imagewise or a group having a property of releasing Dye in correspndence or counter-correspondence to light-sensitive silver salts having a latent image distributed imagewise, diffusibility of Dye released being different from that of the compound represented by $(\text{Dye—X})_n\text{Y}$; and n represents 1 or 2 and when n is 2, the two Dye—X groups are the same or different.

Specific example of the dye providing substance represented by formula (LI) include, for example, dye developers in which a hydroquinone type developing agent (reducing agent) is connected to a dye component are described in U.S. Pat. Nos. 3,134,764, 3,362,819, 3,597,200, 3,544,545 and 3,482,972, etc. Further, substances capable of releasing diffusible dyes upon an intramolecular nucleophilic displacement reaction are described in Japanese patent application (OPI) No. 63618/76, etc., and substances capable of releasing diffusible dyes upon an intramolecular rearrangement reaction of an isooxazolone ring are described in Japanese patent application (OPI) No. 111628/74, etc.

In any of these processes, diffusible dyes are released in portions where development does not occur. In contrast, in portions where development occurs neither release nor diffusion of dyes take place.

There has been provided a process in which a dye releasing compound is preliminarily converted to an oxidized form thereof which does not have a dye releasing abilility, the oxidized form of the compound is coexistent with a reducing agent or a precursor thereof, and after development the oxidized form is reduced with the remaining reducing agent which is not oxidized to release a diffusible dye. Specific examles of dye providing substances which can be used in such a process are described in Japanese patent application (OPI) Nos. 110827/78, 130927/79, 164342/81, and 35533/78, etc.

On the other hand, substances capable of releasing diffusible dyes in portions where development occurred are also know. For example, substances capable of releasing diffusible dyes in the releasing groups thereof with oxidation products of developing agents (reducing agents) are described in British Pat. No. 1,330,524, Japanese patent publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye releasing compounds which have reducing property themselves and thus do not need the use of developing agents have been proposed. (As a matter of course, the above-described reducing agents may be auxiliary used.) Such dye providing compounds are described, e.g., in U.S. Pat. Nos. 3,928,312, 4,053,312, 4,055,428, 4,336,322, 3,725,062, 3,728,113, 3,443,939, and 4,500,626 and Japanese patent application (OPI) Nos. 65839/84, 69839/84, 3819/78, 104343/76, 116537/83, and 179840/82, and *Research Disclosure,* Vol. 174, RD No. 17465 (Oct., 1978).

Specific examples of dye providing substances which can be used in the present invention are the compounds as described in aforesaid U.S. Pat. No. 4,500,626 (from the 22nd column to the 44th column), and in particular, Compounds (1)–(3), (10)–(13), (16)–(19), (28)–(30), (33)–(35), (38)–(40) and (42)–(64) among the compounds of the said U.S. patent are expecially preferred.

The aforesaid dye providing substances and other hydrophobic additives such as image forming accelerators, which will be described hereafter, may be introduced into the layers of the photographic materials in a conventional manner, for example, by the method described in U.S. Pat. No. 2,322,027. For introduction, high boiling point organic solvents as described in Japanese patent application (OPI) Nos. 83154/84, 178451/84, 178452/84, 178453/84, 178454/84, 178455/84, and 178457/84 may be used, optionally together with a low boiling point organic solvent(s) having a boiling point of 50° C. to 160° C.

The amount of the high boiling point-organic solvent to be used is generally 10 g or less, preferably 5 g or less, to 1 g of the dye providing substance.

In addition, the dispersion method using polymers described in Japanese patent publication No. 39853/76 and Japanese patent application (OPI) No. 59943/76 may also be used.

In the case the compounds are substantially insoluble in water, fine particles of the compound may be dispersed in a binder and the resulting dispersion may be introduced into the layers.

For the dispersion of hydrophobic substances into hydrophilic colloids, various surfactants may be used, e.g., those as described in Japanese patent application (OPI) No. 157636/84 may be used.

In the present invention, heat developable photographic materials may contain an image forming accelerator. Image forming accelerators have various functions, for example, for the acceleration of the oxidation-reducing reaction of a silver salt oxidizing agent and a reducing agent, acceleration of the formation of dyes from a dye providing substances as well as for the decomposition of dyes or for the release of diffusible dyes and the acceleration of the transfer of dyes from light-sensitive material layers to dye fixing layers. These may be classified into the groups of bases or base precursors, nucleophilic compounds, high boiling point organic solvents (oils), thermal solvents, surfactants and compounds having a mutual action with silver or silver ion, in view of the physico-chemical functions thereof. These groups of substances have, in general, composite functions and thus have two or more of the aforesaid acceleration effects. Details on these substances are described in Japanese patent application (OPI) No. 93451/86. In addition to the use of the aforesaid image forming accelerators, other materials are known for the generation of bases, and such compounds are usable as a base precursor in the present invention. For instance, U.S. patent application. Ser. No. 890,442 (filed July 30, 1986) and European patent application No. 86 110568.2 (filed July 30, 1986) describe a method for the generation of bases by blending a sparingly soluble metal compound and a compound capable of reacting with the metal of the sparingly soluble etal compound for complex formation (which is called a complex forming compound); and Japanese patent application (OPI) No. 232451/86 describes a method for the generation of bases by electrolysis.

In particular, the former method is very effective. Examples of sparingly soluble metal compounds are zinc, aluminium, calcium and barium carbonates, hydroxides and oxides. The complex forming compounds are described in detail, e.g., in A. E. Martell and R. M. Smith, *Critical Stability Constants,* Vols. 4 and 5 published by Plenum Press. Specific examples of such compounds are salts of amino carboxylic acids, imidino acetic acids, pyridyl carboxylic acids, amino phosphoric acids, carboxylic acids (including mono-, di-, tri- and tetra-carboxylic acids as well as those having a substituent such as a phosphono, hydroxyl, oxo, ester, amido, alkoxy, mercapto, alkylthio, phosphino or salts like group), hydroxamic acids, polyacrylates and polyphosphoric acid salts with alkali metals; guanidines, amidines or quaternary ammonium salts.

These sparingly soluble metal compounds and the complex forming compounds are preferably added separately to the light-sensitive materials and the dye fixing materials, individually.

In the present invention, various kinds of development stopping agents may be used in order to obtain constant images at all times despite variations in processing temperature and processing time in heat development.

The development stopping agents herein are compounds capable of neutralizing a base or reacting with a base after the completion of development, to thereby lower the base concentration in the film, thereby stopping the development, or the compounds may mutually react with silver or a silver salt, after the complete development, to inhibit the development. For example, these agents include acid precursors capable of releasing an acid on heating, electrophilic compounds which react an existing base by a substitution reaction on heating, as well as nitrogen-containing heterocyclic compounds, mercapto compounds and precursors thereof. Examples of these compounds are described, e.g., in Japanese patent application (OPI) Nos. 108837/85, 192939/85, 230133/85, and 230134/85.

Further, the compounds which release a mercapto compound by heating are useful and include those described in U.S. patent application Ser. Nos. 774,427 (filed Sept. 10, 1985), 809,627 (filed Dec. 16, 1985), 799,996 (filed Nov. 20, 1985), 827,139 (filed Feb. 7, 1986), 829,032 (filed Feb. 13, 1986), 828,481 (filed Feb. 12, 1986), and 830,031 (filed Feb. 18, 1986), Japanese patent application (OPI) No. 53632/86, etc.

In the present invention, the heat-developable photographic materials can contain compounds which activate the development and stabilizing of the formed images at the same time. Examples of preferred compounds are described in U.S. Pat. No. 4,500,626 (51st column to 52nd column).

In the present invention, various kinds of antifogging agents can be employed. Examples of useful antifogging agents include an azole, a carboxylic acid and a phosphoric acid each containing a nitrogen atom as described in Japanese patent application (OPI) No. 168442/84, a mercapto compound and a metal salt thereof as described in Japanese patent application (OPI) No. 111636/84, etc.

The heat developable photographic materials of the present invention may optionally contain an image toning agent. Examples of usable toning agents are described in U.S. patent application Ser. No. 809,627, filed Dec. 16, 1985.

The supports used for the heat developable photographic materials of the present invention and for the dye fixing materials which are, as the case may be, optionally used in the present invention, are those which are resistant to processing temperatures. In general, conventional supports such as glass, paper, polymer films, metals and analogues thereof may be used, and in addition, those as described in U.S. patent application Ser. No. 809,627, filed Dec. 16, 1985 may also be used.

The heat developable photographic materials of the present invention may contain various additives which are known to be usable in conventional heat developable photographic materials, and in addition, may contain other layers than the light-sensitive layers, such as antistatic layers, electrically conductive layers, protective layers, intermediate layers, antihalation layers, stripping layers and mat layers. Many useful additives are described in *Research Disclosure,* Vol. 170, RD No.

17029 (June 1978), pp. 9–15 and Japanese patent application (OPI) No. 88256/86, which include, for example, plasticizers, sharpness improving dyes, antihalation dyes, sensitizing dyes, matting agents, surfactants, fluorescent whitening agents, ultraviolet light absorbents, slide inhibitors, antioxidants and color fade-preventing agents.

In particular, protective layers generally contain an organic or inorganic matting agent for the pourpose of blocking prevention. In addition, the protective layers may optionally contain a mordant and a UV light absorbent. The present photographic materials may have two or more protective layers and two or more intermediate layers.

The intermediate layers may contain a reducing agent for the prevention of color fading or color mixing, a UV light absorbent or a white pigment such as $TiO_2$. The white pigment may be added not only to the intermediate layers, but also to the emulsion layers, for the purpose of intensifying sensitivity.

The photographic elements of the present invention comprise a light-sensitive element capable of releasing or forming a dye(s) on heat development and a dye fixing element for fixing the dyes formed.

Both a light-sensitive element and a dye fixing element are indispensable in a system for the formation of images by diffusion transfer. Such may be classified into two typical systems. In one system, the light-sensitive element and the dye fixing elements are separately provided on two different supports; in the other system, the two elements are provided on the same support.

The relationship between the light-sensitive element and the dye fixing element, between these elements and the support(s) and between these elements and a white reflective layer are described in U.S. patent application Ser. No. 809,627, filed Dec. 16, 1985 (pp. 58–59) and U.S. Pat. No. 4,500,626 (57th column), which may be applied to the present invention.

One representative example of the embodiment in which the light-sensitive element and the dye fixing element are provided on the same support is a type in which the light-sensitive element is not necessary to peel apart from the image receiving element after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer, or transparent support/dye fixing layer/white reflective layer/light-sensitive layer, etc.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese patent application (OPI) No. 67840/81, Canadian Pat. No. 674,082, U.S. Pat. No. 3,730,718, etc.

The light-sensitive element or the dye fixing element may form a structure having an electrically conductive heat generating layer suitable for use as heating means for the purpose of heat development or diffusion transfer of dyes.

In this case, the transparent or opaque heating element (layer) may be formed in a conventional manner for the formation of conventional heating elements.

For the formation of a heating element, two methods are generally used. In one method, a thin film of a semiconductive inorganic material is used, and in the other method an organic thin film made of a dispersion of electrically conductive fine particles dispersed in a binder is used. Materials usable in these methods are described in Japanese patent application (OPI) No. 29835/86.

The dye fixing element used in the present invention contains at least one layer containing a mordant, and in the case the dye fixing layer is positioned on the surface of the photographic material, a protective layer may optionally be coated thereon.

The layer construction of the dye fixing element, the binder, the additives and the position of the mordant agent containing layer are described in U.S. patent application Ser. No. 809,627, filed Dec. 16, 1985 and in the patent publications referred to therein, which may be applied to the present invention.

The dye fixing element used in the present invention may optionally have, in addition to the aforesaid layers, a stripping layer, a matting agent layer, a curl preventive layer or like auxiliary layers.

One or more of the above mentioned layers may contain, if necessary, bases and/or base precursors for the acceleration of dye transfer, hydrophilic thermal solvents, color fade-preventing agents for inhibition of the discoloration of the dyes, UV light absorbents, sliding agents, matting agents, antioxidants, vinyl compound dispersions for increased dimensional stability and fluorescent whitening agents. Examples of these additives are described in Japanese patent application (OPI) No. 88256/86.

The binders in the aforesaid layers are preferably hydrophilic, and transparent or semi-transparent hydrophilic colloids are typical. For example, the binders as mentioned in the aforesaid photographic materials may be used.

The image receiving layers of the present invention are dye fixing layers to be used in the heat developable color photographic materials, and the mordants used in the layers may freely be selected from conventional mordants. In particular, polymer mordants are especially preferred. The polymer mordants include tertiary amino group-containing polymers, nitrogen-containing heterocyclic polymers and quaternary cationic group-containing polymers.

Examples of these polymers are described in U.S. patent application Ser. No. 809,627, filed Dec. 16, 1985 and U.S. Pat. No. 4,500,626 (57th column to 60th column).

The method of providing heat developable light-sensitive layers, protective layers, intermediate layers, subbing layers, backing layers and other layers is described in U.S. Pat. No. 4,500,626 (55th column to 56th column), which may be applied to the present invention.

As the light source for image exposure to record the images on the heat developable photographic materials may use radiation including visible rays, and for example, various light sources as described, e.g., U.S. patent application Ser. No. 809,627, filed Dec. 16, 1985 and U.S. Pat. No. 4,500,626 (56th column) may be used.

The heating temperature for development in heat development is generally about 50° C. to about 250° C., and is preferably about 80° C. to about 180° C. The heating temperature for transfer in the transfer step is generally within a range from a temperature in the heat development to room temperature, and is especially preferably within the range from 50° C. or more to the lower temperature than in the heat development step by about 10° C. For the heating means in the development step and/or the transfer step, there may be used a hot plate, iron, a hot roller or any other heating elements with carbon or titanium white.

The development and transfer may be effectively carried out simultaneously or continuously by heating the material in the presence of a small amount of a solvent, such as water, as described in detail in Japanese patent application (OPI) No. 218443/84. In such method, the aforesaid image forming accelerator may earlier be incorporated in either the dye fixing material or the light-sensitive material, or in both, or it may be externally added to the photographic processing system.

In a system where development and transfer are carried out simultaneously or continuously, the heating temperature is preferably from 50° C. or more to the boiling point of the solvent. For instance, when water is used as the solvent, the heating temperature is desirably from 50° C. or higher to 100° C. or lower.

Solvents may be used for the transfer of the mobile dye to the dye fixing layer.

Examples of solvents used for the acceleration of development and/or transfer of the mobile dye to the dye fixing layer are water and a basic aqueous solution containing an inorganic alkali metal salt or an organic base. (The bases as referred to in the item of the image forming accelerators hereinbefore may be used.) Further, low boiling point solvents as well as mixtures thereof comprising a low boiling point solvent and water or a basic aqueous solution may also be used. Surfactants, antifogging agents and sparingly soluble metal salt complex forming compounds may be incorporated in the solvent(s).

The solvent(s) may be added to either the dye fixing material or the light-sensitive material or to both. The amount added may be small, i.e., to such a degree that the weight of the solvent used is the same as or less than that which corresponds to the maximum swollen volume of the total coated film, especially the same as the weight or less a left by subtracting the weight of the total coated films from the weight of the solvent which corresponds to the maximum swollen volume of the total coated films.

The solvent (for example, water) may accelerate the formation of the images and/or the transfer of the dyes, when applied between the light-sensitive layer of the heat developable photographic material and the dye fixing layer of the dye fixing material, and the solvent may earlier be incorporated into either the light-sensitive layer or the dye fixing layer or into both.

The incorporation of the solvent into the light-sensitive layer and/or the dye fixing layer is described, e.g., U.S. patent application Ser. No. 809,627, filed Dec. 16, 1985.

For the acceleration of dye transfer, hydrophilic thermal solvents which are solid at room temperature but which dissolve at a higher temperature may be incorporated into the light-sensitive materials or the dye fixing materials. The hydrophilic thermal solvents may be incorporated into either the light-sensitive material or the dye fixing material or into both. For incorporation, the solvents may be added to any of the emulsion layer(s), intermediate layer(s), protective layer(s) and dye fixing layer(s), and, in particular, these are especially preferably added to the dye fixing layers and/or an adjacent layer(s).

Examples of thermal solvents are ureas, pyridines, amides, sulfonamides, imides, alcohols, oximes and other heterocyclic compounds.

Exemplary heating means which can be used in the transfer step are described in U.S. patent application Ser. No. 809,627, filed Dec. 16, 1985. For heating, a graphite, carbon black, metal or the like electrically conductive material layer may be coated on the dye fixing material, whereby the electrically conductive layer may directly be heated by imparting an electric current thereinto.

The heat developable light-sensitive material and the dye fixing material are typically laminated under pressure, and typical pressure conditions and the means for the pressure application are described in U.S. patent application Ser. No. 809,627, filed Dec. 16, 1985.

The compounds of the present invention may be used in silver halide photographic materials for color diffusion transfer, which are developed with a developer near room temperature. Such color diffusion transfer is described, e.g., in Belgian Pat. No. 757,959. As the dye providing substances for color diffusion transfer there may be used compounds of formula (I) of the present invention where PUG is a diffusible dye, and in addition, compounds of the following formula (V) may also be used.

$$\text{Dye—Y} \qquad \text{(V)}$$

in which Dye represents a dye moiety (or precursor thereof); and Y represents a substrate having a function of varying the diffusibility of the dye providing substance (V) as a result of development.

The wording "to vary the diffusibility" as used herein means that: (1) the dye providing substance (V) is initially non-diffusible and this is changed into a diffusible form or a diffusible dye is released thereform; or (2) the dye providing substance (V) is initially diffusible and is changed into a non-diffusible form. The change depends upon the property of Y itself, resulting from the oxidation of Y in one case or from the reduction of the Y in the other case.

In the former case where "the diffusibility varies because of the oxidation of Y", examples of Y are dye releasing redox substrates, which are p-sulfonamidonaphthols (including p-sulfonamidophenols, as described in Japanese Patent Application (OPI) Nos. 33826/73 and 50736/78; European Pat. No. 76,492), o-sulfonamidophenols (including o-sulfonamidonaphthols, as described in Japanese patent application (OPI) Nos. 113624/76, 12642/81, 161830/81, 16131/81, 4043/82, and 650/82, U.S. Pat. No. 4,053,312, and European Pat. No. 76,492), hydroxysulfonamido-heterocyclic compounds (as described in Japanese patent application (OPI) No. 104343/76, European Pat. No. 76,492), 3-sulfonamidoindoles (as described in Japanese patent application (OPI) Nos. 104343/76, 46730/78, 130122/79, and 85055/82, and European Pat. No. 76,492), α-sulfonamidoketones (as described in Japanese patent application (OPI) Nos. 3819/78 and 48534/79 and European Pat. No. 76,492).

Another embodiment is a system where the dye is released by an intranuclephilic attack of the compound after oxidation of Y. Intramolecular assistant type substrates as described in Japanese patent application (OPI)

Nos. 20735/82 and 65839/84 are the examples of such Y groups.

Still another embodiment involves the use of such a substrate that releses the dye by an intramolecular cyclization reaction under basic conditions but does not substantially release any dye after Y has been oxidized. Examples of the substrates of this kind are described in Japanese patent application (OPI) No. 63618/76. Further substrates that release the dye because of a ring rearrangement of an isoxazolone ring in the presence of a nucleophilic reagent may be used, which is a modification of this embodiment. Examples of substrates of this modified case are described in Japanese patent application (OPI) Nos. 111628/74 and 4819/77.)

A further embodiment involves the use of substrates that release the dye moiety by dissociation of an acidic proton under basic conditions but do not substantially release any dye after Y has been oxidized. Examples are described in Japanese patnet application (OPI) Nos. 69033/78 and 130927/79.

In the latter case where "the diffusibility varies because of the reduction of Y", examples of Y are nitro compounds as described in Japanese patent application (OPI) No. 110827/78 and quinone compounds as described in Japanese patent application (OPI) No. 110827/78 and U.S. Pat. Nos. 4,356,249 and 4,358,525. These are reduced by a reducing agent, which is called an electron donor, remaining without having been consumed in development and, as a result, release the dye because of an intramolecular attack by the resulting nucleophilic group. Further, quinone type substrates capable of releasing the dye moiety because of dissociation of the acidic proton of the reduced form thereof are usable, which are a modification of the present embodiment. Examples of these substrates are described in Japanese Patent Application (OPI) Nos. 130927/79 and 164342/81.

In the case the aforesaid substrates which vary diffusibility because of reduction thereof are used, the pertinent reducing agent (=electron donor) which mediates between exposed silver halide and the dye providing substance is indispensably used, and the examples of such agents are described in the aforesaid publications. So called LDA compounds which per se contain an electron donor in the substrate Y may also be effectively used.

The aforesaid dye providing substances form a mobile dye in imagewise distribution in the photographic material by wet development, which corresponds to exposure of the material, and the dye image is transferred to the dye fixing material by diffusion transfer to obtain a visible image thereon.

Photographic elements for color diffusion transfer will now be explained in greater detail.

Photographic elements for color diffusion transfer are preferably in the form of a film unit comprising a combination of the light-sensitive material (light-sensitive element) and the dye fixing material (image receiving element).

In one typical embodiment of such a film unit, the image receiving element and the light-sensitive element are laminated on one transparent support, and the light-sensitive element need be peeled off from the image receiving element after the completion of the image transfer. More precisely, the image receiving element comprises at least one mordant layer; and the light-sensitive element preferably comprises the combination of a blue-sensitive emulsion layer, a green-sensitive emulsion layer and a red-sensitive emulsion layer, the combination of a green-sensitive emulsion layer, a red-sensitive emulsion layer and an infrared-sensitive emulsion layer or the combination of a blue-sensitive emulsion layer, a red-sensitive emulsion layer and an infrared-sensitive emulsion layer, and the corresponding yellow dye providing substance, magenta dye providing substance and cyan dye providing substance are incorporated into each of these emulsion layer. An "infrared-sensitive emulsion layer" means an emulsion layer having light sensitivity to light of 700 nm or more, especially 740 nm or more. A white reflective layer containing a solid pigment such as titanium oxide is normally provided between the mordant layer and the light-sensitive layer or the dye providing substance-containing layer, whereby the transferred image may be seen through the transparent support. A light shielding layer may be provided between the white reflective layer and the light-sensitive layer so that the development may be carried out in the light. If necessary, a peeling layer may be provided so that a part of all of the light-sensitive element may be peeled off the image receiving element. Examples of this embodiment are described, e.g., Japanese Patent Application (OPI) No. 67840/81 and Canadian Pat. No. 674,082.

In another non-peeling type embodiment, the light-sensitive element is coated on the transparent support, the white reflective layer is coated thereover and the image receiving layer is further superposed thereover. A system where the image receiving element, the white reflective layer, the peeling layer and the light-sensitive element are laminated on the same support and the light-sensitive element is peeled off the image receiving element is described in U.S. Pat. No. 3,730,718.

On the other hand, a system where the light-sensitive element and the image receiving element are separately provided on two different supports is typically classified into two types. One is a peeling type and the other is non-peeling type. These two types will now be explained in detail.

In one preferred embodiment of a peeling-type film unit, a light reflective layer is provided on the back surface of the support and at least one image receiving layer is provided on the front surface thereof. This embodiment is so planned that the light-sensitive element is provided on the support having a light shielding layer and that the light-sensitive layer coated surface is reversed to face to the image receiving layer coated surface after the exposure (or, for example, during development) while the light-sensitive layer coated surface and the mordant layer coated surface are not faced to each other before exposure. After the completion of the image transfer to the mordant layer, the light-sensitive element is immediately peeled off the image receiving layer.

In another preferred embodiment of a non-peeling type film unit, at least one mordant layer is provided on the transparent support and the light-sensitive element is provided on the transparent or light shielding layer coated support, whereupon the light-sensitive layer coated surface and the mordant layer coated surfaces are kept to face to each other.

A photographic element of the aforesaid color diffusion transfer type may optionally be combined with a container (or processing element) which contains an alkaline processing solution and which may be ruptured under pressure. In a non-peeling type film-unit comprising an image receiving element and a light-sensitive element laminated on one support, in particular, the processing element is preferably provided between the light-sensitive element and a cover sheet coated thereon. In another embodiment where the light-sensitive element and the image receiving element are separately provided on respective two supports, the processing element is preferaly provided between the light-sensitive element and the image receiving element at latest during development. The processing element preferaly contains a light shielding agent (such as carbon black or dye(s) whose color may vary because of variations in pH) and/or a white pigment (such as titanium white). In color diffusion transfer type film units, it is preferred that the cover sheet, the image receiving element or the light-sensitive element be combined with a neutralization timing system comprising the combination of a neutralizing layer and a neutralization timing layer.

The present invention will now be explained in greater detail by reference to the following examples, which, however, are not intended to be interpreted as limiting the scope of the present invention.

EXAMPLE 1

The following layers (I) and (II) were coated in that order on a polyethyene terephthalate support to obtain the test samples.

Layer (I):

(a) Gelatin dispersion comprising Compound 15 of the present invention (reducible dye providing substance) (0.27 mmole/m$^2$) and tricresyl phosphate (0.4 g/m$^2$), (b) Gelatin dispersion comprising reducing substance (S-13) (0.52 mmole/m$^2$) and tricresyl phosphate (0.2 g/m$^2$), (c) Guanidine trichloroacetate (0.22 g/m$^2$), and (d) The following compound (0.1 g/m$^2$):

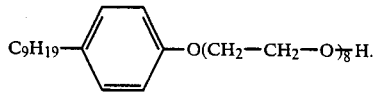

Layer (I) was a color material layer containing the above components (a) through (d), and the gelatin content therein (including the gelatin content in dispersions (a) and (b)) was 1.2 g/m$^2$.

Layer (II):

(a) This was a protective layer containing guanidine trichloroacetate (0.37 g/m$^2$) and gelatin (1 g/m$^2$).

This was test sample No. (1). Other test samples Nos. (2) through (8) were prepared, in the same manner as for test sample No. (1) but dye providing substance (Compound 15) therein was replaced by Compound 1, 2, 13, 10, 41, 35 or 12 (as listed hereinbefore).

The formation of the image receiving sheet with the dye fixing layer is now explained.

10 g of poly(methyl acrylate/co-N,N,N-trimethyl-N-vinylbenzylammonium chloride) (ratio of methyl acrylate to vinylbenzylammonium chloride=1:1, molar) was dissolved in 200 ml of water, and the resulting solution was uniformly blended with 100 g of a 10 wt% acid treated gelatin emulsion. The resulting mixture solution was uniformly coated on a polyethylene terephthlate laminated paper support to form a film having a wet film thickness of 20 μm. This was the image receiving sheet.

Each of the above test samples (1) through (8) was heated on a heat block (block heated to 140° C.) for a determined period of time, and then was intimately attached to the image receiving sheet, to which had been added 8 ml/m$^2$ of water, so that the coated surfaces of the two elements faced each other. The thus attached sheet was heated at 90° C. for 20 seconds for dye transfer, and then the image receiving sheet was peeled off. The reducible dye releasing compound was reduced by the electron donor in the first heating step, whereby the dye was released and an image of high transferred color density was obtained.

The following Table 1 shows the heating time (T50%) required for the release of half of the dye from the dye providing substance and the maximum color density (reflection).

TABLE 1

| Sample No. | Compound No. | T 50% (sec) | Maximum density (reflection) |
|---|---|---|---|
| 1 | 15 | 22 | 1.72 (yellow) |
| 2 | 1 | 11 | 1.73 (yellow) |
| 3 | 2 | 18 | 2.03 (magenta) |
| 4 | 13 | 11 | 2.02 (magenta) |
| 5 | 10 | 9 | 2.02 (magenta) |
| 6 | 41 | 12 | 2.00 (magenta) |
| 7 | 35 | 4 | 2.06 (magenta) |
| 8 | 12 | 11 | 2.62 (cyan) |

The above results prove that the dye providing compounds of the present invention release a dye within an extremely short period of time and that the releasing speed may easily be controlled because of the structures of the substituents in the compounds.

EXAMPLE 2

The following layers were coated in the recited order on a transparent polyethylene terephthalate support to obtain light-sensitive element sample (A).

Layer (I):

(a) Light-sensitive silver iodobromide gelatin emulsion (0.36 g Ag/m$^2$), (b) Benzotriazole silver gelatin emulsion (0.18 g Ag/m$^2$), (c) Gelatin dispersion comprising Compound 15 of the present invention (0.27 mmole/m$^2$) and tricresyl phosphate (1 g/m$^2$), (d) Gelatin dispersion comprising reducing substance (S-29) (0.27 mmole/m$^2$) and tricresyl phosphate (0.2 g/m$^2$), (e) Base precursor of the following structure (0.44 g/m$^2$):

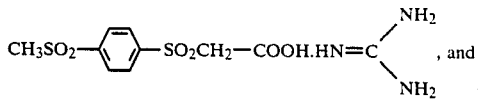

, and (f) Compound of the following structure (0.1 g/m$^2$):

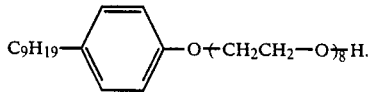

Layer (I) was a light-sensitive layer containing the above components (a) through (f), and the gelatin content therein (including the gelatin content in the above (a) through (d)) was 1.2 g/m$^2$.

Layer (II):

(a) This was a protective layer containing the above base precursor (e) (0.74 g/m$^2$) and gelatin (1 g/m$^2$).

In the same manner as above, with the exception that Compound 15 in layer (I) was replaced by one of Compounds 2, 13, 10, 41 or 35, other light-sensitive element samples (B) through (F) were prepared. These samples were exposed to light and then uniformly heated on a hot plate heated at 140° C. for 30 seconds. Next, the sample was intimately attached to the same image receiving sheet as in Example 1, to which had been added 8 ml/m$^2$ of water, and heated for 20 seconds at 90° C. After heating, the image receiving sheet was peeled off, whereby a positive color image was obtained.

The photographic characteristic of each sample as obtained by sensitometry is shown in the following Table 2.

TABLE 2

| | Compound No. | Maximum density (reflection) | Minimum density |
|---|---|---|---|
| A | 15 | 1.30 | 0.44 |
| B | 2 | 1.20 | 0.41 |
| C | 13 | 2.10 | 0.66 |
| D | 10 | 2.11 | 1.01 |
| E | 41 | 2.10 | 0.72 |
| F | 35 | 2.05 | 1.48 |

EXAMPLE 3

The following layers were coated in the recited order on a transparent polyethylene terephthalate support to obtain a light-sensitive element sample.

Red-sensitive layer: Light-sensitive layer comprising the following components (a) through (e):

(a) Red-sensitive silver iodobromide gelatin emulsion (0.36 g Ag/m$^2$), (b) Benzotriazole silver gelatin emulsion (0.18 g Ag/m$^2$), and (c) Gelatin dispersion comprising Compound 12 (0.27 mmole/m$^2$), precursor reducing substance (S-11) (0.4 mmole/m$^2$) and tricresyl phosphate (0.37 g/m$^2$) S-11:

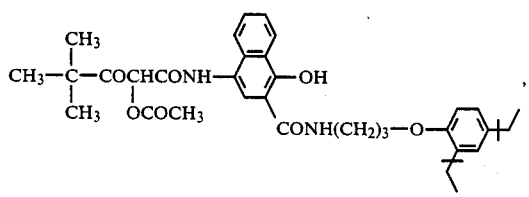

(d) 1-Phenyl-4-methyl-4-hydroxymethyl-3-pyrazolidone (ETA) (0.32 mmole/m$^2$), and (e) Gelatin (including the gelatin component in the above (a) through (c)) (1.24 g/m$^2$).

Imtermediate layer: Layer comprising 2,5-di(tert-pentadecyl)hydroquinone (=compound for preventing color mixing from the interlayer diffusion of ETA) (0.81 g/m$^2$), polyvinyl acetate (0.79 g/m$^2$) and gelation (0.38 g/m$^2$).

Green-sensitive layer: The same layer as the above red-sensitive layer with the exception that (a) is a green-sensitive gelatin emulsion and (c) is Compound 13.

Intermediate layer: The same layer as the above intermediate layer.

Blue-sensitive layer: The same layer as the above red-sensitive layer with the exception that (a) is a blue-sensitive emulsion and (c) is Compound 1.

Protective layer: Layer containing gelatin (0.4 g/m$^2$).

The sample was, after exposure adhered to the image receiving sheet of the Example 1, which had been dipped in a 1M $K_3PO_4$ solution, and heated at 95° C. for 20 seconds, and then the image receiving sheet was peeled off.

The phtographic characteristic of the sample as obtained by sensitomery is given in the following Table 3.

TABLE 3

| | Maximum density | Minimum density |
|---|---|---|
| B | 2.10 | 0.12 |
| G | 2.01 | 0.11 |
| R | 2.21 | 0.18 |

The results in the above Table 3 prove that the sample formed an excellent positive image of high quality, having a high maximum density and a low minimum density.

EXAMPLE 4

The following layers were coated, in the order recited, on a transparent polyethylene terephthalate support to obtain a light-sensitive element sample.

(I) Image receiving layer containing:

(a) copoly[styrene-n-vinylbenzyl-N,N,N-trihexylammonium](4.0 g/m$^2$) and (b) gelatin (4.0 g/m$^2$).

(II) White reflective layer containing:

(a) titanium dioxide (22 g/m$^2$) and (b) gelatin (2.2 g/m$^2$).

(III) Opaque layer containing:

(a) carbon black (2.7 g/m$^2$) and (b) gelatin (2.7 g/m$^2$).

(IV) Cyan dye providing layer containing:

(a) gelatin dispersion comprising cyan dye providing Compound 12 (0.33 mmole/m$^2$) and Compound (S-11) per Example 3 (0.4 mmole/m$^2$) and (b) gelatin (1.1 g/m$^2$, including the gelatin in the above (a)).

(V) Red-sensitive layer containing:

(a) red-sensitive silver iodobromide gelatin emulsion (0.5 Ag/m$^2$) and (b) gelatin (1.1 g/m$^2$, including the gelatin in the above (a)).

(VI) Intermediate layer containing:

(a) 2,5-di(t-pentadecyl)hydroquinone (0.82 g/m$^2$)

(b) vinyl acetate (0.8 g/m$^2$), and (c) gelatin (0.4 g/m$^2$).

(VII) Magneta dye providing layer containing:

(a) gelatin dispersion comprising magenta dye providing Compound 13 (0.3 mmole/m$^2$) and Compound (S-11) of Example 3 (0.4 mmole/m$^2$) and (b) gelatin (1.1 g/m$^2$, including the gelatin in the above (a)).

(VIII) Green-sensitive layer containing:

(a) green-sensitive silver iodobromide emulsion (0.5 g Ag/m$^2$) and (b) gelatin (1.1 g/m$^2$, including the gelatin in the above (a)).

(IX) The same intermediate layer as (VI).

(X) Yellow dye forming layer containing:

(a) gelatin dispersion comprising yellow dye providing Compound 1 (0.5 mmole/m$^2$) and Compound (S-11) of Example 3 (0.6 mmole/m$^2$) and
(b) gelatin (1.1 g/m$^2$, including the gelatin in the above (a)).

(XI) Blue-sensitive containing:
(a) blue-sensitive silver iodobromide emulsion (0.5 g/m$^2$) and
(b) gelatin (1.1 g/m$^2$, including the gelatin in the above (a)).

(XII) Protective layer containing:
(a) polymethyl methacrylate latex (average particle size: 4 μm) (0.9 g/m$^2$),
(b) the following UV light absorbents (A) and (B) (each 0.4 mmole/m$^2$),
(c) hardener bisvinylsulfonylmethyl ether (0.15 g/m$^2$), and
(d) gelatin (1.3 g/m2).

UV light absorbent (A):

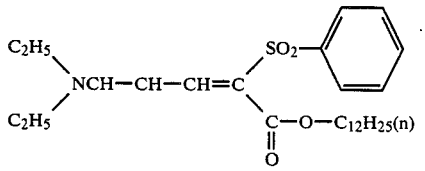

UV light absorbent (B):

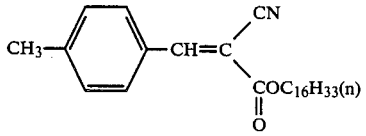

Next, the following layers were coated in the recited order on a transparent polyethylene terephthalate film to form a cover sheet.

(I) Acid-neutralizing layer containing:
(a) polyacrylic acid (17 g/m$^2$),
(b) N-hydroxysuccinimidobenzene sulfonate (0.06 g/m$^2$), and
(c) ethylene glycol (0.5 g/m$^2$).

(II) Timing layer of cellulose acetate (acetylation degree: 54%), as coated in a thickness of 2 μm.

(III) Timing layer of a copolymer latex comprising vinylidene chloride and acrylic acid, as coated in a thickness of 4 μm.

Next, a processing solution comprising the following composition was prepared.

| | |
|---|---|
| Potassium hydroxide | 48 g |
| 4-hydroxymethyl-4-methyl-1-p-tolyl-3-pyrazolidinone | 10 g |
| 5-methylbenzotriazole | 2.5 g |
| Sodium sulfite | 1.5 g |
| Potassium bromide | 1 g |
| Benzyl alcohol | 1.5 ml |
| Carboxymethyl cellulose | 6.1 g |
| Carbon black | 150 g |
| Water to make | 1 liter |

The above prepared light-sensitive element sample was exposed through a wedge and the cover sheet was attached thereto, whereupon the processing solution was uniformly spread therebetween in a thickness of 80 μm using a pair of parallel rollers.

After development for one hour, the sample was subjected to sensitometry, and the results are given in the following Table 4. The results prove that the sample formed excellent color images of high quality having a high transferred dye density with less color stain in white background areas.

TABLE 4

| | B | G | R |
|---|---|---|---|
| Maximum density | 1.61 | 1.90 | 2.20 |
| Minimum density | 0.22 | 0.23 | 0.36 |

EXAMPLE 5

The following layers (1) through (11) were coated in that order on a black support to obtain a light-sensitive element sample.

(1) Layer containing the following cyan DRR compound (0.36 mmole/m$^2$), tricyclohexyl phosphate (0.09 g/m$^2$), 2,5-di(t-pentadecyl(hydroquinone (0.1 g/m$^2$) and gelatin (0.44 g/m$^2$).

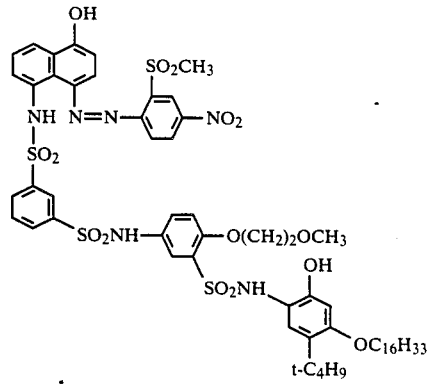

(2) Layer containing a red-sensitive internal latent image type direct reversal silver bromide gelatin emulsion (0.5 g Ag/m$^2$), gelatin (0.78 g/m$^2$), the following nucleating agent (27 g/m$^2$) and sodium pentadecylhydroquinone sulfonate (0.06 g/m$^2$).

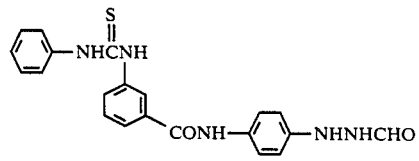

(3) Layer containing 2,5-di)tert-pentadecyl)hydroquinone (0.71 g/m$^2$), a copolymer of vinylpyrrolidone and vinyl acetate (molar ratio: 7/3) (0.24 g/m$^2$) and gelatin (0.4 g/m$^2$).

(4) Layer containing gelatin (0.3 g/m$^2$).

(5) Layer containing the following magneta DRR compound (0.49 g/m$^2$), tricyclohexyl phosphate (0.08 g/m$^2$), 2,5-di(tert-pentadecyl)hydroquinone (0.01 g.m$^2$) and gelatin (0.5 g/m$^2$).

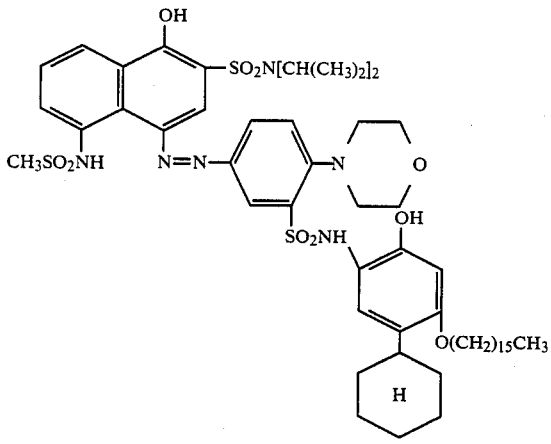

(6) Layer containing a green-sensitive internal latent image type direct reversal silver bromide gelatin emulsion (0.34 g Ag/m$^2$), gelatin (0.66 g/m$^2$), the same nucleating agent as layer (2) (12.9 g/m$^2$) and sodium pentadecylhydroquinone sulfonate (0.04 g/m$^2$).

(7) Layer containing 2,5-di(tert-pentadecyl)hydroquinone (0.71 g/m$^2$), a copolymer of vinylpyrrolidone and vinyl actate (molar ratio: 7/3) (0.24 g/m$^2$) and gelatin (0.4 g/m$^2$).

(8) Layer containing gelatin (0.25 g/m$^2$).

(9) Layer containing the following yellow DRR compound (0.48 g/m$^2$), tricyclohexyl phosphate (0.03 g/m$^2$), 2,5-di(tert-pentadecyl)hydroquinone (0.004 g/m$^2$) and gelatin (0.43 g/m$^2$).

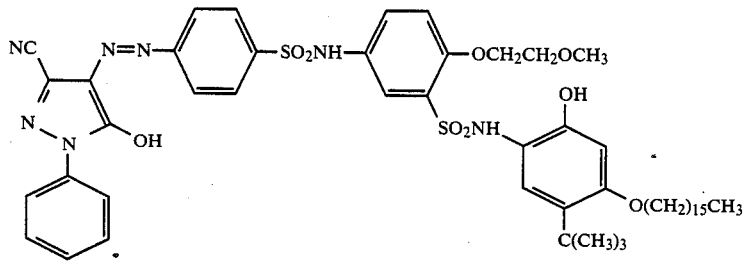

(10) Layer containing a blue-sensitive internal latent image type direct reversal silver bromide emulsion (0.84 μg Ag/m$^2$), gelatin (0.9 g/m$^2$), the same nucleating agent as the layer (5) (29 g/m$^2$) and sodium pentadecylhydroquinone-sulfonate (0.05 g/m$^2$).

(11) Layer containing gelatin (1.0 g/m$^2$).

This light-sensitive element was called light-sensitive element sample (1).

A dispersion comprising the following components (a), (b) and (c) was incorporated into each of the red-sensitive emulsion layer, the green-sensitive emulsion layer and the blue-sensitive emulsion layer in sample (1) to obtain a light-sensitive element sample (2).

(a) The antifoggant releasing compound 11 of this invention (0.1 mmole/m$^2$);

(b) Precursor reducing substance (S-45) (0.1 mmole/m$^2$); and (c) Trihexyl phosphate (0.01 g/m$^2$)

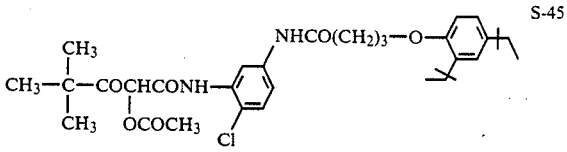

On the other hand, the following layers (1) through (5) were coated in that order on the front surface of a white support, which had a carbon black layer and a titanium white layer in that order on the back surface thereof, to obtain a dye receiving sheet.

(1) Layer containing a copolymer of acrylic acid and butyl acrylate (weight ratio: 80/20) (22 g/m$^2$) and 1,4-bis(2,3-epoxypropoxy)butane (0.44 g/m$^2$).

(2) Layer containing acetyl cellulose (modified by hydrolysis of 100 g acetyl cellulose to form 39.4 g of acetyl groups) (3.8 g/m$^2$), a copolymer of styrene and maleic anhydride (weight ratio: 60/40; molecular weight: about 50,000) (0.2 g/m$^2$) and 5-(β-cyanoethylthio)-1-phenyltetrazole (0.115 g/m$^2$).

(3) Layer containing a copolymer latex of vinylidene chloride, methyl acrylate and acrylic acid (weight ratio: 85/1123) (2.5 g/m$^2$) and a polymethyl methacrylate latex (particle size: 1 to 3 μm) (0.05 g/m$^2$).

(4) Mordant layer containing the following mordant (3.0 g/m$^2$) and gelatin (3.0 g/m$^2$).

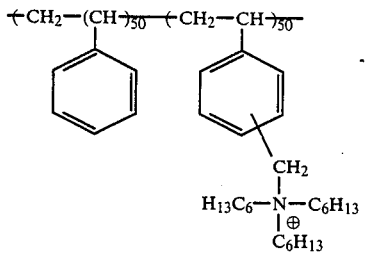

(5) Layer containing phthalated gelatin (1 g/m$^2$).

Next, 0.8 g of the processing solution having the following composition was filled in a rupturable container.

| Composition of Processing Solution: | |
|---|---|
| Benzyl alcohol | 0.20 ml |
| 1-Phenyl-4-hydroxymethyl-4-methyl-3-pyrazolidinone | 0.3 g |
| Methylhydroquinone | 0.012 g |
| 5-Methylbenzotriazole | 0.6 g |
| Sodium sulfite | 0.18 g |
| Hydroxymethyl cellulose | 4 g |
| Potassium hydroxide (28% aqueous solution) | 22.4 ml |

-continued

| Composition of Processing Solution: | |
|---|---|
| $H_2O$ | 67 ml |

Element samples (1) and (2) were exposed through a wedge, and then the above processing solution was spread between the light-sensitive element sample and the dye receiving sheet in a thickness of 60 μm. After development for 2 minutes at 25° C., the dye receiving sheet was peeled off to obtain a transferred color image thereon.

The results of sensitomery on each sample are shown in the following Table 5. The results prove that light-sensitive element sample (2) containing the antifoggant releasing compound of the present invention formed a more excellent image with less fog in white background areas as compared with comparative light-sensitive element sample (1).

TABLE 5

| | Maximum density | | | Minimum density | | |
|---|---|---|---|---|---|---|
| | B | G | R | B | G | R |
| Comparative sample (1) | 1.93 | 2.23 | 2.80 | 0.14 | 0.13 | 0.19 |
| Present sample (2) | 1.88 | 2.21 | 2.77 | 0.11 | 0.10 | 0.15 |

EXAMPLE 6

An aqueous nitrate solution and an aqueous potassium iodide and potassium bromide solution were simultaneously added to an aqueous gelatin solution which was kept at 50° C., in the presence of $4\times10^{-7}$ mole (per mold of Ag) of potassium iridium(III) chloride and ammonia, over the course of 60 minutes, while the pAg value in the reaction system was being kept at 7.8, to obtain a cubic monodispersed emulsion having an average grain size of 0.25 μm and an average silver iodide content of 1 mole %. To this silver iodobromide emulsion were added $5.6\times10^{-5}$ mole/mole-Ag of sodium anhydro-5,5-dichloro-9-ethyl-3,3'-bis(3-sulfopropyl)oxacarbocyaninehydroxide (sensitizer dye) and $4\times10^{-3}$ mole/mole-Ag of 1-formy-2,4-[2-(2,4-di-t-pentylphenoxy)butylamido]phenyl hydrazide (hydrazine compound), and, further, a compound as shown in the Table 1 was added thereto. Next, a polyethyl acrylate dispersion, polyethylene glycol, 1,3-vinylsulfonyl-2-propanol, 1-phenyl-5-mercaptotetrazole, 1,4-bis[3-(4-acetylaminopyridinio)propionyloxy]tetramethylenedibromide, Compound I-3 and ascorbic acid were added thereto, in an amount as shown in Table 6. The resulting solution was coated on a polyethylene terephthalate film in an amount of 3.4 g Ag/m². Further, a gelatin layer was superposed on the emulsion layer, the coated gelatin amount being 1.0 g/m².

The samples were exposed through an optical wedge and through "Gray Negative Contact Screen 150L (No. 2)" (by Dainippon Screen Co., Ltd.) and an optical wedge and then developed with the following developer by the use of an automatic developing machine FG-660F (Fuji Photo Film Co., Ltd.) for a development time of 20 seconds at 38° C. The developer is later given. The quality of the developed sample was evaluated. The results are given in Table 6.

In Table 6, the sensitivity is represented by the reciprocal of the exposure needed to give a density of 1.5 when the same was exposed with only the optical wedge and developed, which shows a relative value with respect to the index value of the sensitivity of 100 of sample (1).

For measurement of dot gradation, the samples were exposed with the contact screen and the optical wedge and then developed. Dot gradation is represented by the value of Δ log E for a dot formation of from 5% to 95% (measured by "Dottie II" by Process-Shizai Co., Ltd.). Soft contrast is preferred because of an enlarged degree tone reproductivity.

For evaluation of dot quality, the samples were visually observed "5" is the best, and "1" is the worst. "5" and "4" mean practical commercial samples, "3" means samples of practical limit, as being coarse; and "2" and "1" are not useful samples. The intermediate between "2" and "3" is represented by "2.5".

TABLE 6

| No. | Compound | Added amount | Sensitivity | Dot gradation | Dot quality | Note |
|---|---|---|---|---|---|---|
| 1 | — | — | 50 | 1.35 | 1 | |
| 2 | Comparative compound | $0.3\times10^{-2}$ | 60 | 1.29 | 3 | |
| 3 | " | $10^{-2}$ | 83 | 1.27 | 4.5 | Comparative samples |
| 4 | " | $3\times10^{-2}$ | 100 | 1.27 | 5 | |
| 5 | Compound 65 | $0.45\times10^{-2}$ | 60 | 1.32 | 3 | |
| 6 | " | $1.5\times10^{-2}$ | 81 | 1.36 | 4.5 | |
| 7 | " | $3\times10^{-2}$ | 93 | 1.42 | 5 | Present samples |
| 8 | " | $4.5\times10^{-2}$ | 103 | 1.44 | 5 | |

Table 6 proves that the present samples formed better images of higher sensitivity, dot gradation and dot quality than the comparative samples.

Compound 65:

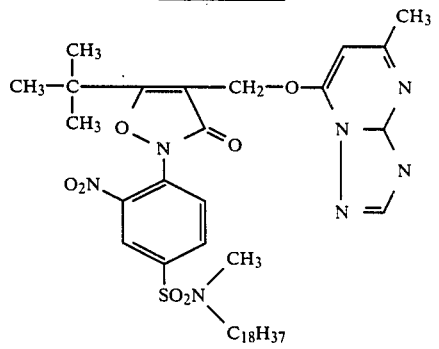

Comparative compound:

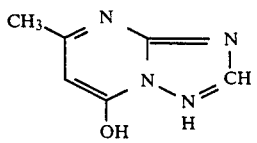

Developer

| | |
|---|---|
| Hydroquinone | 45.0 g |
| N—Methyl-p-aminophenol (½ sulfate) | 0.8 g |
| Sodium hydroxide | 18.0 g |

-continued

| | |
|---|---|
| Potassium hydroxide | 55.0 g |
| 5-Sulfosalicyclic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1 liter |
| | (pH = 11.6) |

EXAMPLE 7

The following layers were coated in the recited order on a polyethylene terephthalate support to obtain a light-sensitive element sample.

Layer (I):

(a) Light-sensitive silver iodobromide emulsion (0.36 g Ag/m$^2$), (b) Gelatin dispersion containing Compound 10 (reducible dye providing substance) (0.28 mmole/m$^2$), reducing substance (S-3) (as given hereinbefore) (0.4 mmole/m$^2$) and tricyclohexyl phosphate (0.1 g/m$^2$), and (c) Light-sensitive layer containing 1-phenyl-4-methyl-4-hydroxymethyl-3-pyrazolidone (electron transfer agent) (0.1 mmole/m$^2$), the total gelation content (including the gelatin in the above (a) through (c)) being 2 g/m$^2$.

Layer (II):

(a) Silica dispersion and (b) Protective layer containing bis-vinylsulfonylmethyl ether hardener (50 mg/m$^2$), the total gelation content being 1 g/m$^2$.

Thus prepared light-sensitive element sample was called sample (A). In comparison, light-sensitive element sample (B) was prepared in the same manner as sample (A) with the exception that Compound 10 in sample (A) was replaced by Comparative Compound (1) having the following structure. Comparative Compound (1) is given in Japanese Patent Application (OPI) No. 110827/78. Further, light-sensitive element sample (C) was prepared in the same manner as sample (A) with the exception that Compound 10 in sample (A) was replaced by Comparative Compound (2) having the following structure. Comparative Compound (2) is given in Japanese Patent Application (OPI) No. 130927/81.

Samples (A) through (C) were exposed and then dipped into a buffer solution having a pH of 8–13 for 10 seconds. The solution remaining on the surface of the samples were removed, and each sample was attached to the image receiving sheet of Example 1 and heated at 95° C. for 20 seconds. The image receiving sheet was peeled off, and it was observed a positive image was formed thereon. The reflection density (Dmax) in the low exposed areas is shown in the Table 7.

TABLE 7

| Sample | Dye providing substance | | pH of dipping solution 9 | 10 | 11 | 12 | 13 |
|---|---|---|---|---|---|---|---|
| A | Present | $D_{max}$ | 0.62 | 1.81 | 2.01 | 2.10 | 2.20 |
| | Compound 10 | $D_{min}$ | 0.13 | 0.14 | 0.16 | 0.16 | 0.17 |
| B | Comparative | $D_{max}$ | 0.22 | 0.61 | 0.93 | 1.51 | 2.12 |
| | Compound (1) | $D_{min}$ | 0.13 | 0.14 | 0.17 | 0.21 | 0.25 |
| C | Comparative | $D_{max}$ | 0.15 | 0.42 | 0.85 | 1.33 | 2.05 |
| | Compound (2) | $D_{min}$ | 0.13 | 0.17 | 0.21 | 0.23 | 0.24 |

Comparative Compound (1)

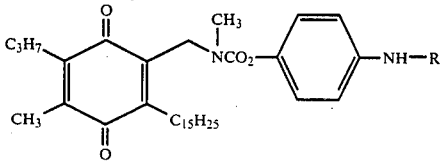

Comparative Compound (2)

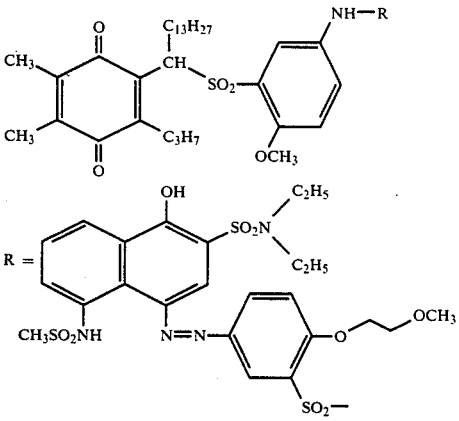

The results in the above Table 7 prove that Comparative Compounds (1) and (2) gave images of extremely low transferred dye density in low pH processing, although they gave images of sufficient transferred dye density in high pH processing. On the contrary, it is apparent from Table 7 that the compound of the present invention gave images of sufficient dye density both in high pH processing and low pH processing. This is an extremely favorable characteristic feature of the present invention.

EXAMPLE 8

A multilayered color light-sensitive material was prepared as shown in the table below.

| | |
|---|---|
| 6th layer | Gelatin (coated amount: 800 mg/m$^2$) |
| | Hardener*1 (coated amount: 100 mg/m$^2$) |
| | Silica*2 (coated amount: 100 mg/m$^2$) |
| | $Zn(OH)_2$ (coated amount: 300 mg/m$^2$) |
| 5th layer | (Blue-sensitive layer) |
| | Silver iodobromide (iodide: 5 mole %, coated amount: 400 mgAg/m$^2$) |
| | Organic silver salt*3 (coated amount: 100 mgAg/m$^2$) |
| | Yellow dye providing substance (1) (coated anount: 400 mg/m$^2$) |
| | High boiling point solvent*4 (coated amount: 200 mg/m$^2$) |
| | Gelatin (coated amount: 1000 mg/m$^2$) |
| | Reducing substance (coated amount: 277 mg/m$^2$) |
| | Surface active agent*5 (coated amount: 100 mg/m$^2$) |
| 4th layer | (Intermediate layer) |
| | Gelatin (coated amount: 800 mg/m$^2$) |
| | $Zn(OH)_2$ (coated amount: 300 mg/m$^2$) |
| 3rd layer | (Green-sensitive layer) |

-continued

| | |
|---|---|
| | Silver chlorobromide*6 (bromide: 80 mole %, coated amount: 400 mgAg/m$^2$) |
| | Organic silver salt*3 (coated amount: 100 mgAg/m$^2$) |
| | Magenta dye providing substance (2) (coated amount: 400 mg/m$^2$) |
| | High boiling point solvent*4 (coated amount: 200 mg/m$^2$) |
| | Gelatin (coated amount: 1000 mg/m$^2$) |
| | Reducing substance (coated amount: 277 mg/m$^2$) |
| | Surface active agent*5 (coated amount: 100 mg/m$^2$) |
| 2nd layer | (intermediate layer) |
| | Gelatin (coated amount: 800 mg/m$^2$) |
| | $Zn(OH)_2$ (coated amount: 300 mg/m$^2$) |
| 1st layer | (Red-sensitive layer) |
| | Silver chlorobromide*7 (bromide: 80 mole %, coated amount: 400 mgAg/m$^2$) |
| | Organic silver salt*3 (coated amount: 100 mgAg/m$^2$) |
| | Cyan dye providing substance (7) (coated amount: 300 mg/m$^2$) |
| | High boiling point solvent*4 (coated amount: 200 mg/m) |
| | Gelatin (coated amount: 1000 mg/m$^2$) |
| | Reducing substance (coated amount: 277 mg/m$^2$) |
| | Surface active agent*5 (coated amount: 100 mg/m$^2$) |
| Support | (Polyethylene terephthalate film) |

*1 1,2-bis(vinylsulfonylacetamido)ethane
*2 size: 4 μm
*3 prepared as follows. 20 g of gelatin and 5.9 g of 4-acetylaminophenyl propionic acid were dissolved in a solution containing 1000 ml of a sodium hydroxide aqueous solution and 200 mg of ethanol. To the solution, an aqueous solution of silver nitrate obtained by dissolving 4.5 g of silver nitrate in 200 ml of water was added in 5 minutes. After washing and desalting, the pH was adjusted to 6.3. The yield of the emulsion was 300 g.
*4 Tricyclohexylphthalate

*5 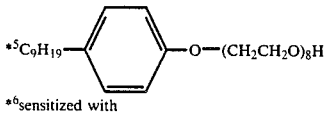

*6 sensitized with

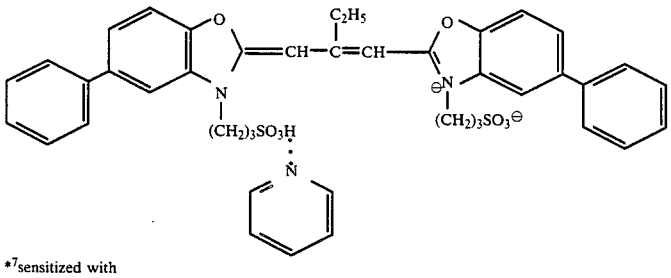

*7 sensitized with

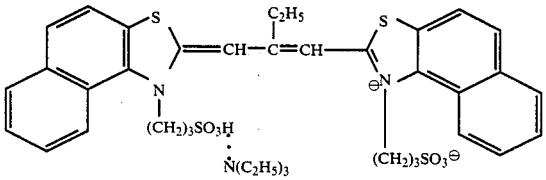

The preparation of a dye fixing element is described hereinafter.

63 g of gelatin, 80 g of guanidine picolinate and 130 g of mordant of the structural formula shown below were dissolved in 1,300 ml of water. The solution thus obtained was then applied to a paper support laminated with polyethylene in an amount such that the thickness of wet film reached 42 μm. The wet film thus formed was then dried.

Mordant

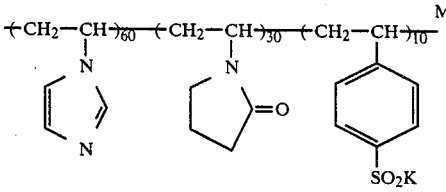

A solution obtained by adding 1.05 g of 1,2-bis(vinylsulfonylacetamido)ethane to an aqueous solution obtained by dissolving 35 g of gelatin in 800 ml of water was applied to the film thus formed in an amount such that the thickness of wet film reached 17 μm, and then dried to prepare a dye fixing element D-1.

The multilayered color light-sensitive element obtained above was exposed to light of 500 lux from a tungsten lamp through a separation filter for 1 second.

Water was fed to the emulsion surface of the light-sensitive element thus exposed by means of a wire bar in an amount of 15 ml/m$^2$. Thereafter, the dye fixing element D-1 was superimposed on the light-sensitive element in such a manner that the film surfaces thereof were brought into contact with each other. The laminate was heated for 25 seconds by means of a heat roller which had been controlled so as to maintain the temperature of the film thus moistened at 90° C. The dye fixing element was then peeled off the light-sensitive element. As a result, there were obtained on the dye fixing element sharp images of yellow (Y), magenta (M), and cyan (C) corresponding to the separation filter (B, G and R). These images were measured for maximum color density (Dmax) and minimum color density (Dmin) by a Macbeth reflection densitometer (RD-519). The results are shown in Table 8.

TABLE 8

| Light-Sensitive Material | Reducing Substance | Fresh Dmax Y | Fresh Dmax M | Fresh Dmax C | Fresh Dmin Y | Fresh Dmin M | Fresh Dmin C | After Storage for 1 Week in Condition of 40° C., 80% RH Dmax Y | Dmax M | Dmax C | Dmin Y | Dmin M | Dmin C |
|---|---|---|---|---|---|---|---|---|---|---|---|---|---|
| A | (S-14) | 2.01 | 2.05 | 2.12 | 0.28 | 0.38 | 0.36 | 1.98 | 2.02 | 2.01 | 0.30 | 0.42 | 0.38 |
| B | (S-15) | 2.03 | 2.08 | 2.20 | 0.29 | 0.36 | 0.38 | 2.00 | 2.05 | 2.12 | 0.31 | 0.38 | 0.40 |
| C | 4-Hydroxymethyl-4-methyl-1-phenyl-3-pyrazolidone | 1.96 | 2.00 | 2.06 | 0.28 | 0.37 | 0.36 | 1.80 | 1.89 | 1.95 | 0.68 | 0.89 | 0.93 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a compound of the following general formula (I):

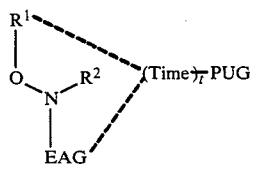

(I)

wherein EAG represents a group which accepts an electron from a reducing substance; N and O each represents nitrogen atom and an oxygen atom, respectively; $R^1$ and $R^2$ each represents a substituent other than a hydrogen atom, and when $R^1$ or $R^2$ is bonded to —(Time)$_t$PUG, $R^1$ or $R^2$ is a mere bond or a substituent other than a hydrogen atom, and $R^1$ and $R^2$ may be bonded to each other to form a ring; Time represents a group for releasing PUG via the subsequent reaction as triggered off by the cleavage of the nitrogen-oxygen single bond in the compound of general formula (I); PUG represents a photographically useful group; t is an integer of 0 or 1; the full lines in the formula each mean a bond; and the dotted lines therein mean that at least one of the dotted lines is a bond, wherein the single bond between the N atom and the O atom is cleaved when EAG accepts an election.

2. The silver halide photographic material as claimed in claim 1, wherein the compound of general formula (I) has general formula (II):

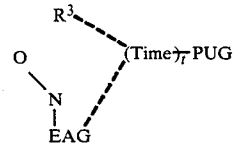

(II)

wherein $R^3$ is bonded to the nitrogen atom or oxygen atom in formula (II), and is an atomic group necessary for the formation of a 3 to 8-membered mono- or fused-hetero ring:

3. The silver halide photographic material as claimed in claim 1, where the compound of general formula (I) has general formula (III):

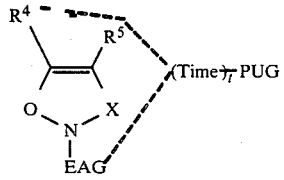

(III)

wherein $R^4$ and $R^5$ each represents a mere bond, a hydrogen atom or a substituent group, and $R^4$ and $R^5$ may be bonded to each other to form a saturated or unsaturated carbon ring or hetero ring; and X represents a divalent binding group.

4. The silver halide photographic material as claimed in claim 1, wherein EAG is a group represented by the following formula (A) or (B):

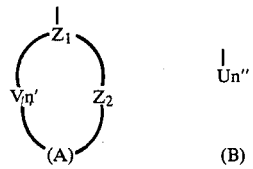

(A) (B)

wherein $Z_1$ represents

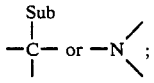

Vn′ represents an atomic group for forming a 3 to 8-membered ring together with $Z_1$ and $Z_2$; n′ is an interger of 3 to 8; meaning the following:

| | |
|---|---|
| $V_3$=—$Z_3$—, | $V_4$=—$Z_3$—$Z_4$—, |
| $V_5$=—$Z_3$—$Z_4$—$Z_5$—, | $V_6$=—$Z_3$—$Z_4$—$Z_5$—$Z_6$—, |
| $V_7$=—$Z_3$—$Z_4$—$Z_5$—$Z_6$—$Z_7$, | $V_8$=—$Z_3$—$Z_4$—$Z_5$—$Z_6$—$Z_7$—$Z_8$—; |

$Z_2$ to $Z_8$ each represents

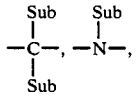

—O—, —S— or —$SO_2$—;

Sub represents a mere bond ($\pi$-bond) or a hydrogen atom or a substituent, and these Sub's may be the same or different, or they may be bonded to each other to form a 3 to 8-membered, saturated or unsaturated carbon-ring or hetero-ring; n'' is an integer of 1 to 6; meaning the following:

| | |
|---|---|
| $U_1 = -Y_1$, | $U_2 = -Y_1-Y_2$, |
| $U_3 = -Y_1-Y_2-Y_3$, | $U_4 = -Y_1-Y_2-Y_3-Y_4$, |
| $U_5 = -Y_1-Y_2-Y_3-Y_4-Y_5$, | $U_6 = -Y_1-Y_2-Y_3-Y_4-Y_5-Y_6$ |

$Y_1$ through $Y_6$ each represent

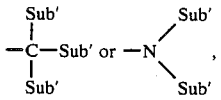

where

Sub' represents a mere bond ($\sigma$-bond or $\pi$-bond) or the same substituents.

5. The silver halide photographic material as claimed in claim 1, wherein EAG is an aryl group substituted by at least one electron-attracting group, an optionally substituted heterocyclic group or a monovalent residue of a quinone compound.

6. The silver halide photographic material as claimed in claim 1, wherein PUG is a diffusible dye.

7. The silver halide photographic material as claimed in claim 1, wherein PUG is a development inhibitor.

8. The silver halide photographic material as claimed in claim 1, wherein the material further contains a hydrazine derivative and PUG is a hydroxytetrazaindene compound.

9. The silver halide photographic material as claimed in claim 8, wherein the material is, after exposure, processed with a processing solution containing 0.15 mole/liter or more of sulfite ion and having a pH of 10.0 to 12.3.

10. The silver halide halide photographic material as claimed in claim 1, wherein the material further contains a reducing substance.

11. The silver halide photographic material as claimed in claim 10, wherein the reducing substance is an organic compound to follow Kendal-Pels formula.

12. A method for the formation of photographic images, wherein the silver halide photographic material as claimed in claim 10 is developed by heating after image-wise exposure thereof or simultaneously with image-wise exposure thereof.

13. The silver halide photographic material as claimed in claim 2, wherein the hetero ring is selected from the group consisting of:

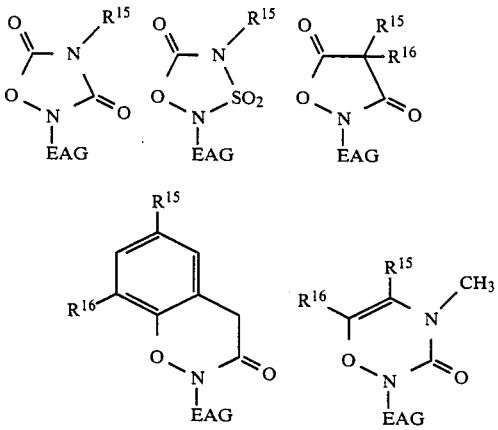

-continued

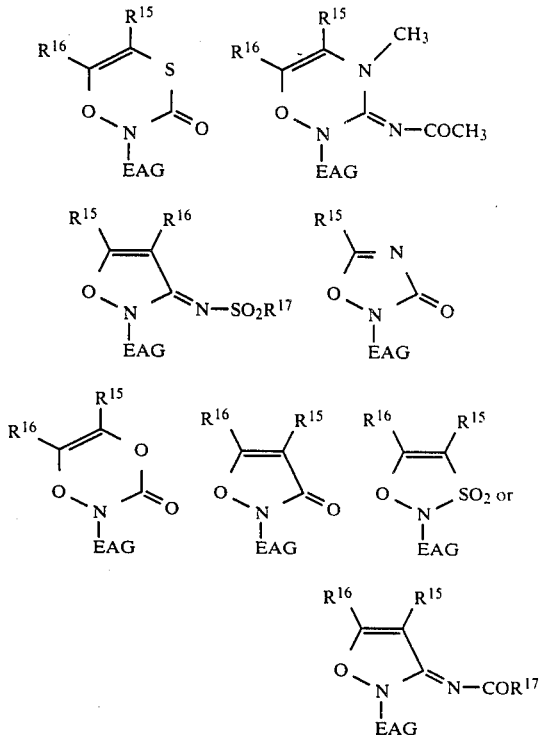

wherein $R^{15}$, $R^{16}$ and $R^{17}$ each represent a hydrogen atom, an aliphatic group, an aromatic group, a heterocyclic group or —(Time)$_t$PUG.

14. The silver halide photographic material as claimed in claim 3, where X is —CO— or —$SO_2$—.

15. The silver halide photographic material as claimed in claim 4, wherein the Sub's in formula (A) are selected so that the total of the Hammett's substituent constant $\sigma_p$ of the Sub's it +0.09 to +2.6.

16. The silver halide photographic material as claimed in claim 4, wherein the Sub's in formula (A) are selected so that the total of the Hammett's substituent constant $\sigma_p$ of the Sub's is +0.3 to +2.6.

17. The silver halide photographic material as claimed in claim 4, wherein the Sub's in formula (A) are selected so that the total of the Hammett's substituent constant $\sigma_p$ of the Sub's is +0.45 to +2.6.

18. The silver halide photographic material as claimed in claim 4, wherein the Sub's in formula (B) are selected so that the total of the Hammett's substituent constant $\sigma_p$ of the substituents is +0.09 to +2.6.

19. The silver halide photographic material as claimed in claim 4, wherein the Sub's in formula (B) are selected so that the total of the Hammett's substituent constant $\sigma_p$ of the substituents is +0.3 to +2.6.

20. The silver halide photographic material as claimed in claim 4, wherein the Sub's in formula (B) are selected so that the total of the Hammett's substituent constant $\sigma_p$ of the substituents is +0.45 to 2.6.

21. The silver halide photographic material as claimed in claim 5, wherein PUG is selected from the group consisting of development inhibitors, development accelerators, nucleating agents, couplers, diffusible or non-diffusible dyes, desilvering accelerators, desilvering inhibitors, silver halide solvents, competing compounds, developing agents, developing auxiliaries, fixing accelerators, fixing inhibitors, image stabilizers, toning agents, processing dependence improving agents, dot improving agents, color image stabilizers, photographic dyes, surfactants, hardeners, desensitizers, contrast intensifiers, chelating agents, fluorescent whitening agents and precursors thereof.

22. A process for forming an image comprising image-wise exposing the silver halide photographic material as claimed in claim 1 and subjecting the exposed photographic material to development processing in the presence of a reducing agent.

* * * * *